US009603471B2

(12) United States Patent
Green

(10) Patent No.: US 9,603,471 B2
(45) Date of Patent: Mar. 28, 2017

(54) BEVERAGE LID COVER FOR ENHANCING AROMA

(71) Applicant: Marie Green, Brentwood, TN (US)

(72) Inventor: Marie Green, Brentwood, TN (US)

( * ) Notice: Subject to any disclaimer, the term of this patent is extended or adjusted under 35 U.S.C. 154(b) by 0 days.

(21) Appl. No.: 14/804,275

(22) Filed: Jul. 20, 2015

(65) Prior Publication Data

US 2016/0015199 A1 Jan. 21, 2016

Related U.S. Application Data

(60) Provisional application No. 62/026,484, filed on Jul. 18, 2014.

(51) Int. Cl.
*A47G 19/22* (2006.01)

(52) U.S. Cl.
CPC ..... *A47G 19/2272* (2013.01); *A47G 2400/04* (2013.01)

(58) Field of Classification Search
CPC ..... A47G 19/2272; A47G 19/2266; A47G 19/2205; B65D 43/0204; B65D 43/0212; B65D 43/0214; B65D 43/0218; B65D 43/0222; B65D 43/02
USPC ..... 220/713, 711, 703, 287, 795, 780, 781, 220/802, 796; 229/404, 400
See application file for complete search history.

(56) References Cited

U.S. PATENT DOCUMENTS 3,065,875 A * 11/1962 Negoro ..... B65D 43/0212 220/784
4,113,135 A 9/1978 Yamazaki
4,138,033 A 2/1979 Payne et al.
4,415,097 A * 11/1983 Meins ..... B65D 25/42 220/711
4,619,372 A 10/1986 McFarland
5,911,331 A 6/1999 Boller
6,076,450 A * 6/2000 DiGiorgio, Jr. ..... A47J 31/02 210/244
6,164,485 A 12/2000 Hilton
6,302,268 B1 10/2001 Michaeli
D449,986 S 11/2001 Schaefer
(Continued)

FOREIGN PATENT DOCUMENTS

CA 2677938 A1 * 12/2010 ..... B65D 43/02

OTHER PUBLICATIONS

International Search Report, PCT Application PCT/US2015/041205, Nov. 10, 2015, 6 pages.
(Continued)

*Primary Examiner* — Robert J Hicks
(74) *Attorney, Agent, or Firm* — Aka Chan LLP

(57) ABSTRACT

A lid for a beverage cup includes a mouth opening, an aroma opening, and a concentrator member. The mouth opening is positioned closer to a rim of the lid than the aroma opening. An area of the aroma opening is greater than an area of the mouth opening. The concentrator member surrounds the aroma opening and extends from a plane formed by the aroma opening to a height above the aroma opening. A cross sectional area of the concentrator decreases in a direction from a base to an upper end of the concentrator, creating a concentration of beverage aromas in the space surrounding a user's nose. The concentrator channels a concentrated amount of aroma to the nose, providing an enhanced drinking and tasting experience.

20 Claims, 68 Drawing Sheets

(56) References Cited

U.S. PATENT DOCUMENTS

| | | | | |
|---|---|---|---|---|
| 6,357,619 | B1 | 3/2002 | Schaefer | |
| 6,578,726 | B1 * | 6/2003 | Schaefer | B65D 47/265 215/387 |
| D480,968 | S | 10/2003 | Atkins et al. | |
| 6,889,859 | B1 * | 5/2005 | Leon | B65D 51/24 220/254.3 |
| D518,996 | S | 4/2006 | Schmidt | |
| 7,111,749 | B1 | 9/2006 | Akers | |
| 7,191,911 | B2 | 3/2007 | O'Neill | |
| 7,959,028 | B2 | 6/2011 | Leon | |
| 8,056,752 | B2 * | 11/2011 | Carnevali | B65D 43/0212 220/372 |
| 8,167,162 | B2 * | 5/2012 | Levey | B65D 51/185 220/212 |
| 8,313,002 | B2 | 11/2012 | Tokunaga | |
| 8,496,983 | B2 | 7/2013 | Michaeli et al. | |
| 2004/0089662 | A1 | 5/2004 | Smith et al. | |
| 2008/0000921 | A1 | 1/2008 | Leon | |
| 2009/0250479 | A1 | 10/2009 | Kaufman et al. | |
| 2009/0266829 | A1 | 10/2009 | Bailey | |
| 2009/0283526 | A1 | 11/2009 | Pierce et al. | |
| 2010/0301048 | A1 | 12/2010 | Tokunaga | |
| 2011/0114655 | A1 * | 5/2011 | Bailey | B65D 43/0214 220/713 |
| 2011/0155732 | A1 | 6/2011 | Sprunger | |
| 2011/0174658 | A1 * | 7/2011 | Otsubo | B65D 21/0219 206/508 |
| 2011/0303678 | A1 | 12/2011 | Zomorodi et al. | |
| 2012/0152968 | A1 | 6/2012 | Bailey | |
| 2012/0199584 | A1 | 8/2012 | Pensak | |
| 2013/0020338 | A1 * | 1/2013 | French | B65D 43/0208 220/713 |
| 2014/0042177 | A1 | 2/2014 | Fleming | |
| 2014/0042178 | A1 | 2/2014 | Brannock | |

OTHER PUBLICATIONS

Written Opinion, PCT Application PCT/US2015/041205, Nov. 10, 2015, 7 pages.

FoamAroma Web Pages, retrieved from www.foamaroma.com on Jul. 9, 2014, 16 pages (2011).

Koziol Insulated Cup Aroma To Go Product Reference, retrieved from http://www.amazon.com/Koziol-Insulated-Aroma-Orange-Hand/dp/B0073LRJQ2/ref=sr_1_3?ie=UTF8&qid=1437524088&sr=8-3&keywords=koziol+aroma+cup on Jul. 21, 2015, 5 pages (2013).

* cited by examiner

BEVERAGE LID COVER FOR ENHANCING AROMA

CROSS-REFERENCE TO RELATED APPLICATIONS

This application claims the benefit of U.S. patent application 62/026,484, filed Jul. 18, 2014, which is incorporated by reference along with all other references cited in this application.

BACKGROUND OF THE INVENTION

The present invention relates to lids for beverage containers including disposable and nondisposable cups, mugs, thermoses, glasses, bottles, tea and soup bowls, and other drinking vessels. More particularly, the present invention relates to an improved lid for to-go use which can provide a person with simultaneous exposure to the taste and aroma of the beverage, thus providing a person with improved flavor perception, tasting experience, and safety from spills.

Everyday, across the world, people consume hot beverages throughout the day. In some countries, the day does not begin until a person has a cup (or several cups) of hot coffee or tea. Coffee, tea, and other hot beverages are consumed throughout the day, including after meals, with snacks, as pick-me-ups, and late into the night. Hot beverages are also consumed at all times of the year, and even during the warm seasons in many cultures. It is consumed in the home, at work, in cafes and restaurants, in the car, on public transportation, while walking, during recreational activities, during social gatherings, and many other settings. In recent years, the global hot beverages market accounted for almost one-third of global beverage volume consumption. In the U.S. alone, currently more than half of Americans over the age of 18 drink at least a cup of coffee each day. Hot beverage consumption continues to grow as branded hot beverage products gain more presence.

Hot beverage drinkers generally drink the beverage from a mug, or a disposable cup, travel mug, or thermos for on-the-go use. For many people, drinking a hot beverage from a mug is a more enjoyable experience than from a disposable cup. A person can control the amount of hot liquid consumed with each sip, while fully enjoying the aromas that waft from the beverage. For many coffee enthusiasts for example, the smell of the coffee is equally important, if not more so, as the taste of the coffee. The aroma of the beans provides more sensory information to the person to provide a fuller and richer tasting experience.

Disposable cups on the other hand, do not provide the same drinking experience as mugs. Disposable cups are provided with disposable lids which greatly limit how much liquid and aroma pass to the person. Most of these lids have a small hole that force the hot liquid into the person's mouth with little, if any, control. This can cause burns. The lid also limits the desirable aromas from being inhaled by the person while drinking. Most times, the person can only taste a sweet or bitter taste to the hot beverage, but cannot taste the full range of flavors of the drink, thus making the drink taste more bland than it actually is. In fact, the person may even smell the plastic or Styrofoam material of the lid instead. While some conventional lids may include a pinhole or vent to release steam, these openings are not sufficient to allow aromas to escape. What little aroma does escape is quickly dissipated into open air.

With a lid, a person may also not have sufficient space to place the nose while drinking. Lids generally have a flat surface, or a small indentation, on which the person's nose can hit with each sip. This forces the person to tip their entire head back just to finish the liquid at the bottom of the cup. This is uncomfortable for the person, and can cause dangerous or unpleasant results since hot liquids can spill or leak out of the top onto the person's body and clothing. Further, leaning the head back can cause the person to look away from where they are going while walking or driving, which can lead to very unsafe situations.

Thus, there is a need for a lid for a beverage cup or mug that provides a person with a natural and comfortable space for the nose while drinking. The lid also provides open areas to allow the aroma of the beverage to reach the person's nose to give a more pleasurable drinking experience. In particular, there is a need for an improved lid to allow for the aroma to be channeled more directly to the nose in an enclosed lid in order to provide the person with a full and concentrated aroma.

BRIEF SUMMARY OF THE INVENTION

The lid described in this patent provides: (1) features to allow access of a user's nose to beverage aromas; (2) concentration of the aromas for a more intense smell sensation; (3) an ergonomic shape to allow and fit the user's nose through a opening of the lid to access the aromas; (4) components to allow the consumer to visually see the elements of the beverage in the cup (e.g., color, richness, steam, solids, foam, spices, and many others) the level of the beverage in the cup; (5) improved heat dissipation; and (6) an opening of a sufficient size to allow stirring of the beverage through the opening of the lid without having to remove the lid. The lid can be easily stacked where one lid fits over and onto the top of another lid. This allows for compact packaging which is desirable in transport where space is often limited, and in storage in warehouses, cafes, offices, and restaurants. The lid is more ergonomic, increases tasting experience, and is safer to use than conventional lids.

A container lid includes a rim portion; a front wall portion, connected to the rim, where the front wall will face toward a user's face, and the front-facing wall extends in first and second rotation directions between first and second wall ridges; a back wall portion, connected to the rim and the front wall, where the back wall extends between the first and second wall ridges, and extends in a first direction above the rim portion to a lid top; a base portion, connected to the rim, where from the base portion, the front wall extends in the first direction toward the lid top; a first opening (e.g., mouth opening), formed in the base portion; and a second opening (e.g., aroma opening), separate from the first opening, extending from the base portion in the first direction toward the lid top, where an inside surface of the back wall faces the first opening.

In an implementation, a first width of the first opening can be greater than a first length of the first opening. A second width of the second opening can be less than a second length of the second opening. The second length is greater than the first length, and the second width can be greater than the first width. In an implementation, the second width decreases from a first side to a second side of the second opening, where the first side is closer to the first opening than the second side of the second opening. An area of the aroma opening can be greater than an area of the mouth opening.

In an implementation, the first and second openings can overlap or merge to form a combined opening to accommodate the person's mouth and to allow aroma to escape the cup. The combined opening can have any area.

In a specific implementation, a lid for a cup includes a base portion surrounded by a rim portion of the lid. The rim portion is adapted to connect the lid to a rim of a cup. The rim portion can form a seal with a lip of the cup. The base portion includes a mouth opening and an aroma opening. The lid includes a first wall, connected to the rim portion, extending upward to a lid top that can be above the aroma opening. The first wall can direct the aroma (or deflect a flow direction of aroma molecules) toward the person's nose.

The first wall surrounds the aroma opening. This will allow the aromas that escape from the aroma opening to be blocked from drifting away and dissipating into the air. The first wall forms a space on an inside of the lid, where the aromas can remain. In an implementation, the user's nose passes through the aroma opening into the space in the lid while drinking. This will allow the aromas concentrated in the lid to be channeled toward the nostrils.

In various implementations, a wall of the lid, opposite to the aroma opening, is angled at a first angle with respect to the base portion. The first angle can range from about 30 degrees to about 90 degrees. The wall is angled toward the opening.

The lid can include a dome lid. A container lid includes: a rim portion; a dome portion, coupled to the rim; an opening formed in the dome portion, where the opening extends from a first rim position to the second rim position, the opening includes a first edge extending from the first rim position to a first dome position, a second edge extending from the first dome position to a second dome position, and a third edge extending from the second dome position to the second rim position. From the first rim position to the first dome position, the first edge has a positive slope, having an increasing elevation compared to the first rim position. From the third dome position to the second rim position, the third edge has a negative slope, having a decreasing elevation compared to the third dome position. From the first dome position to the second dome position, the second edge has a point having zero slope.

In a specific implementation, an angle between the first rim position and second rim position is about 180 degrees or less. In another specific implementation, an angle between the first rim position and second rim position is about 60 degrees of less. In another specific implementation an angle between the first rim position and second rim position is about 45 degrees of less.

A method includes: providing a rim portion; providing a front wall portion, connected to the rim portion, where the front wall will face toward a user's face, and the front-facing wall extends in first and second rotation directions between first and second wall ridges; providing a back wall portion, connected to the rim portion and the front wall, where the back wall extends between the first and second wall ridges, and extends in a first direction above the rim portion to a lid top; providing a base portion, connected to the rim portion, where from the base portion, the front wall extends in the first direction toward the lid top; providing a first opening, formed in the base portion; and providing a second opening, separate from the first opening, extending from the base portion in the first direction toward the lid top, where an inside surface of the back wall faces the first opening.

In an implementation, a lid cover apparatus for a beverage container includes a rim. The rim is typically circular, but can be other shapes (e.g., rectangular, hexagonal, octagonal, and so forth) that and fit on an open top of the beverage container. The rim has a sealing inside surface that mates with an edging formed on the top of the beverage container. This mating create a leakproof seal, so that when a person drinks from the container with the lid on, liquid will not leak from the rim. The rim elastically stretches to fit over the edging of the top of the beverage container and elastically contracts to its original size to couple against an outside of the top edging of the beverage container. An implementation can include an adjusting rim sizing mechanism, which is described further below in this application.

The lid cover has an upper covered portion that is connected to the rim. The upper covered portion forms a top of the lid cover. The covered portion extends in a direction away from the beverage container opening when the lid cover is coupled to the beverage container, such that the covered portion does not drop below an edge of the rim cup to which it is attached. In an implementation, the upper covered portion has a dome shape.

The lid cover has a mouth opening that is formed in the upper covered portion of the lid cover. A user uses the mouth opening to drink a beverage, usually a liquid or fluid that can include vapors and steam, that is contained in an interior space of the beverage container.

The lid cover has an aroma opening formed in the upper covered portion of the lid cover. The aroma opening is larger than the mouth opening. The aroma opening extends further in a direction away from the beverage container than the mouth opening, so that a distance from the top of the aroma opening to the rim of the cup (when attached) is longer than a height of the mouth opening. In some implementations, the mouth opening and aroma opening are combined into a single opening.

When the lid cover is used by a user and the mouth is placed at the mouth opening to drink from the beverage container, at least a portion of the upper covered portion is above and forms over at least a portion of the user's nose. Thus, the upper covered portion of the lid cover envelopes and exposes the nose to interior space of the beverage container while separating the nose from an exterior space outside the beverage container. The user can enjoy the aromas and fragrances from within the beverage container space through the user's nose (and nostrils), unimpeded by a boundary or a lid wall of the lid cover.

In various implementations, the aroma opening has an aroma opening covering. To allow use by the user, the aroma opening covering is pulled away from the upper covered portion to reveal the aroma opening. The aroma opening covering can be a removable and disposable piece of the upper covered portion (e.g., aroma cover is torn completely off the lid cover). The aroma opening covering can be opened and reclosed into the upper covered portion (e.g., aroma cover remains attached to lid cover after opening).

Alternatively, the aroma opening covering is a removable and remains connected to the upper covered portion. The upper covered portion includes at least one of a fastening peg (e.g., a portion protruding from the lid cover) or fastening groove (e.g., a portion protruding into the lid cover) that will retain or hold the aroma opening covering in the open position, away from the aroma opening. Further, the aroma opening covering can be pulled off the fastening peg or fastening groove and used to reclose the opening.

Further, like the aroma opening, the mouth opening can have a mouth opening covering. To allow drinking or use by the user, the mouth opening covering is pulled away from the upper covered portion to reveal the mouth opening.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1:
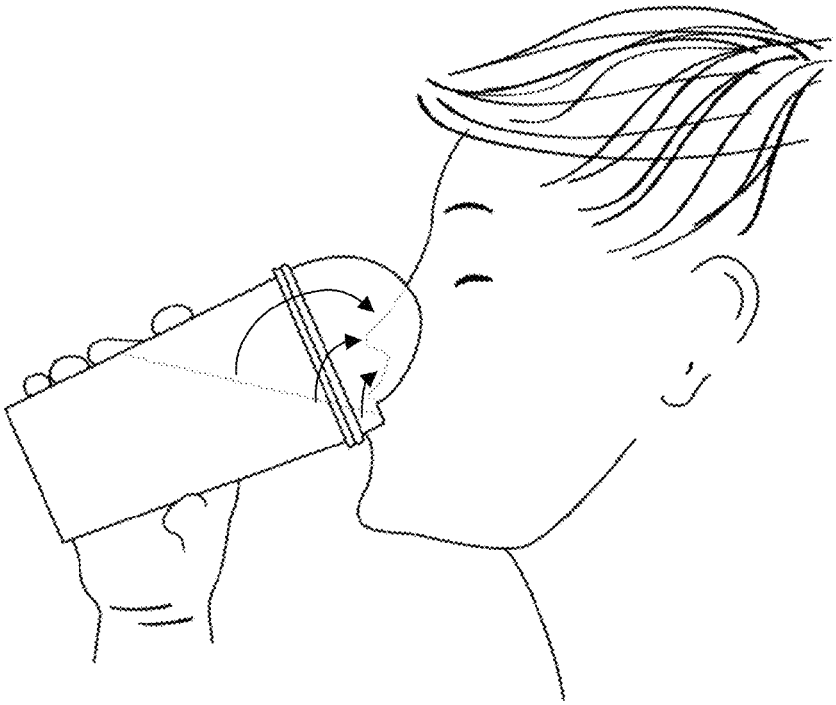
FIG. 1 shows a lid with aroma opening in use.

FIG. 1 shows a lid for a beverage container. An opening of this lid allows the user to insert the user's nose, so that the user can smell the aromas of the beverage while drinking. This opening can be referred to as an aroma opening of the lid. This lid with aroma opening can enhance the drinking and tasting experience.

Figure 2:
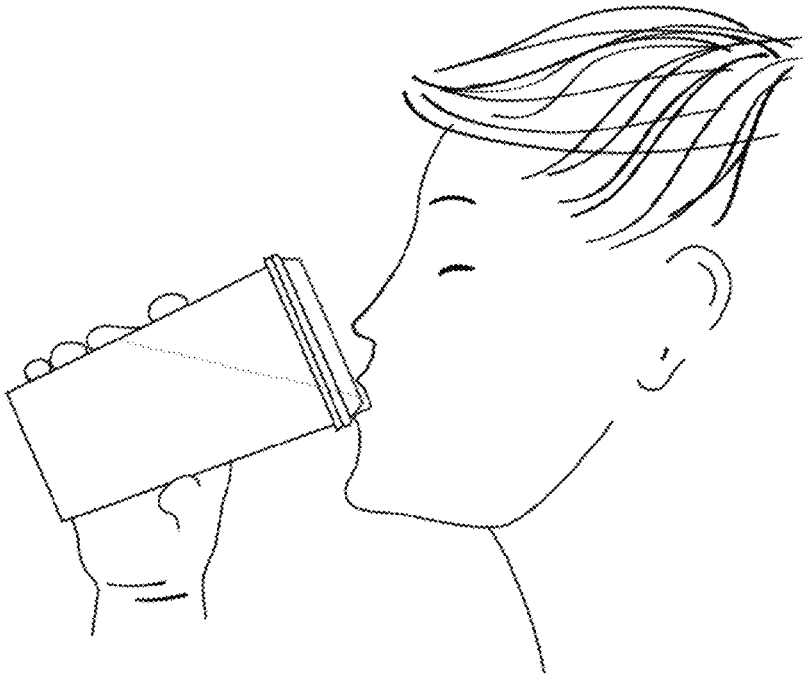
FIG. 2 shows a conventional lid without an aroma opening in use.

Other lid designs, such as in FIG. 2, do not have an aroma opening. Such lids have an opening that allows the user to drink or sip, but no opening that allows the user to smell the aromas of the beverage while drinking.

A lid with an aroma opening can enhance the drinking and tasting experience. The sense of smell and taste are closely linked. The sense of taste is significantly affected by the sense of smell. Some studies have shown that aroma, or smell, of food and beverages contributes to about 75 percent of its flavor.

The taste buds of the tongue identify taste, and the nerves in the nose identify smell. Both sensations are communicated to the brain, which integrates the information so that flavors can be recognized and appreciated. Some basic tastes—such as salty, bitter, sweet, and sour—can be recognized without the sense of smell. However, more complex flavors (such as fruit, coffee, herbal, metallic, and other flavors) require both taste and smell sensations to be recognized.

Tastes and smells are the perception of chemicals in the air or in food. The senses of taste and smell are separate senses, with their own receptor organs. However, taste and smell senses work very closely together in how people perceive the flavors of food and drink. For example, a person with a cold, having a blocked nasal passage, may complain they cannot taste their food and drink. This is because the olfactory receptor cells in the nose, responsible for detecting smells, and inflamed and blocked. In other cases, many people who think they have a taste disorder actually cannot appreciate the flavor of food because they have lost some ability to smell.

The terms flavor and taste are often confused. The human tongue can only detect four basic taste sensations: sweet, sour, bitter, salty, and a fifth sensation called umami. When these tastes, along with texture, temperature, spiciness or irritation combine with aroma, the perception of flavor occurs. Flavor defines the food that is eaten, and is recognized mainly through the sense of smell.

To distinguish most flavors, the brain needs information about both smell and taste. These sensations are communicated to the brain from the nose and mouth. Several areas of the brain integrate the information, enabling people to recognize and appreciate flavors.

When people eat and drink, first they smell the aroma released from the product that provides an anticipation of the flavor they are about to taste. People smell their food to determine freshness and to gauge if they will like what they are about to eat. Therefore, an enticing aroma tells a consumer that this is something they want to eat or drink.

Next, as foods and beverages enter the mouth, tastants, chemicals in foods, are detected by taste cells in the lining of the mouth and throat and taste buds on the tongue. Taste cells are stimulated by tastants such as sugars, salts, or acids, and send signals to specific areas of the cerebral cortex of the brain. In the brain, receptors respond to the signals to interpret the signals as one or more of the basis tastes, sweet, sour, bitter, and salty.

Simultaneously, airborne odor molecules, called odorants, are detected by olfactory sensory neurons located in a small patch of mucus membrane lining the roof of the nose. Odorants can get to the sensory neurons either through the nostrils or through a channel that connects the roof of the mouth to the nose.

Odorants stimulate receptor proteins found on hair-like cilia at the tips of the sensory cells, a process that initiates a neural response. An odorant can act on more than one receptor. Similarly, a single receptor can interact with more than one different odorant. Therefore, each odorant can cause a specific pattern of neural activity. This pattern of activity is then sent to the olfactory bulb, where other neurons are activated to form a spatial map of the odor. Neural activity created by this stimulation passes to the primary olfactory cortex at the orbital part of the frontal lobe of the brain. The brain interprets the signal as a specific smell. The brain also processes the combination of smell and taste information, along with other sensory information, to create the perception of flavor.

Returning to FIG. 1, in an implementation, the aroma opening will accommodate the user's nose, such as the nostrils and at least a portion of the dorsum of the nose (or nose ridge or nose bridge). In other implementations, the aroma opening can accommodate the entire nose ridge from tip to nose root.

In addition to the aroma opening, the lid can include a separate opening for a user's mouth, through which the user drinks the beverage liquid. In other implementations, the lid can have a single opening for the user's mouth and also for the nose. And in further implementations, the lid can have additional openings or features in addition to the aroma opening.

In an implementation, as shown in FIG. 1, the beverage's aromas flow from the beverage (represented by the arrows) in an enclosed space inside the lid. The aromas waft up, away from the surface of the beverage, where the person's nose is positioned. Aromas closer to the nose directly get inhaled by the nose. The path of travel for these aromas can be short. Aromas farther away from the nose waft up from the beverage surface, flow away from the beverage, and can be channeled by the walls of the lid back toward the nose. In other words, a wall of the lid can guide (or channel, direct, or funnel) the aromas toward the nose. This creates a concentrated presence of aroma for the nose to intake.

This effect is more apparent when the beverage is hot, and steam can carry aromas as steam rises from the surface of the hot liquid. The walls of the lid will trap the rising steam from going into the air and keep the steam, with the aromas, concentrated around the person's nose. Further, as the person exhales into the lid, the exhaled air can cause more heat and steam to rise, along with more of the aroma molecules. The aromas can immediately permeate the space within the lid since the heat molecules have high kinetic energy and can move very fast in the enclosed space of the lid. The walls of the lid can be angled toward the person's nose so that more of the concentrated aromas can be directed toward the nose.

With the user's nose being able to extend into the lid, the user does not need to worry about hitting the tip of their nose against an upper surface of the lid with each sip, like with other conventional lids. To dispense a sufficient amount of the liquid from the mouth hole, the user must tilt their head back more and more as the liquid level becomes lower in the cup. This can be quite uncomfortable on the person's neck. Further, when liquids from the cup have a greater risk of leaking or spilling out if the seal between the lid and the cup is not strong. And when the user tilts his head back, he or she momentarily takes their eyes away from the forward direction, which can cause a dangerous situation (e.g., bumping into a person or object while walking, or crashing into a person, car, or other object while driving).

With the lid with aroma opening, the opening accommodates the user's nose, or a portion of the nose, within the lid itself. In an implementation, the user can comfortably extend their nose into the lid without the nose pressing against any part of the lid. This feature prevents or minimizes contact of the nose with the lid while drinking. This allows the person to keep the neck and head more upright while drinking, and tilting the cup minimally to access the beverage from the cup, thereby keeping the person's field of vision in a forward direction.

Figures 3A, 3B:
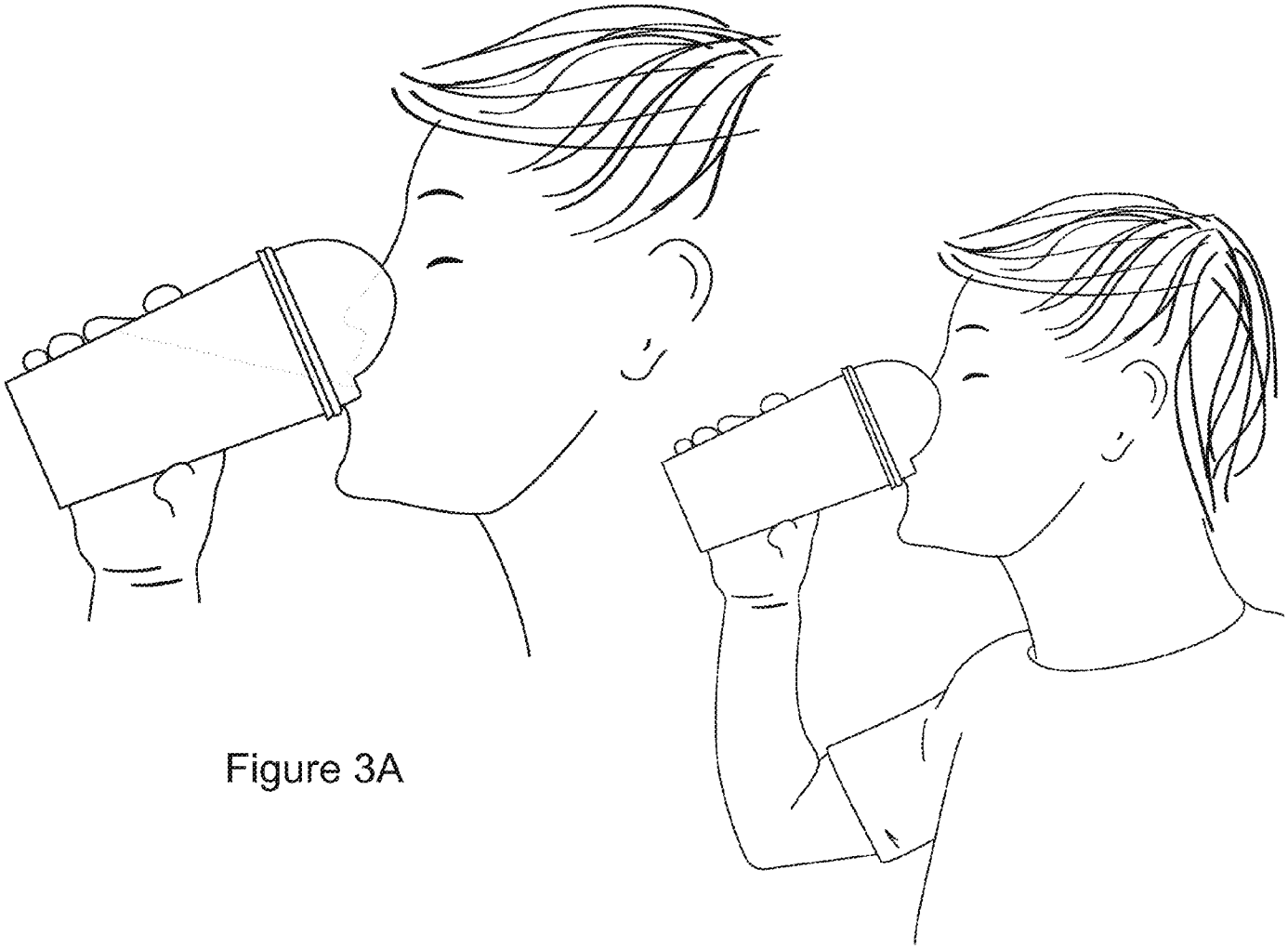
FIG. 3A shows an inside view of a specific implementation of a lid with aroma opening in use.
FIG. 3B shows an outside view of the lid in use.

FIGS. 3A-3B show a person using a specific implementation of a lid with aroma opening. The lid includes a mouth opening, an aroma opening, a wall, an opening for a person's nose, and a mounting member that interfaces with a cup. FIG. 3A shows an inside view of the cup and lid, with the person's nose passing through a surface of the lid into the lid. There is FIG. 3B shows an outside view of the lid, where the person's nose is positioned inside the lid while drinking.

Figure 4:
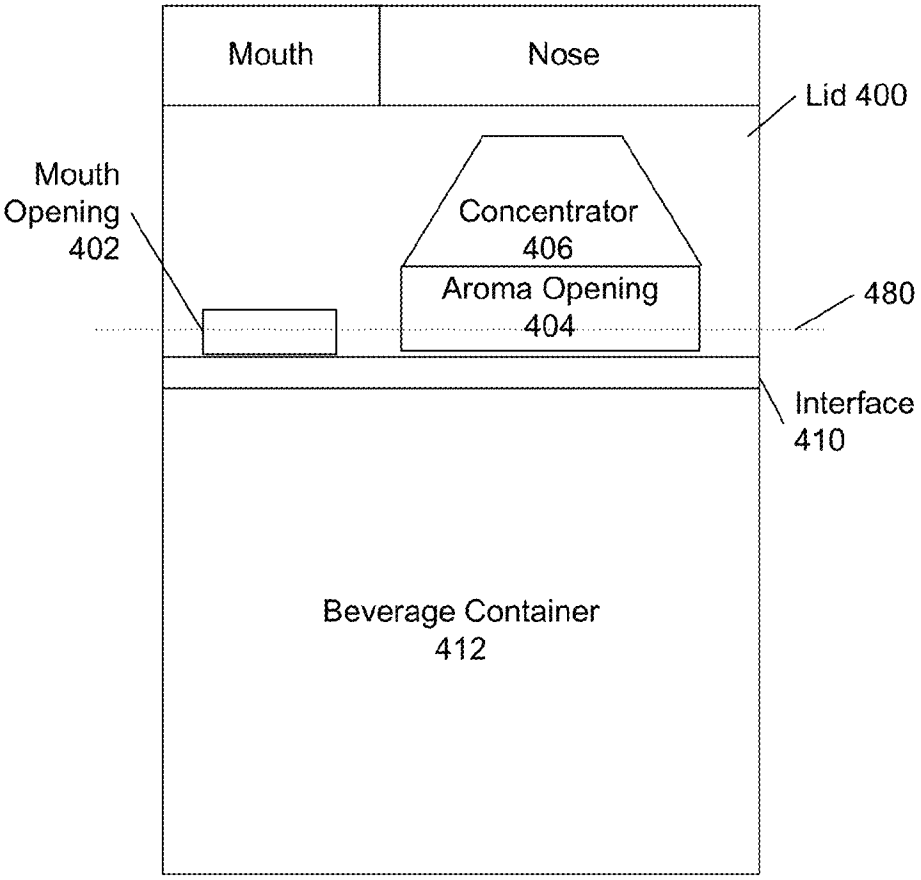
FIG. 4 shows a block diagram of a lid with an aroma opening. A user's mouth and nose interacts with components of the lid.

FIG. 4 shows a block diagram of a lid with an aroma opening. The lid 400 includes a shell of material that is molded, extruded, or otherwise fabricated to include one or more openings to interact with the person's sensory organs (e.g., mouth, nose, and eyes) to enhance the drinking and tasting experience. The openings of the lid are positioned to correspond to features of the person's face. A user's mouth and nose interacts with components of the lid. The lid includes a mouth opening 402, an aroma opening 404, a concentrator member 406, and an interface 410, for coupling the lid to a beverage container 412 (e.g., a cup, disposable cup, mug, glass, or thermos).

The mouth opening is positioned closer to a rim of the lid than the aroma opening. The aroma opening is positioned in a first direction ahead of the mouth opening. The aroma opening can be positioned where a user's nose will be located when the user's mouth is drinking (i.e., when the mouth is over the mouth opening). The mouth opening is an opening in the lid that is cut or molded in the material of the lid. The mouth opening can also be punched through the lid (e.g., pre-punched by the manufacturer, or punched by the user upon use). The size and shape of the mouth opening accommodates the user's lips so the upper and lower lips can position around the edge of the mouth opening to form a seal around the opening while drinking. The user's mouth interacts with the mouth opening to allow an amount of fluid to flow from the opening at a sufficient rate to fill the mouth. The mouth can also interact with the opening by sucking on the opening to control the amount and rate of fluid that flows out. More details on the shape, size, and positioning of the mouth opening are described below for FIGS. 5 and 6.

The aroma opening is an opening in the lid that is cut or molded in the material of the lid. The aroma opening can also be punched through the lid (e.g., pre-punched by the manufacturer, or punched by the user upon use). The aroma opening can be positioned on a same plane as the mouth opening, or below or above a plane of the mouth opening. The aroma opening can be aligned with the mouth opening along an axis 480 passing through the lid. The aroma opening can have a width that is greater than a width of the mouth opening, and a length greater than a length of the mouth opening. The aroma opening can have a height dimension, where the aroma opening can extend above the mouth opening.

An area of the aroma opening is greater than an area of the mouth opening. The size of the aroma opening can vary depending on factors such as lid size, drink container size, aroma flow rate, heat dissipation rate, size of an average consumer's nose, consumer comfort, and many others. In various implementations, the mouth opening can have a first area, the aroma opening can have a second area, and the second area can be about 1.5 to 150 times the first area.

The person's nose can interact with the aroma opening to intake smells that escape from the beverage in the beverage container through the aroma opening. In use, when the person's mouth is positioned over the mouth opening, the aroma opening will be positioned under the openings to the person's nostrils.

A larger aroma opening can provide other sensory benefits besides smell and taste, including sight and feel. With a larger aroma opening, a user can more easily see the contents of the beverage container to gauge how much is remaining, how far to tip the cup to reach the remaining liquid, and how hot or cold the beverage is, to determine how quickly to tip the cup towards the mouth. Many people also enjoy looking at the beverage to increase the enjoyment of drinking the beverage. For example, the steam rising from the beverage can comfort the person on a cold day or if the person is sick. The color of the beverage can also provide information about the beverage. For example, a coffee with a dark, opaque color will be stronger than coffee that is a clearer, light brown color. Many coffee drinkers also enjoy looking at the milk foam or the crema that is on the surface of the drink. Coffee connoisseurs often judge a cappuccino by the quality of the milk foam, of an espresso by the quality of the crema layer. Many coffee drinkers also enjoy looking at the coffee art created by their barista. This an image created on the top surface of an espresso drink when pouring the foamed milk over the espresso in the cup. A larger opening can also allow more heat to escape, thereby warming the user's nose and face. The user can sense how hot the beverage is, and can also blow on the beverage to cool it off if it is too hot to drink. More details on the shape, size, and positioning of the aroma opening are described below for FIGS. 5 and 6.

The lid includes a concentrator member 406 that is connected to the aroma opening. The concentrator concentrates the aromas of the beverage for the user. The concentrator typically surrounds the aroma opening, and can extend to a first height. The height of the concentrator can be about the same as a height of the aroma opening, or greater. The concentrator is defined by inside surfaces of the lid. These inside surfaces deflect and trap aromas from the beverage inside a space defined by the inside surfaces of the lid. When the lid is attached to a beverage container, heat and aromas from the beverage are enclosed in this space, being blocked by the walls from dissipating into the air.

The concentrator extends from a first end to an upper end, opposite the first end, of the lid. The first end is closer to a rim of the lid than the upper end. Typically, a cross sectional area of the concentrator decreases in a direction from the first end to the upper end. In some implementations, at the first end is a maximum area of the concentrator and at the upper end is a minimum area. One or more walls of the concentrator can be sloped to create a narrowing of the area. In other implementations, one or more walls of the concentrator comprise curved surfaces. The narrowing of the area of the concentrator from the first end to the upper end creates a concentration of the beverage aromas. As aroma vapors rise in the concentrator space, there is a greater density of aroma per square unit of area as the area decreases. This concentrates the aromas in the space surrounding a user's nose. The concentrator channels a concentrated amount of aroma to the nose.

As discussed above, the walls of the concentrator prevent the aromas from escaping into the air. As aroma vapors contact the inside of the walls, their flow direction is redirected (or deflected) in other directions toward the nose. This allows for a constant flow of aromas toward the space around the nose. This effect is more apparent with hot beverages, where the vapors carrying the aromas have greater kinetic energy. The vapors move quickly within the walls of the concentrator to saturate the space.

Figure 13:
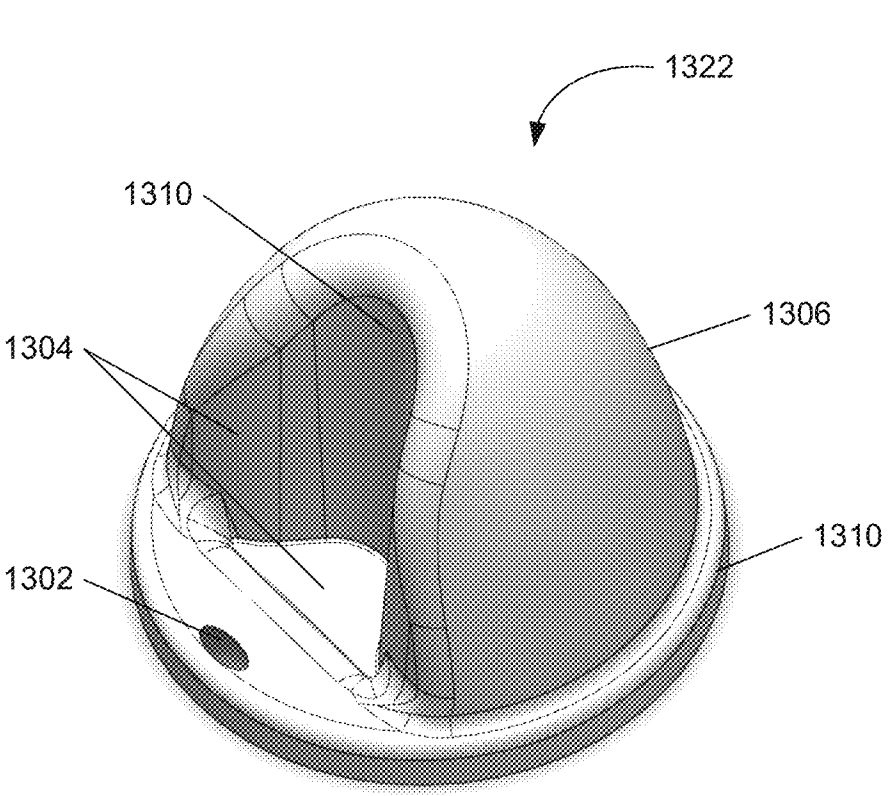
FIG. 13 shows another specific implementation of a lid.

In a specific implementation, as shown in FIG. 13, the concentrator can be formed by one or more walls of the lid on an outer surface of the lid. The one or more walls can surround the aroma opening and extend in a first direction (vertical) above the aroma opening, to direct aromas from the aroma opening to a person's nasal openings. The concentrator can be referred to as a channel, a vent, or a passageway. More details on this implementation are discussed below for FIG. 13.

The lid can also include deflector (not shown) that can replace concentrator 405 or be integrated with the concentrator or otherwise combined with the concentrator. The deflector will deflect the aromas from the beverage toward the face, and more specifically the nose and nostrils of the user. The deflector of the lid may be known by other terms such as reflector, vent, passageway, channel, or others.

In an implementation, the lid can include a deflector without a concentrator, where the aromas from the beverage are deflected toward the user's nose. In another implementation, the lid can include a deflector with concentrator, where the aromas from the beverage are deflected toward the user's nose and also concentrated.

Figure 6:
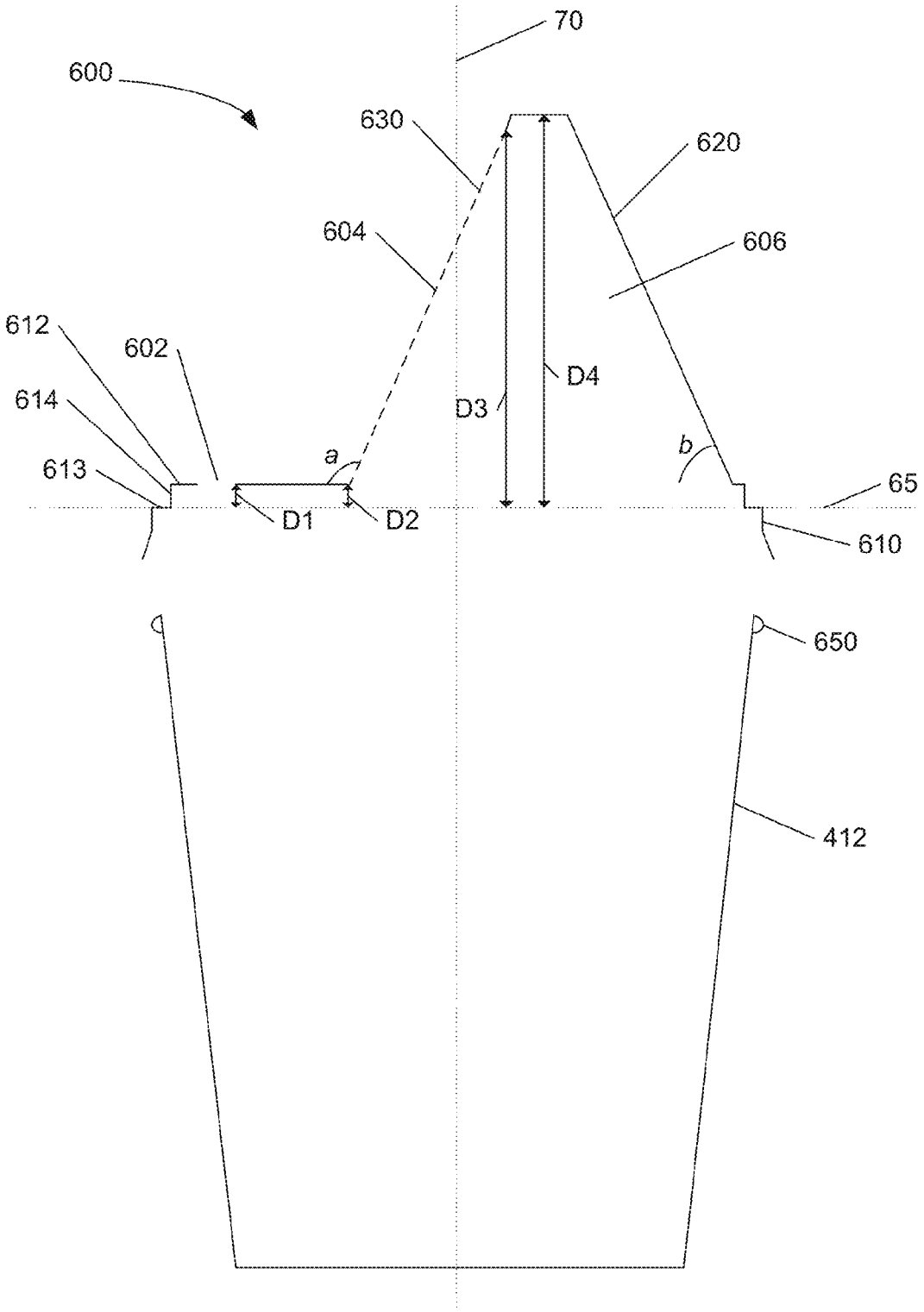
FIG. 6 shows a cross section of a specific implementation of a lid.
Figure 25B:
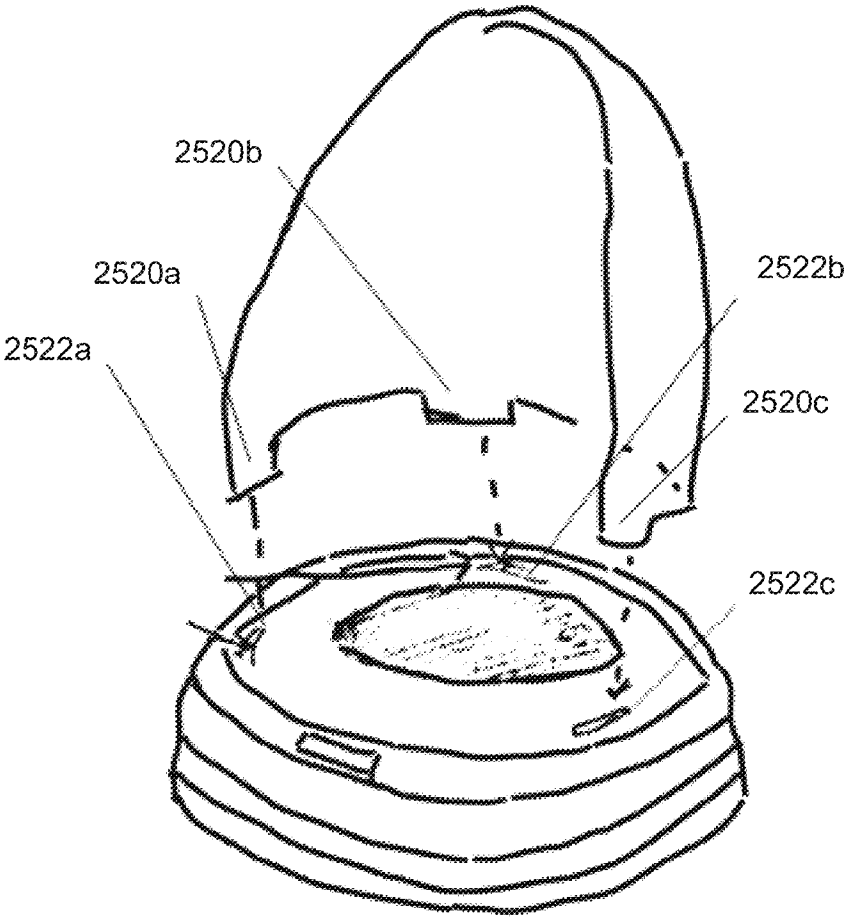
FIG. 25B shows the dome portion removed from the lid of FIG. 25A.
Figure 25A:
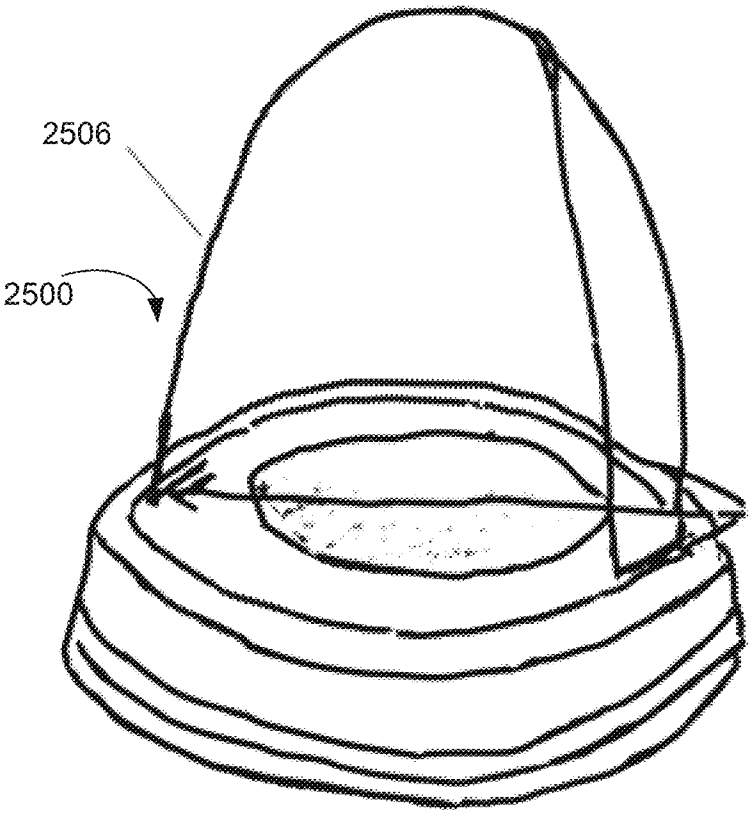
FIG. 25A shows a specific implementation of a lid with a removable dome portion where the lid and dome portion are connected.

As an example, an inside of wall 620 of FIG. 6 can act as a deflector. In FIG. 25A, lid top 2506 may be referred to as a deflector because the aromas that rise from the opening in the rid will be channeled off (or bounces or reflects off) the lid top toward the user's nose. The aromas rise because hot or warm air rises carrying the aromas with the rising arise. Also, aromas rise since they tend to be composed of lighter or more volatile molecules than air molecules.

In a specific implementation, the lid includes a holder. As an example, an inside of a wall of lid wall can have a holder, as shown in FIGS. 26A-26D. The holder can include a piece of permeable material (e.g., woven or knit, or with holes in the material) that is attached along an edge of the material to the inside of the lid wall. The holder includes an opening that is connected to an inside space or cavity of the holder. The holder can be for holding substances with aromatics or medical ingredients, or both. This can include coffee beans, coffee grounds, a tea bag, tea leafs, herbs (e.g., lavender, lemon verbena, basil, mint, and others), spices (e.g., ginger, cinnamon, nutmeg, allspice, vanilla, cardamom, and others), other aromatics (e.g., eucalyptus, menthol, aloe, and others), medicinal ingredients such as menthol or honey, or other ingredients to soothe a person with a sinus infection or a cold. Steam from hot liquid can pass through the permeable material to the contents of the holder, causing the steam trapped inside the lid to become infused with the aromas of the contents.

The lid can be attached to and removed from a beverage cup. The beverage cup can be a disposable cup (e.g., paper cup, hot beverage cup, cold beverage cup, or others). The lid includes an annular rim, flange, or lip, that can be placed on the rim portion of an open end of a drinking container, and connects to the rim of the cup by the interface member 410. The interface member can include a sealing groove, for frictionally engaging the rim portion of the cup to hold the lid in place. This engagement generally forms a seal between an inner surface of the lid and the rim portion of the cup, preventing spillage or leaks of the beverage contents. To attach the lid to the cup, a user can press fit the lid over the cup, and can generally feel the lid snap into place over the rim portion of the cup. To remove the lid, the user can lift the lid off starting from one end of the lid to the other end.

In other implementations, the interface member can include a fastening member to attach the lid onto an edge of the cup or a mug. The fastening member can include a clasp, a hook, a snap on connector, a grip, a screw thread, or any combination of these. The interface can also include a seal (e.g., O-ring) for sealing the lid to the rim of the cup to prevent spillage.

Figure 5:
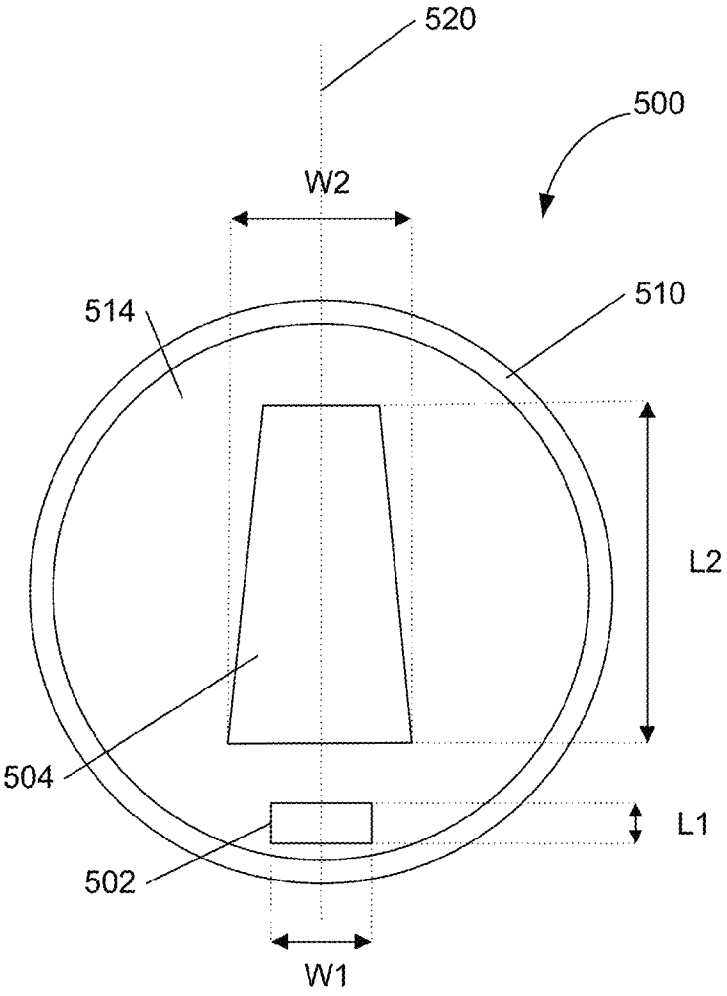
FIG. 5 shows a block diagram of a top view of specific implementation of a lid.

FIG. 5 shows a block diagram of a specific implementation of a top of a lid 500. The lid includes a rim portion 510 and a base portion 514 connected to and surrounded by the rim portion. The lid also includes a mouth opening 502 and an aroma opening 504. The mouth opening includes a first end and a second end, opposite the first end, and a first length L1 extending in a first direction, from the first end to the second end, and a first width W1 extending in a second direction, transverse to the first direction. The aroma opening includes a third end and a fourth end, opposite the third end, in the first direction, where the third end is closer to the mouth opening than the fourth end. The aroma opening includes a second length L2 extending in the first direction from the third end to the fourth end, and a second width W2 extending in the second direction. The first width W1 can be greater than the first length L1. The second width W2 can be less than the second length L2, to accommodate a flared shape of the person's nose. The second length L2 is greater than the first length L1, and the second width W2 can be greater than the first width W1. In an implementation, the second width decreases in the first direction, from the third end to the fourth end of the aroma opening.

Typically, a maximum width of the second width W2, at the third end of the aroma opening, can be at least about 3 centimeters (or about 1.18 inches), for fitting the widest portion of a person's nose at the base of the nose. For example, a maximum width can be 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, or 5.0 centimeters or greater. The width of the aroma opening can vary depending on the particular use, the user, lid and cups size, and others.

A maximum length of the second length L2 of the aroma opening can be about the same, less than, or greater than the maximum width of the aroma opening. In an implementation, the maximum length is at least about 2.5 centimeters (or about 0.98 inches), for fitting the length of a person's nose from a base to a tip. For example, a maximum length can be 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, or 5.0 centimeters or greater. In other implementations, the length of the aroma opening can be less than 2.5 centimeters, or have no length dimension where the plane of the aroma opening is perpendicular to the base portion of the lid. The width and length of the aroma opening can vary depending on the particular use and user. For example, the opening can have a smaller width and length for a child's cup. Typically, the larger the width and the length, the greater the area of the aroma opening, which allows more aroma molecules to flow to the nostrils The mouth opening and aroma opening are aligned along an axis 520 of the lid. Portions of the mouth opening and aroma opening extend from the axis on a first side (e.g., left side), and extend from the axis on a second side (e.g., right side), opposite the first side. The left side can be symmetrical with respect to the right side. In other implementations, the left and right sides are not symmetrical, and can have different features and different dimensions to features.

A first area of the aroma opening is greater than a second area of the mouth opening. Typically, the larger the aroma opening, the more aroma molecules and heat (steam) can flow out to reach the nasal openings. In a specific implementation, the lid includes a first opening which is a combined mouth and aroma opening.

In a specific implementation, the length (first length, L1) and width (first width, W1) of the mouth opening can be 0.75 centimeters and 1.5 centimeters, respectively.

FIG. 6 shows a cross section of a specific implementation of a lid 600 incorporating an aroma opening 604 and a mouth opening 602. The lid can be circular, oval, or have another shape to fit onto a cup 412. The lid has an open end that fits onto the rim 650 of an open end of the cup, and when fitted onto the cup, the lid covers and closes the top of the cup.

The lid includes a base portion 612 and a rim portion 613. The rim portion surrounds a perimeter of the base portion. The base portion may be a raised portion that includes a first wall 614. The base portion may be generally circular or elliptical in shape, and includes a first curved perimeter. The rim portion may be generally circular or elliptical in shape, and includes a second curved perimeter. In some implementations, a length of the second perimeter is greater than the first perimeter. The rim portion 613 is adapted to sit on the rim 650 of the cup. In a specific implementation, the first wall 614 of the base portion is omitted, so the base portion will not be raised above the rim portion. The base portion and rim portion can be coplanar and will have the same perimeter. The rim portion can also be referred to as a flange, a lip, a collar, or an edge.

The rim portion 613 is connected to an annular skirt portion 610 adapted to removably engage a complementary peripheral rim 650 of the beverage container 412. The beverage container can be a disposable cup, a glass, a mug, travel cup, thermos, bowl, or soup bowl. In a specific implementation, the skirt portion includes an annular groove adapted to matingly engage a complementary peripheral rim of the drinking cup. The skirt portion can have a diameter that is about the same as the diameter of the rim of the cup. The skirt portion can stretch over the rim of the cup to form a seal that is water tight. A friction force can prevent the skirt portion from loosening or popping off of the cup. The skirt portion can include any attachment means to connect the lid to the rim of the cup. In other implementations, the skirt portion can include a screw thread on an inner surface of the skirt portion. The lid can be screwed onto the cup. The skirt portion can have various other types of attachment means.

In a specific implementation, a lid with an aroma opening is adapted for use a bowl. The lid can be fastened to the rim of the bowl as discussed above for cups, glasses, and mugs. When soup is consumed using a bowl or cup with an aroma lid, the concentration of steam and aroma can be trapped and concentrated within the lid for a drinker to breathe. This can have a positive and soothing affect on the drinker's sinuses and would provide some relief from the symptoms of illnesses such as colds and flu.

The mouth opening 602 is positioned closer to the rim portion than the aroma opening 604. The mouth opening can be positioned on the same plane as a plane 65 of the rim portion or above the rim portion. In some implementations, the mouth opening is a first distance D1 from the plane 65 of the rim portion. When the mouth opening is on the same plane as the rim portion, D1 is zero. The mouth opening 602 is an opening in the base portion that is cut or molded in the material of the lid. The mouth opening can also be punched through the lid (e.g., pre-punched by the manufacturer, or punched by the user upon use).

The aroma opening 604 is positioned ahead of the mouth opening, closer to a central portion of the cover portion than the mouth opening. When the person's mouth is positioned over the mouth opening, the aroma opening will be positioned under the person's nostrils. An area of the aroma opening is greater than an area of the mouth opening. This allows a person's nose to interact with the aroma opening to intake smells that escape from the beverage in the beverage container through the aroma opening. For example, the person's nose can pass through a plane of the aroma opening and into the lid.

The aroma opening includes a proximal side and a distal side, opposite the proximal side, where the proximal side is closer to the mouth opening than the distal side. At the proximal side of the aroma opening, the aroma opening is a second distance D2 from the plane 65 of the rim portion. At a distal side of the aroma opening, the aroma opening is a third distance D3 from plane 65 of the rim portion of the lid. The second distance D2 is the same as or less than the first distance D1. The third distance is greater than the first distance D1 and the second distance D2.

A plane of the aroma opening from the proximal side to the distal side can be angled at a first angle a, with respect to the cover portion. Angle a can range from about 60 degrees to about 179 degrees. The aroma opening is an opening in the lid that is cut or molded in the material of the lid. The aroma opening can also be punched through the lid (e.g., pre-punched by the manufacturer, or punched by the user upon use).

The lid includes a concentrator member 606 that is connected to the aroma opening. The concentrator member includes a first wall 620 extending upward from the cover portion of the lid. The first wall surrounds the aroma opening, about an axis 70 passing through the lid and the cup. The concentrator includes a space on an inner side of the lid that retains the aroma molecules that rise from the beverage surface in the cup. Wall 620 can be angled with respect to the base portion of the lid at an angle b. In various implementations, wall 620 is a curved wall, resembling a dome that covers the cup. This feature will allow aromas to become more concentrated as they rise from the aroma opening. An upper side of the concentrator is a fourth distance D4 from plane 65. The fourth distance can be the same or greater than the third distance D3. The fourth distance D4 is greater than the first distance D1 and the second distance D2.

In various implementations, the lid includes a cover member 630, indicated in dashed lines in FIG. 6, that covers the aroma opening. So, the aroma opening is a reclosable aroma opening, allowing the person to cover or close the opening when not drinking from the lid. The cover member can be connected to the lid closer to the lid top, above the aroma opening. In a specific implementation, the cover member can hinge, rotate, or be folded away from the aroma opening to expose the opening. In other implementations, the cover member is connected to a sidewall of the lid, and can open in a direction away from the aroma opening, like a door.

In a specific implementation, the mouth opening and the aroma opening form a single opening. That is, when the person positions their mouth on the rim of the lid, there is no lid material between the person's mouth and nose. A cross section of the opening, along a direction of the second axis, is a closed shape. In some implementations, the shape of the opening is a circle or an oval. In other implementations, the shape of the opening is a triangle.

Figure 7:
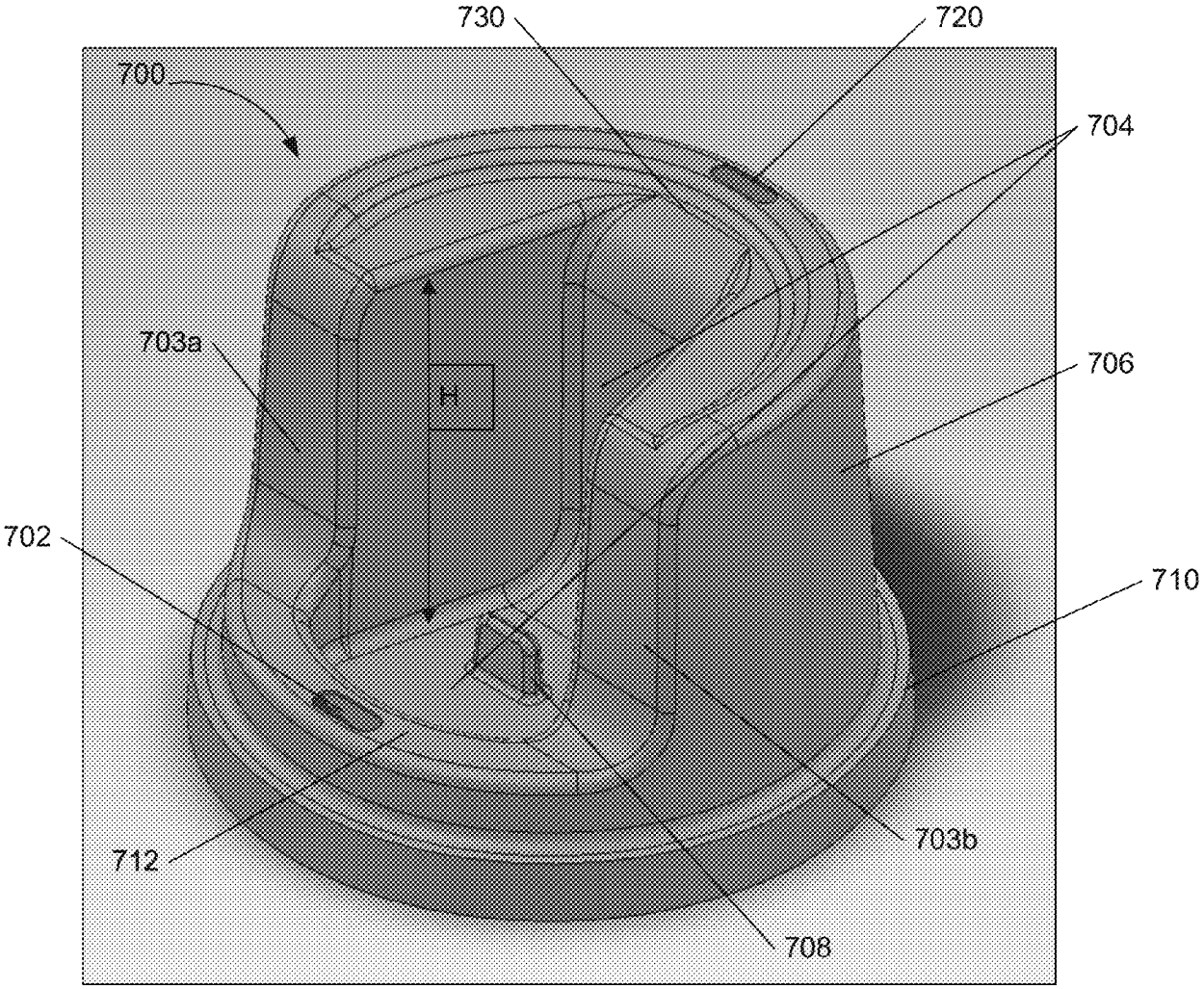
FIG. 7 shows a specific implementation of a lid.

FIGS. 7-10 show a specific implementation of a lid 700 for a beverage cup. FIG. 7 shows a perspective view of the lid. The lid includes a rim portion 701 and a base portion 712 connected to and surrounded by the rim portion. The rim portion is adapted to connect the lid to a beverage container (not shown). The lid includes a front side of the lid, connected to the rim portion, including a front-facing wall that can face a nasal dorsum of a user. The front-facing wall can extend in first and second rotation directions a first wall ridge 703*a* and second wall ridge 703*b*. The lid includes a back side, connected to the rim portion at the front side of the lid at the first and second wall ridges. The back side includes a back-facing wall. The back-facing wall extends in a first direction (e.g., vertical) above the rim portion to a lid top, The back-facing wall includes outside and inside walls portions, the wall extending in first and second rotation directions about the rim portion and stopping at the first and second wall ridges. The front facing wall extends from first and second wall ridges and extends in the first direction from the base portion.

The lid also includes a mouth opening 702, an aroma opening 704, and a concentrator member 706. The mouth opening is positioned closer to the rim or than the aroma opening. The aroma opening can be aligned with the mouth opening along an axis that passes through the cup. The aroma opening is positioned in front of the mouth opening, so that when a person drinks from the mouth opening of the lid, their nose is positioned over the aroma opening.

The aroma opening typically extends above the mouth opening, for fitting the height of the person's nose. In FIG. 7, the aroma opening extends in the first direction from the base portion toward the lid top. An inside surface of the back-facing wall faces the aroma opening. The aroma opening can extend from a same plane as the mouth opening to a first height above the mouth opening. In the specific implementation in FIG. 7, the aroma opening extends from a point or level below the mouth opening, to a height H above the mouth opening.

In a specific implementation of the lid shown in FIG. 7, the dimensions of the mouth opening can be 0.5 centimeters by 1 centimeter. The aroma opening can also have dimensions of 7 centimeters by 5 centimeters.

The aroma opening can have a bent profile shape. The aroma opening has a proximal end and a distal end, where the proximal end is closer to the mouth opening. Between the proximal and distal ends is a first bend. Between the proximal end and the first bend, the aroma opening extends in a first direction (e.g., horizontal), and between the first bend and the distal end, the opening extends in a second direction (e.g., vertical), different from the first direction. When in use, the portion extending in the horizontal direction is arranged to be positioned below a person's nostrils, allowing the aromas from the beverage to flow a short path between the beverage surface and the nostrils. The portion extending in the vertical direction can provide a space for fitting the person's nose. This allows for a more comfortable drinking position, so that the person's nose is not abutting against any part of the lid. Further, more aromas can escape through this portion of the aroma opening to reach the nose for a more enhanced smell experience.

The lid includes a concentrator member 706. The concentrator typically surrounds the aroma opening, and can extend to a height above the mouth opening. The height of the concentrator can be about the same as the height of the aroma opening, or greater. In the embodiment of FIG. 7, the concentrator includes walls that surround the aroma opening on three sides, a left side, a right side, and a front side. The concentrator extends above the mouth opening to about the same height as the aroma opening. The walls of the concentrator define a space within the lid. When the lid is attached to a beverage container, heat and aromas from the beverage are enclosed in this space, being blocked by the walls from dissipating into the air.

In FIG. 7, a cross sectional area of the base of the concentrator includes a curved, closed shape that curves around the aroma opening. A first portion of the concentrator extends from a first end in a first direction to a first bend (or curve), then extends in a second direction from the first bend to a second bend (or curve), and then extends in a third direction from the second bend to a second end of the concentrator. The first, second, and third directions are different. The third direction is opposite the first direction, and the second direction is about transverse to the first and third directions. The shape can be referred to as a horseshoe shape or a U shape. In other implementations, the shape can have fewer or more bends.

The lid can include a reclosable cover that covers the aroma opening. The cover will have a shape that corresponds to the aroma opening. The cover includes a first end and a second end, opposite the first end. The first end is closer to the mouth opening than the second end. The second end of the cover is connected to the lid at a hinge member 730, allowing the cover to lift in a direction away from the aroma opening and rotate about the hinge member, in a first rotational direction, to expose the aroma opening. The hinge member keeps the cover attached so that it cannot be misplaced, thereby allowing a user to close the aroma opening by rotating the cover in a second rotational direction, opposite the first, about the hinge member to cover up the opening.

The reclosable cover can include a first fastening member 708 closer to the first end of the cover. A second fastening member 720 is positioned closer to the second end of the cover. The first fastening member can mate with the second fastening member for retaining the cover in an open position. In a specific embodiment, shown in FIG. 7, the first fastening member can be a projection member, for engaging with a user's fingers to facilitate lifting the cover away from the aroma opening. The second fastening member can be a mating opening or recess, formed closer to an end of the lid opposite to the mouth opening. The mating opening or recess can permit the projection of the cover to be locked into place when it is hinged fully open by press fitting the projection into the opening. The opening or recess can include a small vent opening to permit steam to escape from the interior of beverage container. The projection can also be referred to as a knob, tab, key, insert, or a male member. The opening or recess can also be referred to as a groove, pocket, receptacle, through-hole, or female member. In other implementations, the first and second fastening members can be any number of mating pairs for engaging each other.

When a user wishes to smell the beverage, the user pulls first fastening member (projection) 708 and pivots the cover about hinge 730, with or without locking the cover to the second fastening member (opening) 720, as desired. The aroma opening can be reclosed by moving the cover back to the closed position. The user can apply a downward pressure on the projection to fit the cover over the opening. In various implementations, pushing down on the cover can cause an edge of the cover to move under an edge of the lid, thereby trapping the cover edge from lifting away.

Figure 8:
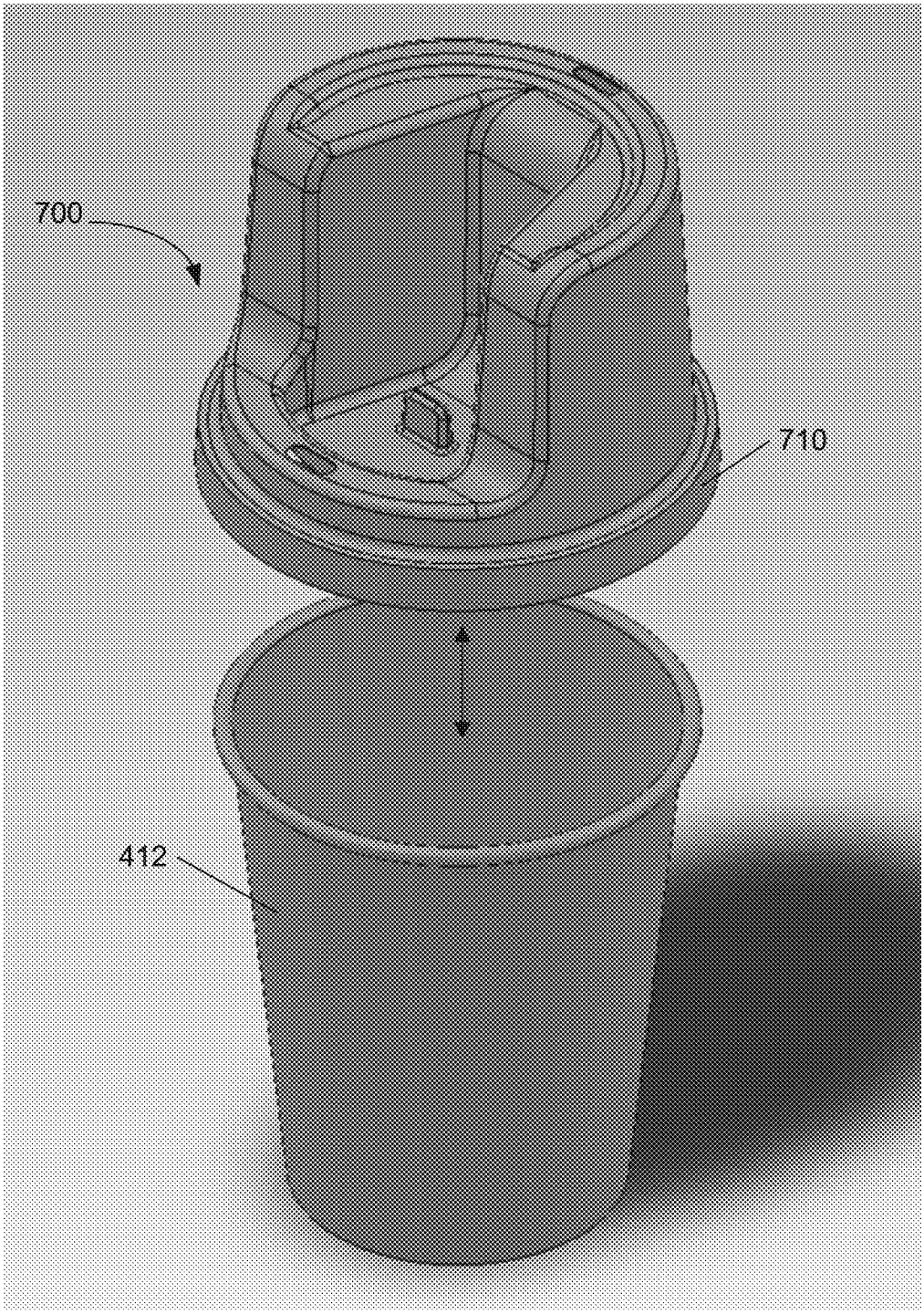
FIG. 8 shows the lid of FIG. 7 where the lid can be attached to and removed from a cup.

FIG. 8 shows the lid of FIG. 7 can be fit onto and removed from a beverage cup. The beverage cup can be a disposable cup (e.g., paper cup, hot beverage cup, cold beverage cup, or others). The lid can be placed on the rim of an open end of a drinking container, and connects to the rim by way of the rim portion 710. The rim of the cup can be a rolled rim. The rim portion of the lid can include an annular groove on an inside surface, for frictionally engaging the cup rim to hold the lid in place. The groove can include an inner side, an outer side, a locking ledge (or protrusion) formed in the inner wall and a flared skirt portion. The inner side has a length which extends to a point at or below the level of the cup rim when the lid is positioned on the cup, and the locking ledge extends inwardly toward the cup to a position which is over a thickness of the cup rim and engages a lower surface of the cup rim. This engagement generally forms a seal between the inside rim of the lid and the cup rim, preventing spillage or leaks of the beverage contents. To attach the lid to the cup, a user can press fit the lid over the cup, and can generally feel the lid snap into place over the rim portion of the cup. To remove the lid, the user can lift the lid off starting from one end of the lid to the other end.

Figure 9A:
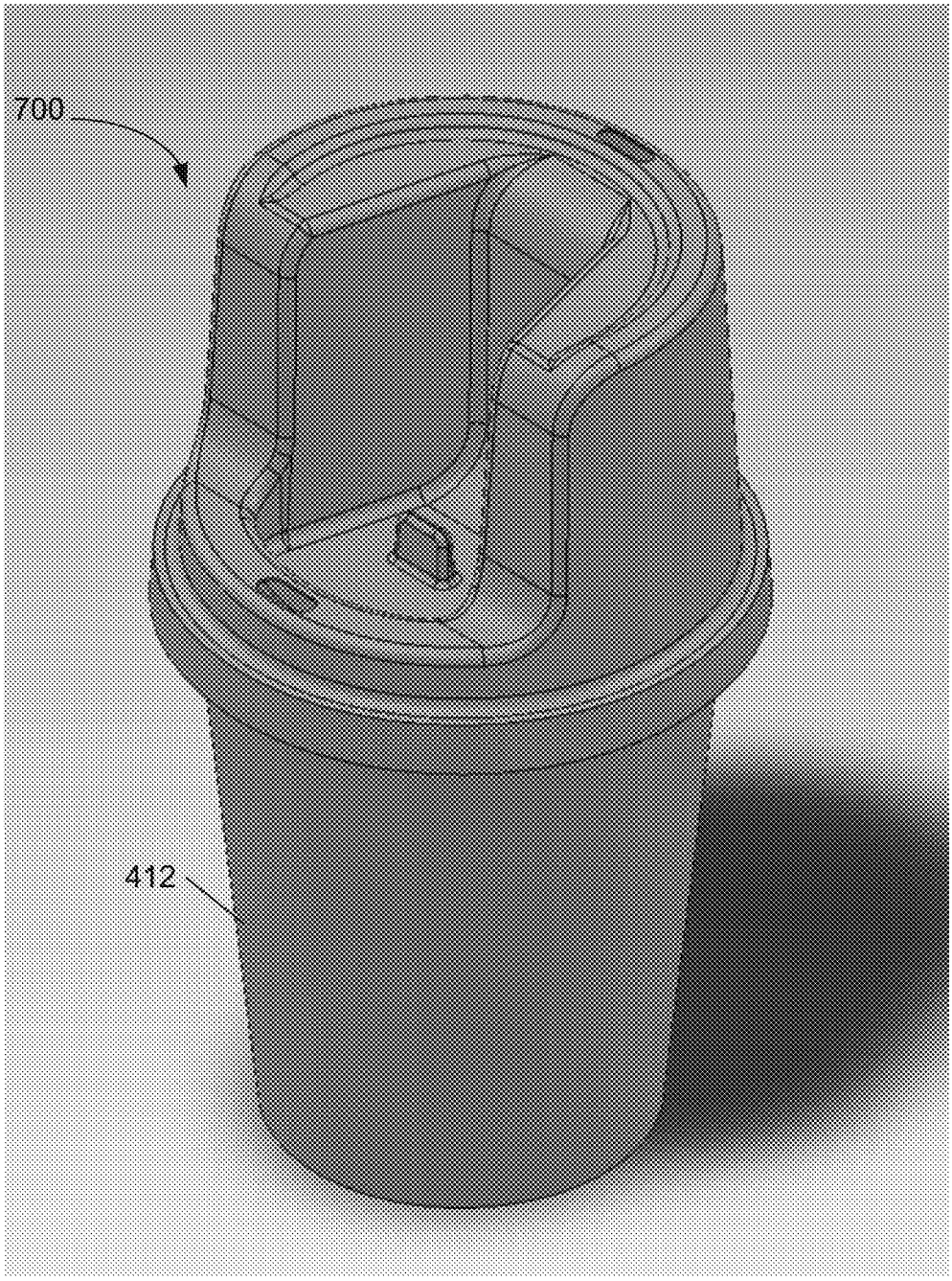
FIG. 9A shows the lid of FIG. 7 attached to a cup and the aroma opening closed.
Figure 9B:
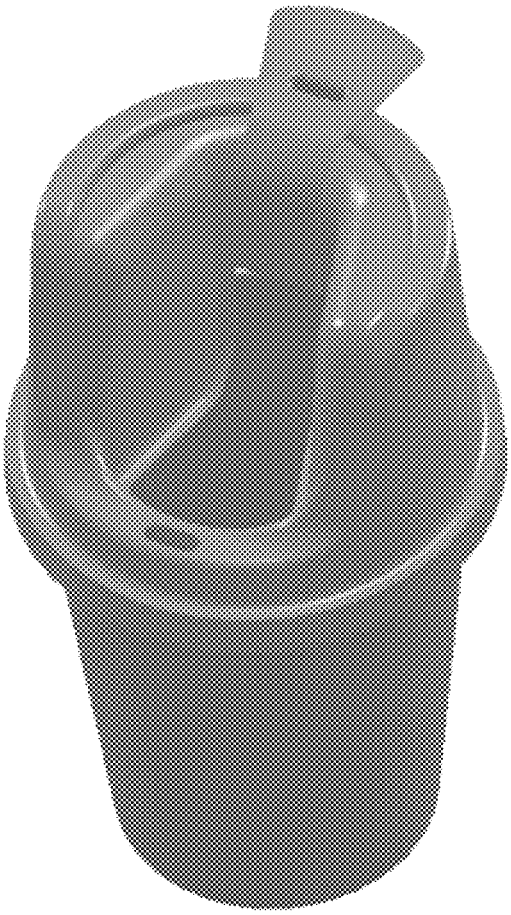
FIG. 9B shows the lid of FIG. 7 attached to a cup and the aroma opening opened.
Figure 9C:
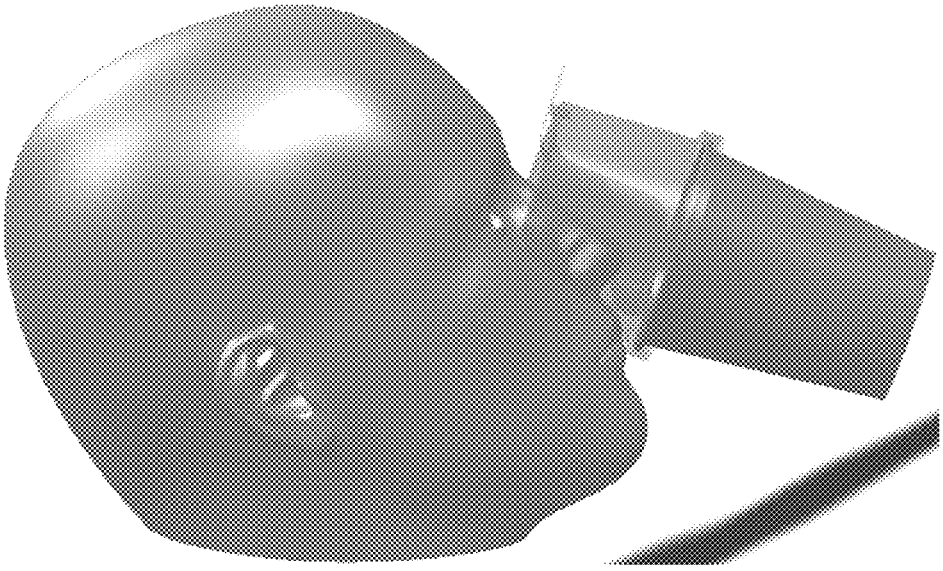
FIG. 9C shows a side view of a user drinking from the lid of FIG. 7.

FIGS. 9A-9C show the lid 700 of FIG. 7 attached to a beverage cup 412. FIG. 9A shows the lid with the aroma opening in a closed stated, while in FIG. 9B, the aroma opening is in an opened state. FIG. 9C shows a side view of a user drinking from the lid of FIG. 7. The diameter, height, and other dimensions of the lid can be made to any size to fit the beverage cup. Typical disposable beverage cups range in size from 3 ounces to about 30 ounces. For example, a cup for holding 3 ounces of liquid is referred to as a demi cup, an 8 ounce cup is referred to as a short cup, a 12 ounce cup is referred to as a tall cup (or small), a 16 ounce cup is referred to as a grande cup (or medium), a 20 ounce cup is referred to as a venti cup (or large), and a 30 ounce cup is referred to as a trenta. The lid can be made to be larger or smaller according to specific dimensions of the cup. As the diameter of the lid increases with increasing cup size, the height of the lid can also increase. This can be a proportional increase or a non-proportional increase. Other features of the lid may remain constant even as the overall lid size increases, including the mouth opening, aroma opening, and concentrator member. In other implementations, these features can increase with increasing lid size.

In a specific implementation, the lid can be made for cups that have a top diameter of 8.5 centimeters. The top of the cup is the area that engages with the lid.

Figure 10A:
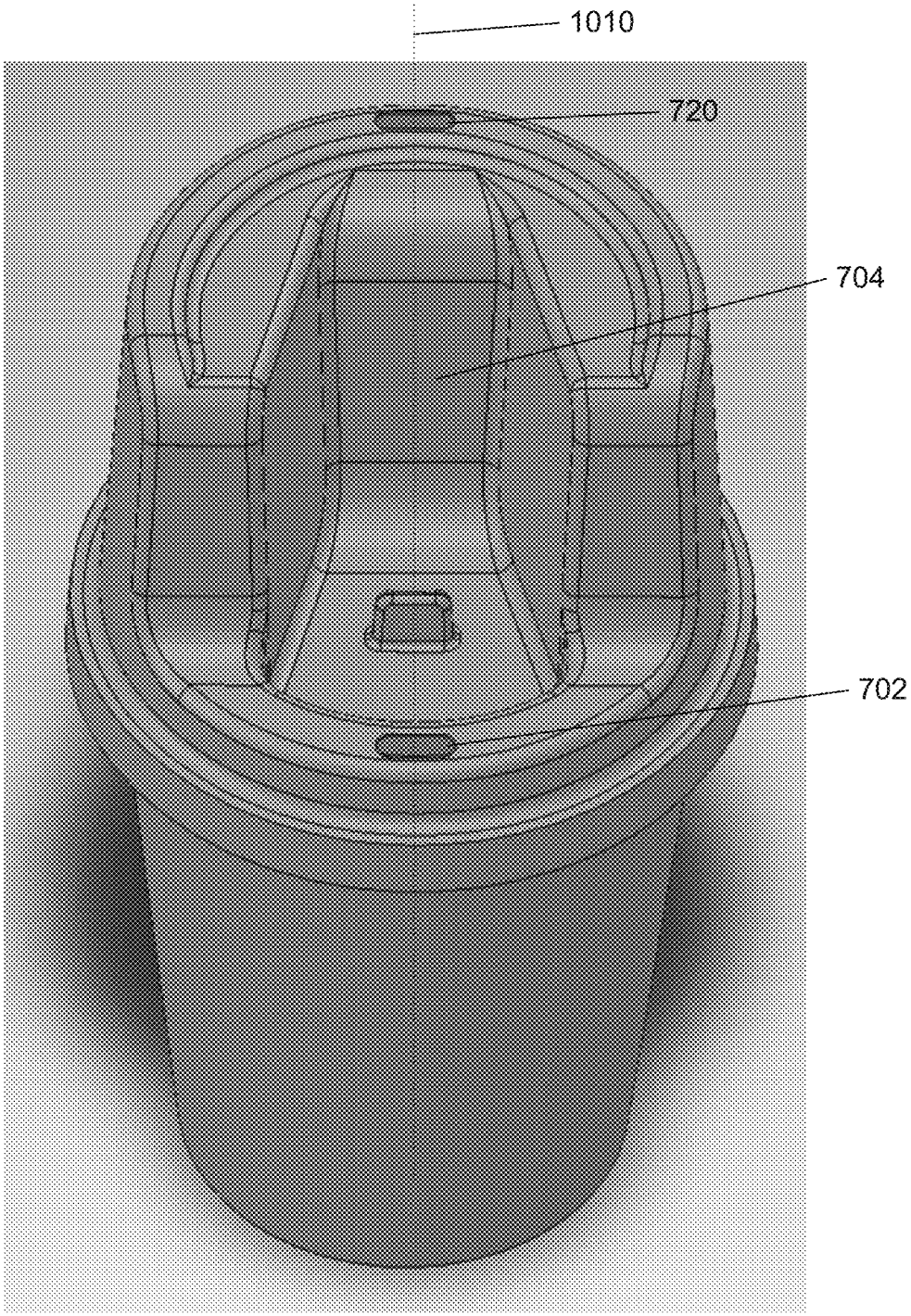
FIG. 10A shows a front view of FIG. 7 with the aroma opening closed.
Figure 10B:
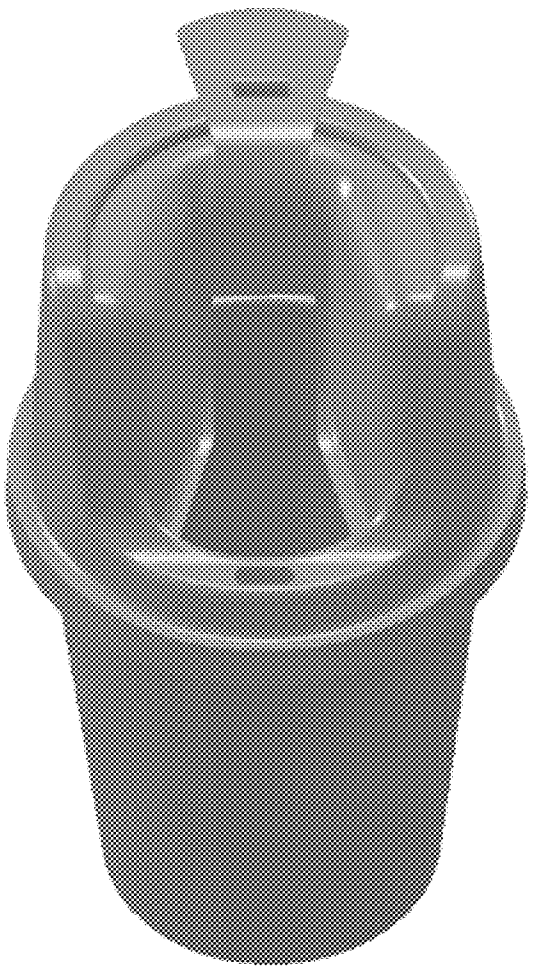
FIG. 10B shows a front view of FIG. 7 with the aroma opening open.

FIG. 10A-10B shows a front perspective view of the lid of FIG. 7. FIG. 10A shows the lid with the aroma opening in a closed stated, while in FIG. 10B, the aroma opening is in an opened state. The mouth opening 702, aroma opening 704 and second fastening member (opening) 720 are aligned along an axis 1010 of the lid. Portions of the mouth opening, aroma opening, concentrator, and second fastening member extend from the axis on a first side (e.g., left side), and extend from the axis on a second side (e.g., right side), opposite the first side. The left side can be symmetrical with respect to the right side. In other implementations, the left and right sides are not symmetrical, and can have different features and different dimensions to features.

The aroma opening can be wider at the proximal end, closer to the mouth opening, than at the distal end of the opening. From the first bend to the proximal end of the aroma opening, a width of the opening increases. Walls of the lid extend from the edges of the aroma opening in a vertical direction. The shape of the aroma opening can be referred to as a flared shape. This shape can correspond to the flared shape of the nose, where the nose is wider at the base of the nose than at the top, where the nose is more tapered.

Figure 11:
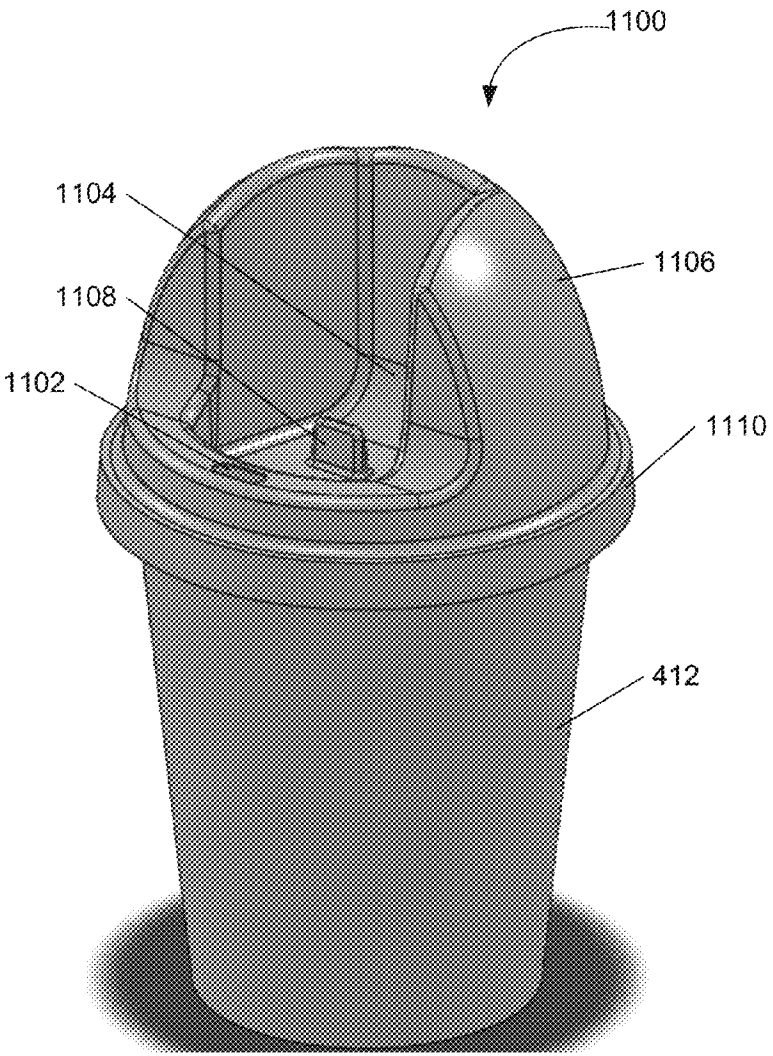
FIG. 11 shows a specific implementation of a lid.

FIG. 11 shows another specific embodiment of a lid 1100 for a beverage cup 412. The lid includes a mouth opening 1102, an aroma opening 1104, a concentrator member 1106, and an interface 1110, for coupling the lid to the cup. The lid also includes a first fastening member 1108 positioned on a reclosable cover, and a second fastening member (not visible) on an upper end of the lid which can mate with each other to cause the cover to be locked in an open position, exposing the aroma opening. Compared to the lid in FIGS. 7-10, this lid includes more contoured surfaces. The surface of the lid includes more curved lines. The shape of the lid can be referred to as a dome (or half spherical shape).

The concentrator member 1106 shown in FIG. 11 can have a greater concentrating effect compared to the lid of FIG. 7. Like the concentrator of FIG. 7, the concentrator extends around the aroma opening. The concentrator extends from a base end to an upper end of the lid. A cross sectional area of the concentrator decreases in a direction from the base end to the upper end. An area at the upper end of the lid having curved walls is less than the area of the lid in FIG. 7 (having straight sloped walls). A smaller area results in a greater concentration of the beverage aromas. As aroma vapors rise in the concentrator space, there is a greater density of aroma per square unit of area as the area decreases. This concentrates the aromas in the space surrounding a user's nose. The concentrator channels or deflects a direction of aroma flowing to the nose.

Figure 12:
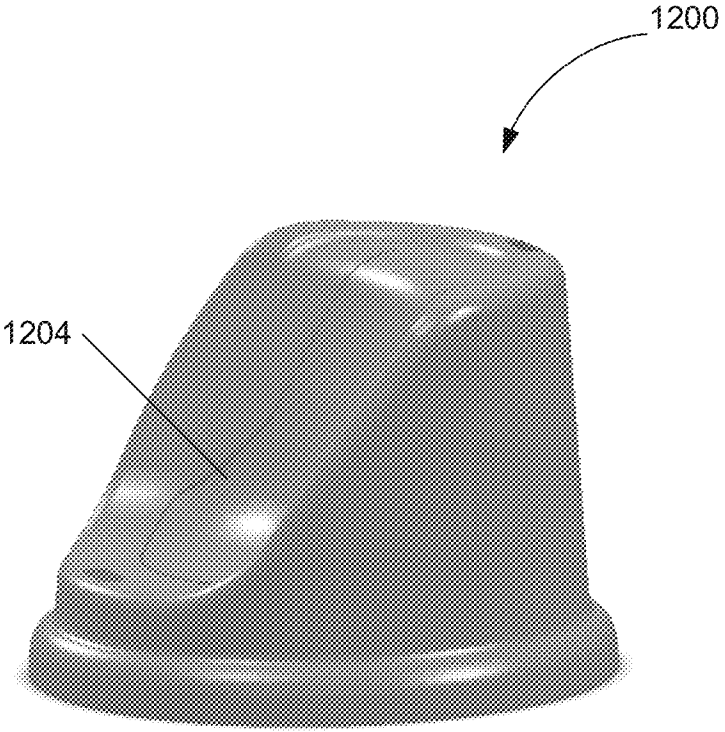
FIG. 12 shows another specific implementation of a lid.

FIG. 12 shows another specific embodiment of a lid 1200 for a beverage cup with a wider aroma opening 1204 compared to the embodiments in FIGS. 7-11. Typically, the larger the aroma opening, the greater the number of aroma molecules that can flow through the opening to the person's nose. The lid also includes a reclosable cover and a mating mechanism for securing the cover in an open position to expose the aroma opening while drinking, as described above. When in a closed configuration, the cover and walls of the lid adjacent to the cover form a more contoured, curved shape compared to the embodiments in FIGS. 7-11. The curved surfaces can provide the user with more space to move the nose and face while drinking.

FIG. 13 shows another specific embodiment of a lid 1300 for a beverage cup. The lid includes a mouth opening 1302, an aroma opening 1304, a concentrator member 1306, and rim 1310. The aroma opening has a first end and a second end, opposite to the first end, where the first end is closer to the mouth opening. A width of the aroma opening at the first end is greater than at the second end. A maximum width of the aroma opening is at the first end, while a minimum width is at the second end. This shape can correspond to the shape of a person's nose, which is wider at a base and tapers to the tip of the nose. Typically, the maximum width is at least about 3 centimeters (or about 1.18 inches), for fitting the width of a person's nose. For example, a maximum width can be 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, or 5.0 centimeters or greater. The width of the aroma opening can vary depending on the particular use and user.

A maximum length of the aroma opening can be about the same, less than, or greater than the maximum width. Typically, the maximum length is at least about 2.5 centimeters (or about 0.98 inches), for fitting the length of a person's nose from a base to a tip. For example, a maximum length can be 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, or 5.0 centimeters or greater. The width and length of the aroma opening can vary depending on the particular use and user. For example, the opening can have a smaller width and length for a child's cup. Typically, the larger the width and the length, the greater the area of the aroma opening, which allows more aroma molecules to flow to the nostrils.

The lid includes a wall 1322 extending upward (vertically) to an upper end of the lid. The wall can have a contoured, concave shape. The wall faces the nasal dorsum of the user. The wall defines a concave space in the lid for fitting the nose. A height of the wall can be the same or less than a height of the lid. The space is adapted to fit a nose with a gap of space between the nose and the wall to provide the nose some space to move. When in use, the person may tip the face forward into the lid or in an opposite direction to lift the face out of the lid.

In this implementation, the wall channels aromas to the nostrils. Aroma molecules are deflected by the wall and directed to the nose. Aroma molecules travel only a short path before entering the nose. The aroma opening can be horizontally disposed, as shown in FIG. 13, or have an angled opening, where the second end of the opening is higher than the first end of the opening.

Figure 14:
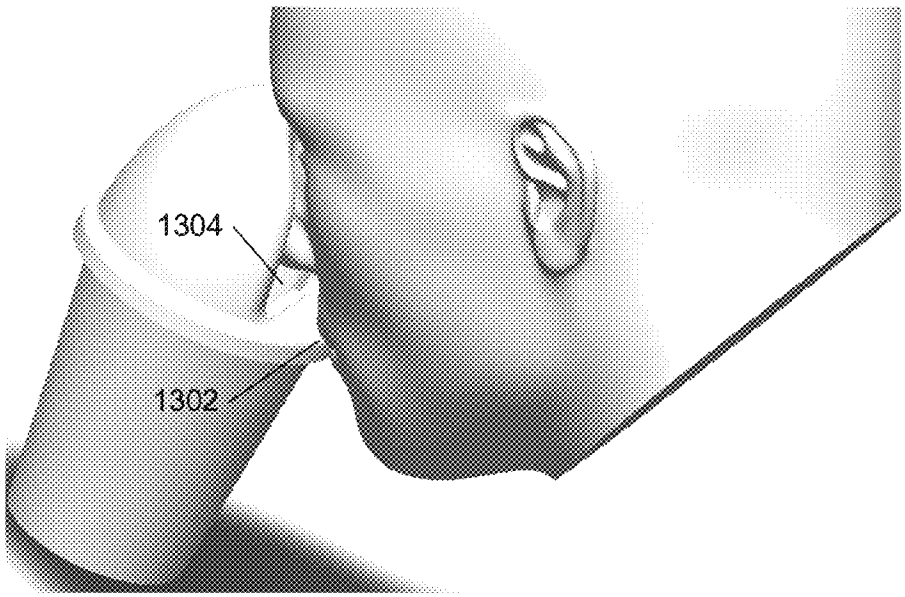
FIG. 14 shows a user's mouth and nose interacting with the lid of FIG. 13.

FIG. 14 shows the lid of FIG. 13 in use. When the person's mouth engages with the mouth opening 1302, the person's nose passes through the aroma opening, and is positioned over the opening. The sloped dome shape of the lid can provide the person with a field of vision even while the person is drinking from the lid. The curved walls are positioned below a level of the eyes to allow the person to see in a forward direction.

Typically, when a beverage releases aromas, some of the molecules responsible for the aroma are in the gas phase. Molecules in a gas phase tend to disperse in all directions. Therefore, in a typical container that has no lid (e.g., mug, cup, or glass), the aroma molecules tend to disperse everywhere and away from the cup. A concentration of the aroma molecules around the source of aroma (e.g., the beverage liquid inside the container) can decrease as the aroma molecules spread out in to other areas.

A lid with walls partially surrounding an aroma opening, such as the one shown in FIG. 13, can prevent dispersion of the aroma molecules. The walls that surround the aroma opening (e.g., an aroma dome or dome) act as a barrier to keep the aroma molecules within a general area of the lid and prevent or slow down the aroma molecules from dispersing away from the lid. As more aroma molecules move out of the aroma opening and into its surrounding walls, more aroma molecules are gathered by the surrounding walls, thereby increasing the concentration of aroma molecules in the area of the aroma opening. When a user's nose is positioned over the aroma opening and underneath the dome (or other shapes), the nose is surrounded by a relatively higher concentration of aroma molecules. Therefore, the described lid can enhance aromas compared to a regular open container (e.g., open mug, cup, or glass). And a person's experience with the beverage can be enhanced compared to drinking from a mug.

Further, when the lid shown in FIG. 13 is used, the user's nose is surrounded by the walls around the aroma opening. The walls, in effect, isolate the nose from the rest of the environment and block smells from the environment. This is similar to covering a nose with a handkerchief and breathing through the handkerchief after encountering a strong and unpleasant odor. Within the walls surrounding the aroma opening, there is less aroma molecules from the environment and more aroma molecules from the beverage. Therefore, within the walls surrounding the aroma opening, the aromas from the environment will not detract from the aromas from the beverage as much compared to a lid that has no walls around the aroma opening.

The isolation of the nose from the rest of the environment is beneficial in a restaurant. In a restaurant, many people are eating many different dishes. Consequently, in a restaurant, a person can smell many aromas that are from other people's dishes. And these aromas can detract from the eating experience. For example, a person may not want to smell someone else's steak or seafood when that person is drinking hot chocolate for dessert. The described lid would help isolate the person's nose so that the person can smell more of the hot chocolate.

The described lid can also be used at home. People enjoy drinking hot beverages at home and the lid can enhance and help them savor their beverages more. Further, family and holiday parties are often held at home. And food plays an important role, especially during such times, with seasonal and traditional drinks being served. With the described lid, the person drinking the beverage can appreciate the beverage in a new manner because of the enhanced sensory experience.

Figure 15:
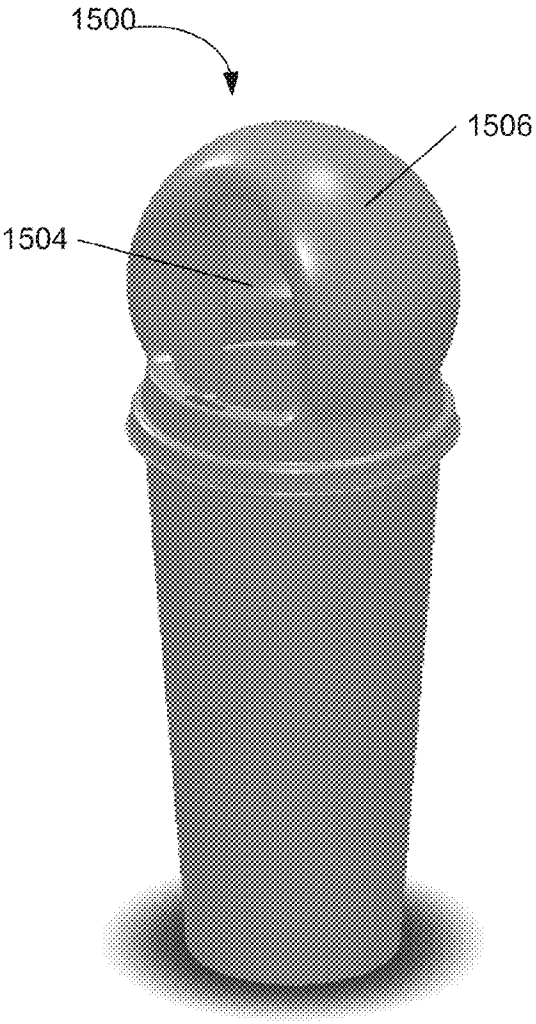
FIG. 15 shows a specific implementation of a lid, having a rounded shape.

FIGS. 15-19 shows another specific implementation of a lid 1500 for a beverage cup. FIG. 15 shows a perspective view of the lid. The lid has a spherical shape. Compared to the curved lid in FIG. 11, this lid includes more of a lower half of the spherical shape. When the lid is placed over the open end of a beverage container, the combined shape of the cup and lid resembles a microphone (or an ice cream cone). This design can be appealing to manufacturers who design and make drink accessories products for children or novelty items.

The aroma opening 1504 can be connected to an internal space of the lid. Compared to the embodiment of FIG. 13, the wall 1310 is omitted in this embodiment. This configuration provides the entire nose with aromas from the beverage, not just the nostrils. The concentrator member 1506 extends to the same height as a height of the lid, and can also extend to the same length and width of the lid.

Figure 16:
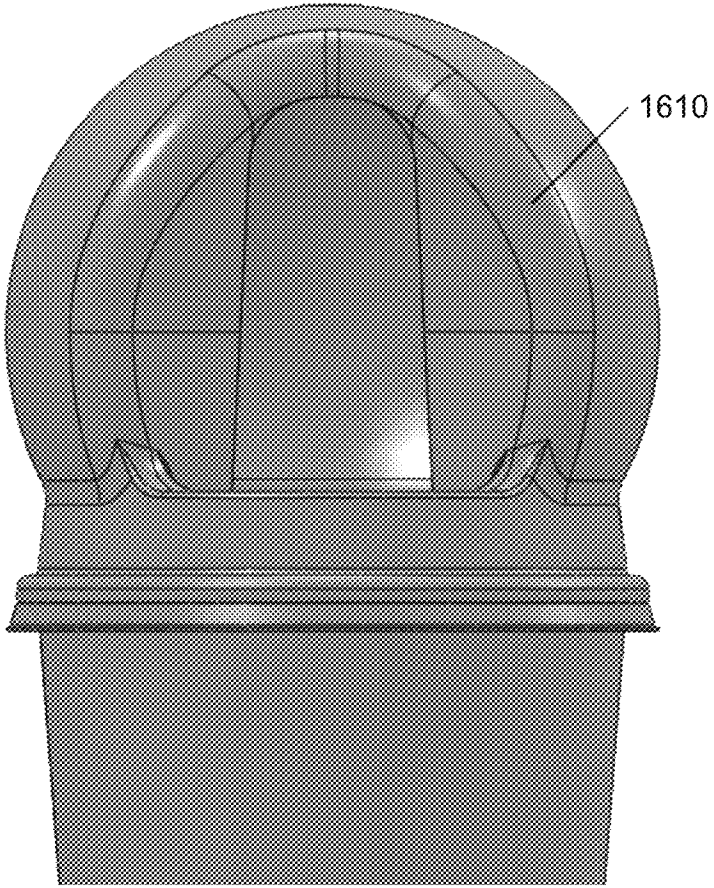
FIG. 16 shows a front view of the lid of FIG. 15.

FIG. 16 shows a front view of the aroma opening. As discussed above, the shape of the aroma opening can be flared, where a width of a base end of the opening is greater than an upper end of the opening. The lid can include a contoured wall 1610 extending around the aroma opening. From the base end to an upper end of the opening, the contoured wall extends in a first direction to a first bend, then from the first bend to the upper end, extends in a second direction that is different from the first direction. The right side is a mirror image of the left side of the contoured wall. The portion of the wall extending in the second direction can have a greater slope than the portion extending in the first direction. The user can rest their face on the wall while drinking. The contoured edge includes curved surfaces to provide more comfort for a user when the user rests the face against the lid.

Figure 17:
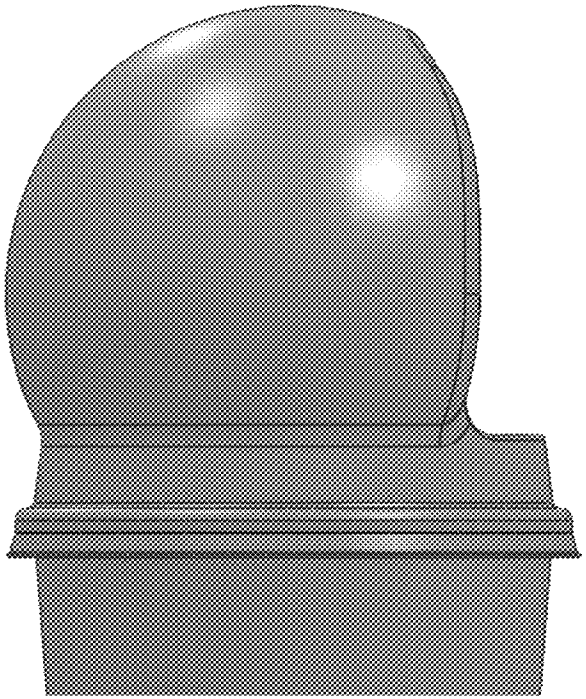
FIG. 17 shows a side view of the lid of FIG. 15.

FIG. 17 shows a side view of the lid of FIG. 15. The dome shape of the lid (and of the concentrator member) can provide an even distribution of aroma molecules in the space within the lid, while concentrating the aromas for the user's nose.

Figure 18:
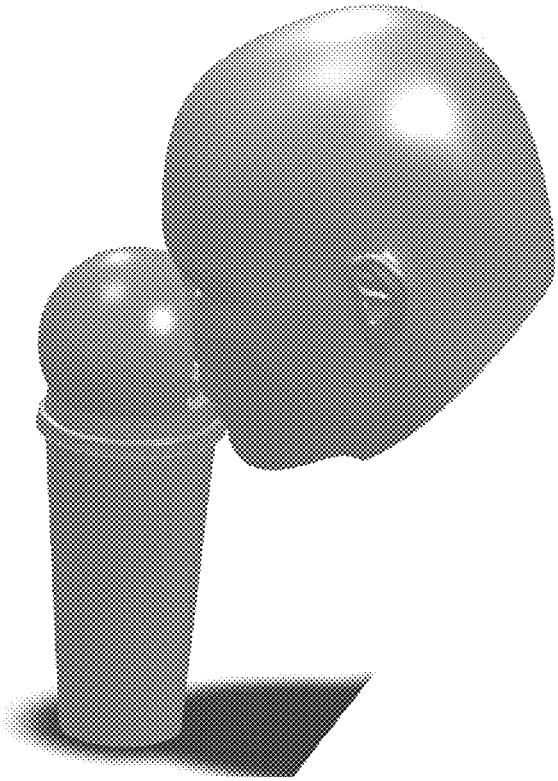
FIG. 18 shows a user drinking from the lid of FIG. 15.

FIG. 18 shows the lid of FIG. 15 in use. When the person's mouth engages with the mouth opening, the person's nose passes through the aroma opening of the lid and can be positioned in the internal space of the lid. The person's nostrils and entire nose are exposed to aromas from the beverage. The curved spherical shape of the lid can be shaped to provide the person with a full range of vision even while the person is drinking from the lid. The curved walls are positioned below a level of the eyes to allow the person to see in a forward direction.

Figure 19:
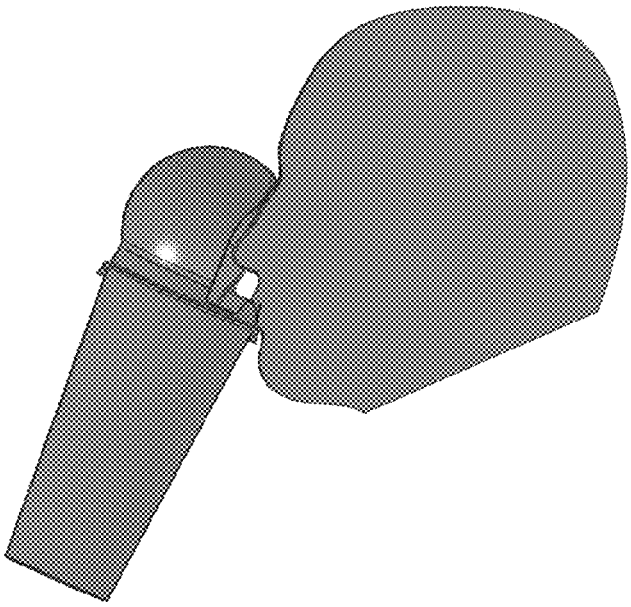
FIG. 19 shows a cross section of FIG. 18.

FIG. 19 shows a cross section view of FIG. 18. The person's nose passes through the aroma opening of the lid and can be positioned in the internal space of the lid. As discussed above, there are many benefits to having a larger aroma opening. Through the aroma opening, the user can not only smell the beverage, but can also see and feel the beverage. The user can also interact with and stir the beverage with a stirrer or a spoon through the opening. The user need not remove the entire lid in order to add tea (tea leaves or tea bag), milk, cream, sugar and other fixings to the beverage.

Figure 20B:
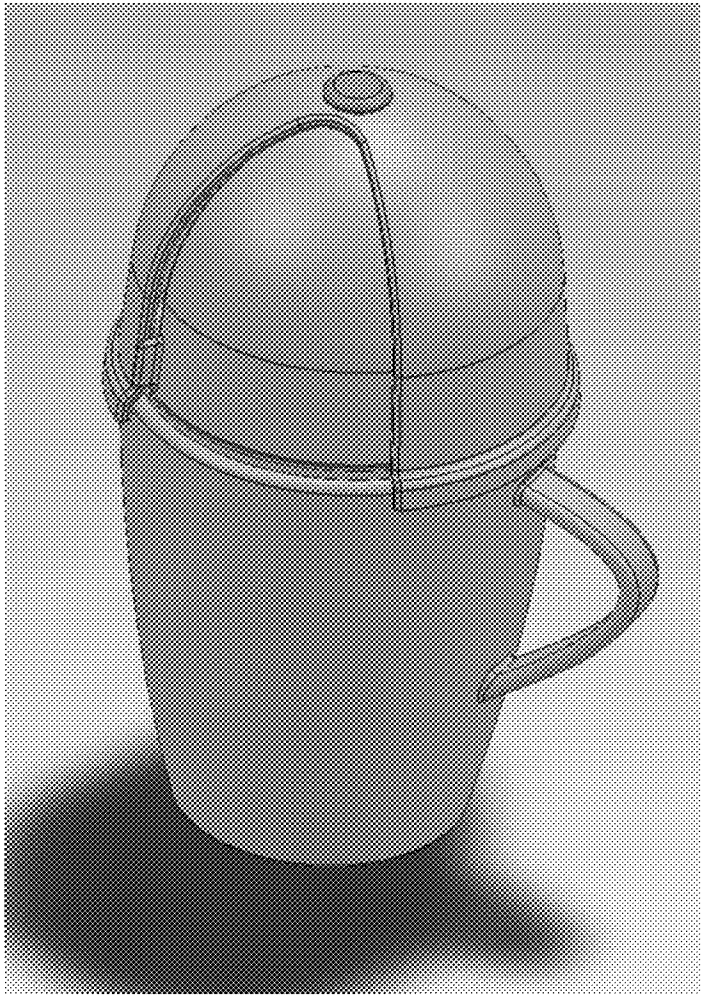
FIG. 20B shows the lid of FIG. 20A in a closed configuration.
Figure 20A:
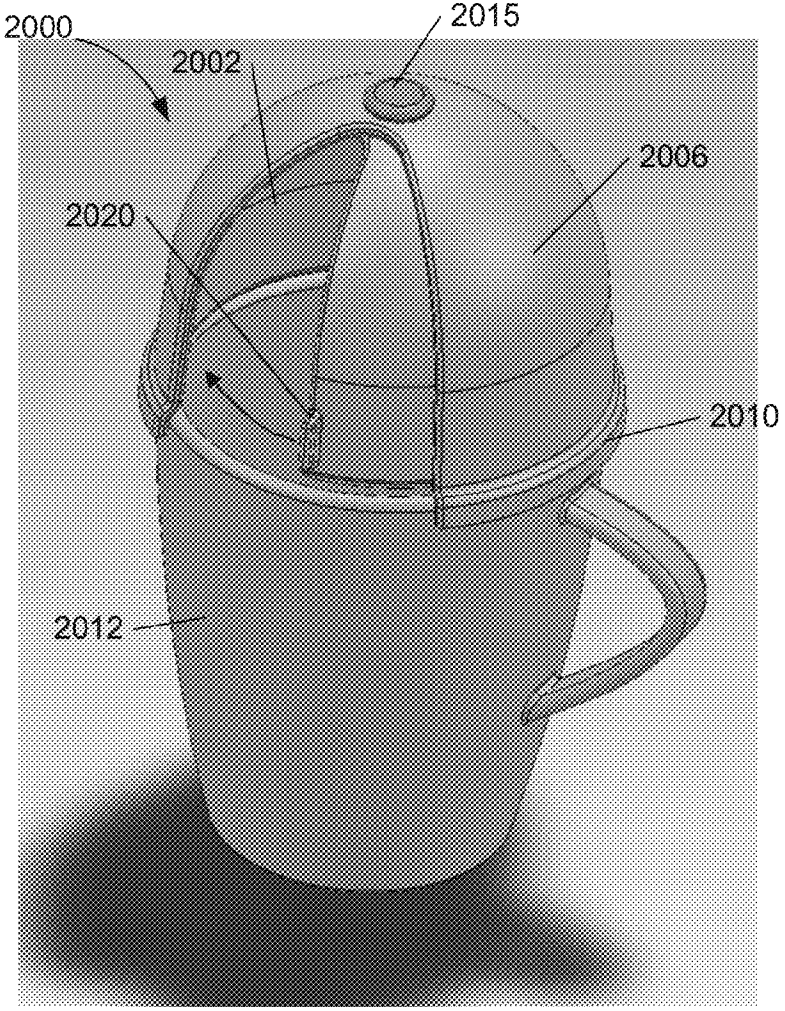
FIG. 20A shows a specific implementation of a lid having a dome shape, where the lid is in an open configuration.

FIGS. 20A-20B shows another specific embodiment of a lid 2000 for a beverage container 2012. FIG. 20A shows the lid in an open configuration. The lid can be disposable lid or reusable lid. The lid can be used with any type of beverage container, including disposable cups (hot and cold cups), mugs (e.g., ceramic, china, plastic, metal, and others), travel mugs and cups, a thermos, and many others.

The lid includes a first opening 2002, a concentrator member 2006, and a rim portion 2010, for coupling the lid to a beverage container 2012. In an implementation, the first opening extends from a first rim position to a second rim position on the rim. The first opening includes a first edge extending from the first rim position to a first dome position, and a second edge extending from the second dome position to the second rim position. From the first rim position to the first dome position, the first edge has a positive slope, having an increasing elevation compared to the first rim position. From the first dome position to the second rim position, the second edge includes a negative slope, having a decreasing elevation compared to the first dome position.

The first opening can be referred to as a combined mouth and aroma opening. When in use, when a person drinks from the mouth opening of the lid, their nose passes through the first opening and can be positioned in the inner space of the lid.

The first opening can extend from a same plane as a rim of the lid to a first height above the rim. The first height can be the same as or less than a height of the lid. The aroma opening can have edges having a curved shape. In FIG. 20A, the opening extends in a first direction (e.g., horizontally) along a perimeter of the lid rim. The opening can have any length along the first direction. The length can be about ⅛ to about ½ the circumference of the rim. Typically, the larger the first opening, the more aromas can reach the person's nose from the beverage.

The lid includes a reclosable cover (or door). The cover can have a curved shape, with the same curvature as a curvature of the lid. The cover has a smaller radius than the lid so that the cover can be positioned to slide back and forth behind the lid, as indicated by the arrow. The cover is connected to a pivot 2015 that allows the cover to rotate about the pivot to slide open and close the cover. The cover includes a handle member 2020 for engaging a user's fingers to slide the cover around the pivot. The handle can also be referred to as a tab, knob, projection, protrusion, or grip.

The lid includes an interface 2010 for engaging the lid with the beverage cup. The interface can include an inner rim to engage with a rim of the cup, as described above, to form a seal around the rim of the cup. In other implementations, the interface includes a mount to attach the lid onto an edge of the cup or a mug. The mount can include a clasp, a hook, a snap on connector, a grip, or any combination of these. The mount can also include a seal (e.g., O-ring) for sealing the lid to the rim of the cup to prevent spillage.

In FIG. 20A, the concentrator member 2006 is the inner space within the lid. The concentrator extends from a plane formed by the rim of the lid upward to an upper end of the lid. As discussed above, a cross sectional area of the concentrator decreases in a direction from the first end to the upper end. In other words, at the first end is a maximum area of the concentrator and at the upper end is a minimum area. The walls of the concentrator comprise curved surfaces that curve in. The narrowing of the area of the concentrator from the first end to the upper end creates a concentration of the beverage aromas. As aroma vapors rise in the concentrator space, there is a greater density of aroma per square unit of area as the area decreases. This concentrates the aromas in the space surrounding a user's nose. The concentrator channels a concentrated amount of aroma to the entire nose, including the nasal openings.

As discussed above, the walls of the concentrator prevent the aromas from escaping into the air. As aroma vapors contact the inside of the walls, their flow is redirected or deflected in directions toward the nose. This allows for a constant flow of aromas toward the space around the nose. This effect is more apparent with hot beverages, where the vapors carrying the aromas have greater kinetic energy. The vapors move quickly within the walls of the concentrator to saturate the space.

FIG. 20B shows the lid of FIG. 20A in a closed configuration. The user can slide the cover in a first direction (clockwise or left) to close the cover. To open the cover, the user can slide the cover in a second direction (counter clockwise or right), opposite the first direction. The curved rim of the cover corresponds or mates with the rim of the cup. When the cover is closed, the rim of the cover can form a firm connection with the rim of the cup.

Figure 21A:
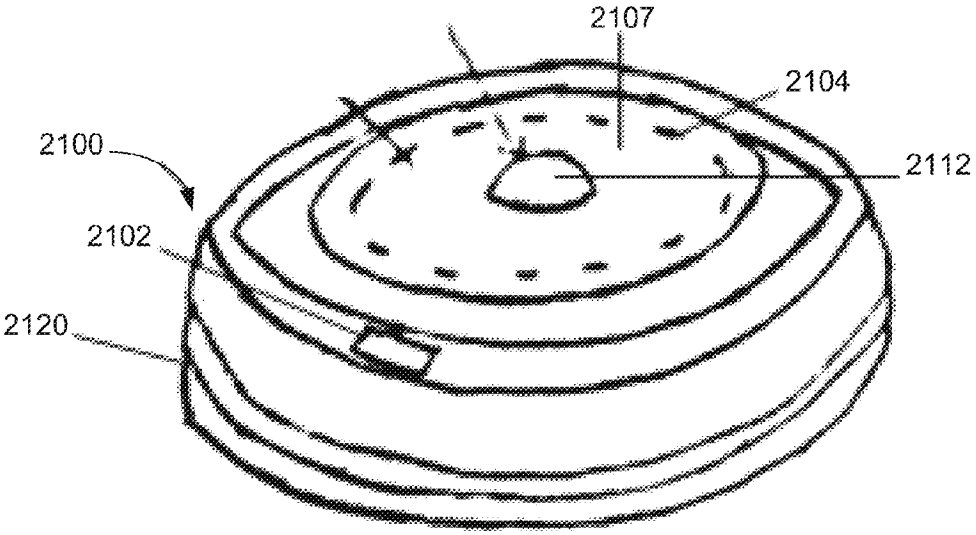
FIG. 21A shows a specific implementation of a lid.
Figure 21B:
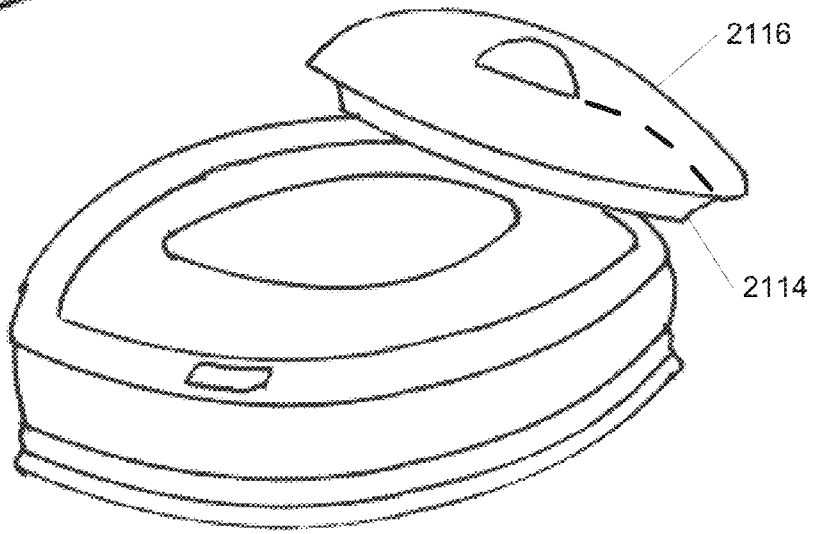
FIG. 21B shows a specific implementation of a lid where a cover member is removed from the lid.
Figure 21C:
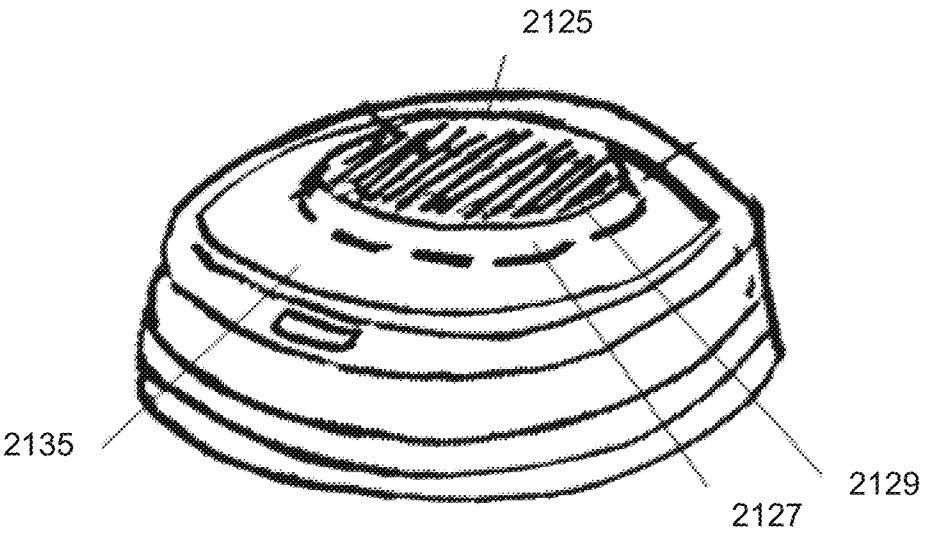
FIG. 21C shows a specific implementation of a lid having a raised lip around an opening of the lid.

FIGS. 21A-21C show specific implementations of a lid incorporating a mouth opening and aroma opening. FIG. 21A shows a specific implementation of lid 2100 having a mouth opening 2102, and a cover member 2107 that is covering the aroma opening 2104 (not visible). The aroma opening, which is below the cover member, is indicated by the broken line. The aroma opening is positioned closer to a central portion of the lid than the mouth opening. The lid includes a rim portion 2120 that fits onto the rim of an open end of a beverage cup (not shown). FIG. 21A shows the mouth opening is above the rim portion. In other implementations, the mouth opening can be on the same plane as the rim portion.

The cover member includes a handle member 2112 for engaging a user's fingers to facilitate removing the cover member from, or placing the cover member over, the aroma opening. The handle member protrudes from an outer surface of the cover member. The handle member can include curved surfaces, planar surfaces, cavities, or a combination of these to allow the user's fingers to grab onto.

FIG. 21B shows the cover member removed from the aroma opening. The cover member and the aroma opening can have any shape. FIG. 21B shows the aroma opening and the cover member have rounded shapes such as a circle. In other implementations, they can have other shapes, including oval, ellipse, triangle, square, rectangle, other polygonal shapes, or an irregular shape. The cover member includes a sealing member 2114 that protrudes from an inner surface of cover member that is opposite the outer surface. The sealing member has the same shape (e.g., annular or circular) as the aroma opening, and engages with a perimeter of the aroma member to form a seal to prevent spillage. The sealing member frictionally engages the perimeter of the aroma opening to hold the cover member in place. To attach the cover member to the opening, a user can press fit the cover member over the opening, and can feel the cover slide into the opening until it is stopped by a rim 2116 of the cover member.

FIG. 21C shows a specific implementation of a lid having a raised lip 2125 around the aroma opening. The raised lip includes an annular wall 2127 that extends from a central portion of the lid, and an upper edge 2129 of the raised lip is raised above the central portion 2135 by a first distance. The aroma opening and the raised lip can resemble a well, or a volcano. The raised lip can help to prevent the beverage contents from spilling out of the aroma opening.

Figure 22:
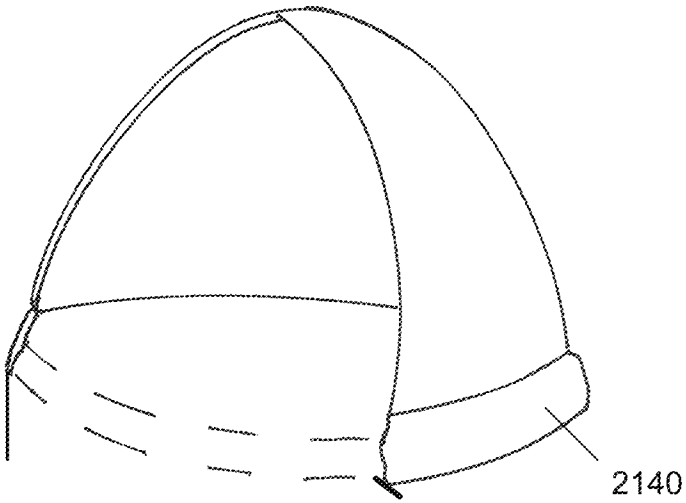
FIG. 22 shows a specific implementation of a lid having a dome shape.

FIG. 22 shows a specific implementation of a lid having a dome shape. The dome lid includes a mounting member 2140 extending around a perimeter of a rim of the lid. The mounting member can fit onto a rim of a cup (not shown) or fit onto a second lid (not shown). The second lid can be a conventional flat lid (e.g., a disposable coffee or tea lid) or a lid as shown in FIGS. 21A-21C, or other lids. The mounting member can extend around the perimeter of the rim, or extend a partial portion of the rim (e.g., 50, 51, 52, 53, 54, 55, 56, 57, 58, 59, 60, 61, 62, 63, 64, 65, 66, 67, 68, 69, 70, or 75 percent or greater).

The dome lid can act as a concentrator, as described above, by channeling aromas from beverage to a person's nose. A wall of the dome lid prevents aroma molecules from escaping into the air. A cross sectional area of the dome lid decreases in a direction from a lower side to an upper side of the lid. This decrease in the area can concentrate the aroma molecules into a small area, thereby increasing the density of the aromas in the space.

Figure 23A:
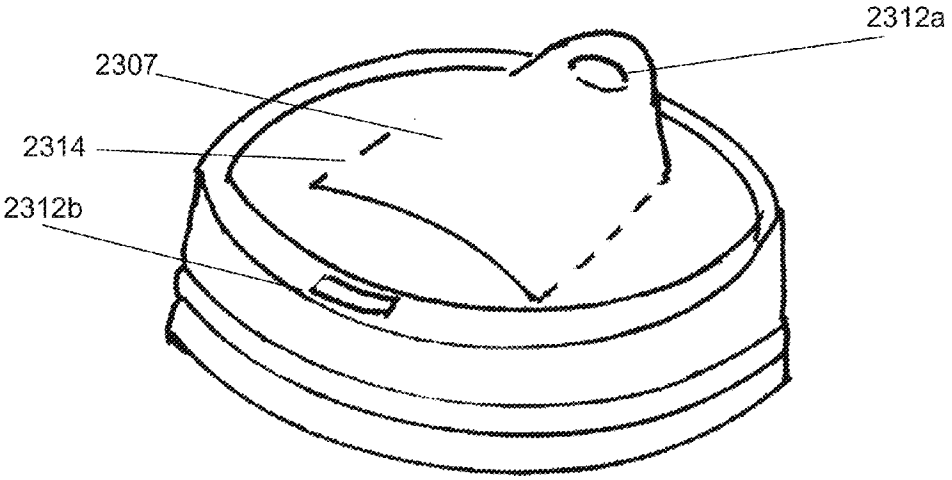
FIG. 23A shows a specific implementation of a lid having a cover member, in a closed configuration.
Figure 23B:
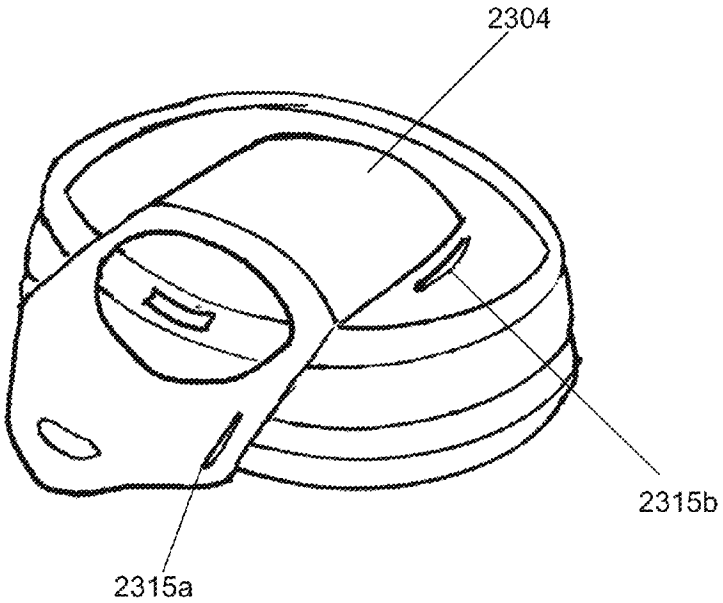
FIG. 23B shows the lid of FIG. 23A in an open configuration.

FIG. 23A shows a specific implementation of a lid having a cover member 2307 that is covering an aroma opening (not visible). The cover member includes a first fastening member 2312*a* for engaging with a second fastening member 2312*b* positioned closer to a rim of the lid. In a specific implementation the cover member is connected to the lid at a hinge member 2314. To open the cover member, a user can rotate the cover portion about the hinge member in a first rotation direction to expose the aroma opening. FIG. 23B shows the open configuration. The first fastening member can mate with the second fastening members mate to secure the cover member to the lid in the open configuration. In a specific implementation the first fastening member is a raised body that protrudes from an outer surface of the cover member (e.g., may be referred to as a male portion, knob, projection, or others), while the second fastening member is a depressed region close to the rim of the lid. The second fastening member can be referred to as a female portion, opening, groove, cavity, hole, recess, or others. In other implementations, the fastening members can be omitted or not used, and the cover member can simply be folded back to expose the aroma opening.

In an implementation, the cover member and lid can include other fastening members to hold the cover member over the aroma opening 2304. In a specific implementation, a width of the cover member is greater than a width of the aroma opening, so that the cover member can over lap with the lid. The cover member includes first mating portions 2315*a* positioned on an inner side of the cover member, and second mating portions 2315*b* are positioned close to an edge of the aroma opening. The first mating portion can have a raised or protruding body while the second member has a cavity or opening for fitting the first mating portion therein. These portions can be reversed where the first mating portion has a cavity for fitting a protruding body of the second mating portion. In other implementations, the hinging member is omitted, and the cover member is a separate portion that can be entirely removed from the lid.

Figure 24B:
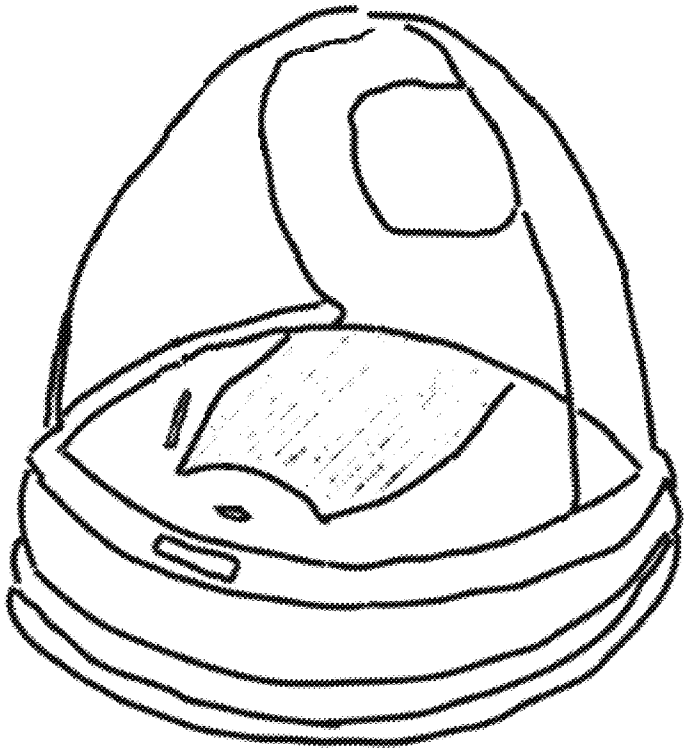
FIG. 24B shows a dome lid mounted to the lid of FIG. 24A.
Figure 24A:
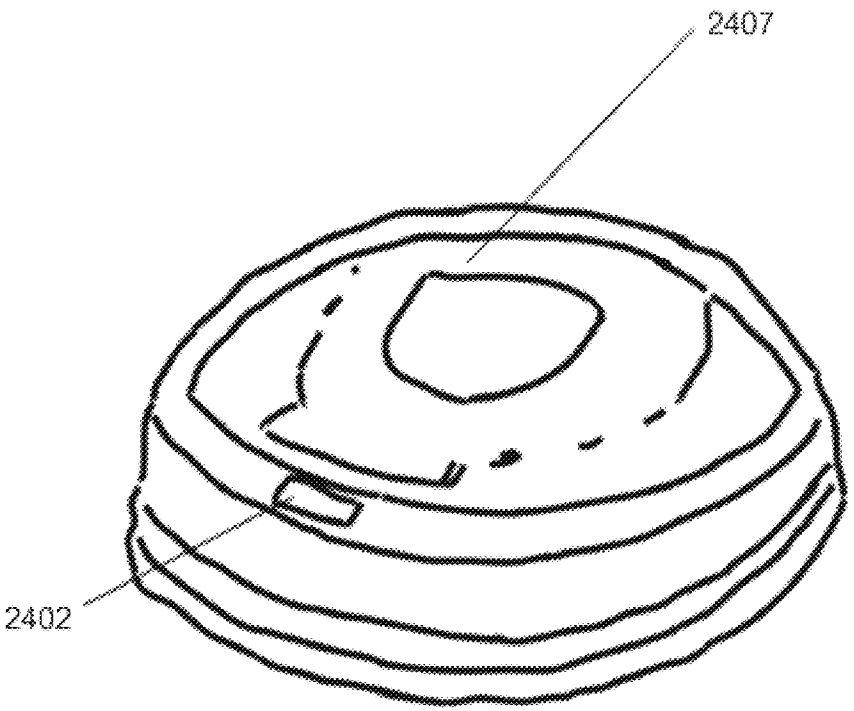
FIG. 24A shows another specific implementation of a lid having a cover member.

FIG. 24A shows a specific implementation of a lid having a mouth opening 2402 and an aroma opening (not visible). A cover member 2407 is positioned over the aroma opening to close the opening. FIG. 24B shows a second domed lid mounted to the lid. The dome lid can include a mounting member as discussed earlier for FIG. 22. The cover member can include any number of mating portions as described above for FIGS. 23A-23B positioned on an outer surface or inner surface of the cover. Corresponding mating portions can be positioned on the lid along an edge of the aroma opening, or on an inside surface of the dome lid. To maintain the cover member in an open configuration, one or more mating portions on the upper surface of the cover member can engage with corresponding mating portion on the inside surface of the dome. To secure the cover portion in a closed configuration, one or more mating portions on an inner surface of cover can engage with corresponding mating portions along an edge of the aroma opening.

FIG. 25A shows a specific implementation of a lid 2500 with a removable dome portion 2506 (i.e., concentrator member). The dome portion is attached to the lid. FIG. 25B shows the dome portion removed from the lid. A lower rim of the dome portion includes insert portions 2520*a*, 2520*b*, 2520*c* that protrude downwardly from the rim. The insert portions align with and fit into corresponding cavities or openings 2522*a*, 2522*b*, 2522*c* on a surface of the lid. Although FIG. 25B shows three insert and cavity pairs, there can be any number of mating pairs. For example there can be fewer (e.g., 1 or 2 pairs), or more than 3 (e.g., 4, 5, 6, 7, 8, or more pairs).

The dome lid can have any shape. In an implementation, the dome lid includes planar surfaces, straight edges, or a combination of these. The removable dome portion can have many benefits. The dome portion can be mounted to any number of beverage containers and therefore can be reused. The removable dome can be stacked and packaged separately from the lid, which can reduce bulk. For example, two or more lids can be fit over each other and stacked for one package, while two or more dome portions can be stacked for a separate package. Thus, more units of each of the dome portion and of the lid can be packaged and shipped together, which is desirable to manufacturers, shipping companies, restaurants, and coffee shops.

Figure 25C:
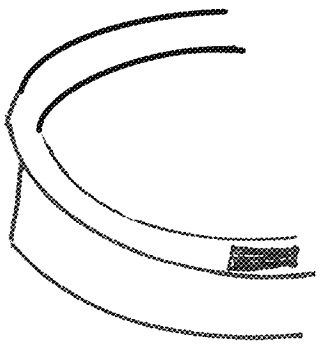
FIG. 25C shows another specific implementation of a lid and removable dome portion.

FIG. 25C shows a specific implementation of the lid and removable dome portion where the lid includes a raised sidewall that extends upward from a rim of the lid. In this implementation, the insert portions may be omitted from the dome portion, and the dome portion can be mounted to the sidewall through friction fitting. An inner surface of the rim of the dome portion engages with the sidewall to hold the dome portion to the lid.

FIGS. 26A-26D show a lid with a holder member 2610 for holding substances with aromatics. This can include coffee beans, coffee grounds, a tea bag, tea leafs, herbs (e.g., lavender, chamomile, lemon verbena, basil, mint, and others), spices (e.g., ginger, cinnamon, nutmeg, allspice, vanilla, cardamom, and others), and other aromatics (e.g., eucalyptus, menthol, aloe, and others). While many people prefer to smell the beverage itself, they also enjoy adding aromatics to customize the drinking experience. For example, coffee drinkers can add cinnamon and vanilla to the holder member to add to the flavor profile of a plain, black coffee. People who have a cold or sinuses can also benefit from a warm, steamy drink. Steam from hot liquid permeates aromatics in the holder, causing the steam trapped inside the lid to become infused with the aromas. Aromas such as *eucalyptus* and mint can help soothe and clear up a blocked nose.

In an implementation, the lid can be made of scented materials to enhance the experience of inhaling the aromas and drinking the beverage. The scent can be pleasant smell, such as lavender or chamomile.

Figure 26A:
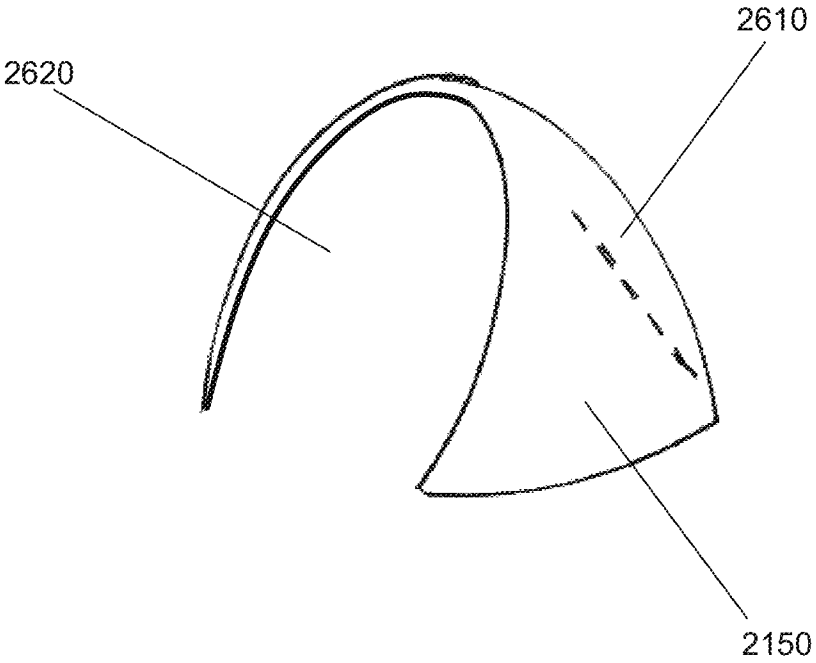
FIG. 26A shows a perspective view of a specific implementation of a lid with a holder member.

FIG. 26A shows a specific implementation of the lid with a holder member 2610. The dashed lines indicate the positioning of the holder member on the inside of the lid. The holder member is not visible from the outside of the lid. In some embodiments, the lid is made of a transparent or translucent material, and the holder member can be visible from the outside of the lid. The lid includes a first opening 2620, for drinking and smelling the beverage, a concentrator member 2650, and an interface for engaging the lid with a beverage container (e.g., disposable cup, mug, travel cup, thermos, glass, and others).

Figure 26C:
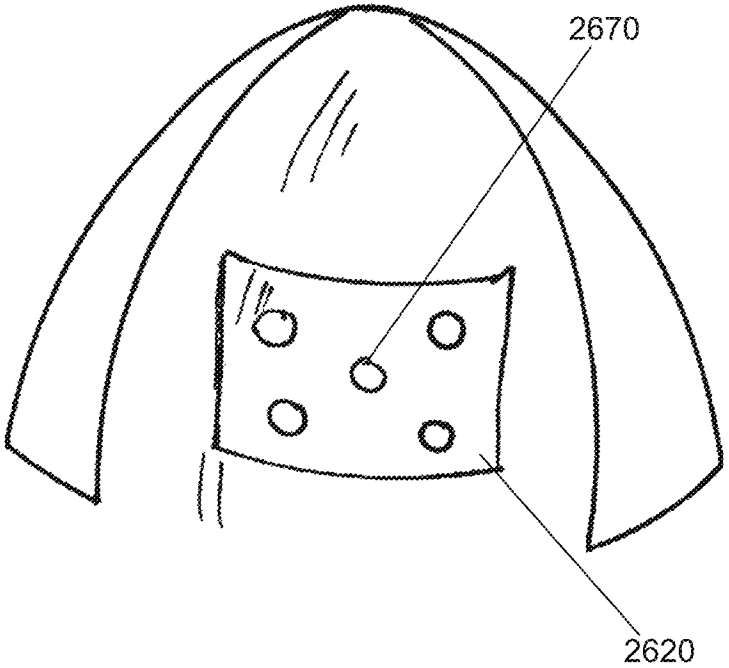
FIG. 26C shows another implementation of the holder member with perforations.
Figure 26B:
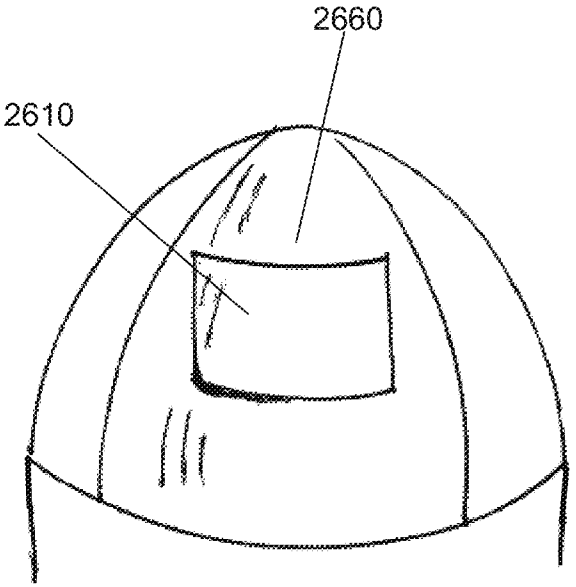
FIG. 26B shows another view of the holder member on an inside of the lid.

FIG. 26B shows another view of the holder member on an inside of the lid. The holder member may be positioned at any location on an inside surface of the lid. In a specific implementation, as shown in FIG. 26B, the holder member is positioned opposite the first opening (e.g., at 0 degrees, while the opening is at 180 degrees). The holder member can be aligned with the opening, or offset to the right or left by any number of degrees (e.g., 5, 10, 15, 20, 25, 30, 35, 40, 45, or 50 degrees or more). Positioning the holder member opposite the opening allows for the aromas from the contents inside the holder member to flow a short distance before reaching the nose. When in use, as described above, the user's nose extends through the first opening and into the inner space of lid. The concentrator traps heat (steam) and aromas from the beverage in the cup. With the nose positioned in the lid in front of the opening, there is only a small gap of space between the nose and the holder member. The person can inhale the aromas that are more directly in front of the nose, which can provide a more intense smelling and tasting experience. The holder member can also be referred to as a pocket, pochet, compartment, pouch, bag, container, enclosure, receptacle, and others.

In a specific embodiment, the holder member includes a layer of material, in the shape of a closed polygon, that is attached to the inside of the lid along an edge or a perimeter of the material. In an implementation, the holder member can resemble a pocket, with an opening 2660 along a first edge while the other edges are attached to the lid. The opening can be positioned at an upper end of the pocket. In other implementations, the opening can be positioned closer to a right or left end of the pocket. And in another specific implementation, the holder member can have a length greater than a width, wherein the length of the holder member extends in a first direction (e.g., horizontal) and the width extends in a second direction (e.g., vertical) opposite the first direction.

The holder member can be attached to the inside of the lid by any means. The holder member can be more permanently attached by a process of welding, sealing, gluing, or sewing an edge of the holder member to the lid. The holder member can also be a removable member, providing the user with the option of using it, and the holder member can also be cleaned more easily. Then, the holder member can be attached to the lid using a fastening member (e.g., clips, studs, clasps, inserts, magnets, hooks, and others), Velcro, tape, other adhesives, and many others.

The holder member can have any polygon shape, or can be an irregular shape. For example, the shape can be a triangle, square, rectangle, trapezoid, pentagon, hexagon, octagon, and many others. The shape can also include curved edges (e.g., circle, oval, ellipse, and others) or a combination of curved edges and straight edges.

Typically, a material of the holder member includes a water resistant material such as a polymer. The material can have or be a same material as a material of the lid. The material can be elastomeric to provide some stretch to the holder member to hold a greater volume of contents, such as a few grams of coffee beans or a tea bag.

FIG. 26C shows an embodiment of holder member 2620 with perforations 2670 for allowing steam to pass through to the contents of the holder member and aromas to escape from the holder member. The perforations can cut or molded into the holder member. The perforation can be arranged according to a pattern or dispersed randomly across a surface of the holder member. For example, the perforations may be arranged in a row, column, or a combination of these, an array, matrix, and many others. Generally, a more even distribution of perforations will allow heat (steam) from the beverage to pass through to the contents of the holder member. The perforations can also be referred to as holes, through holes, passageways, slits, channels, and others.

Although FIG. 26C shows five perforations, the holder can have any number of perforations. For example, there can be fewer than five (e.g., 1, 2, 3, or 4), or more than 5 (e.g., 6, 7, 8, 9, 10, 11, 12, 13, 14, or 15 or more). Generally, the more perforations there are, the more steam can pass through to the contents of the holder.

Figure 26D:
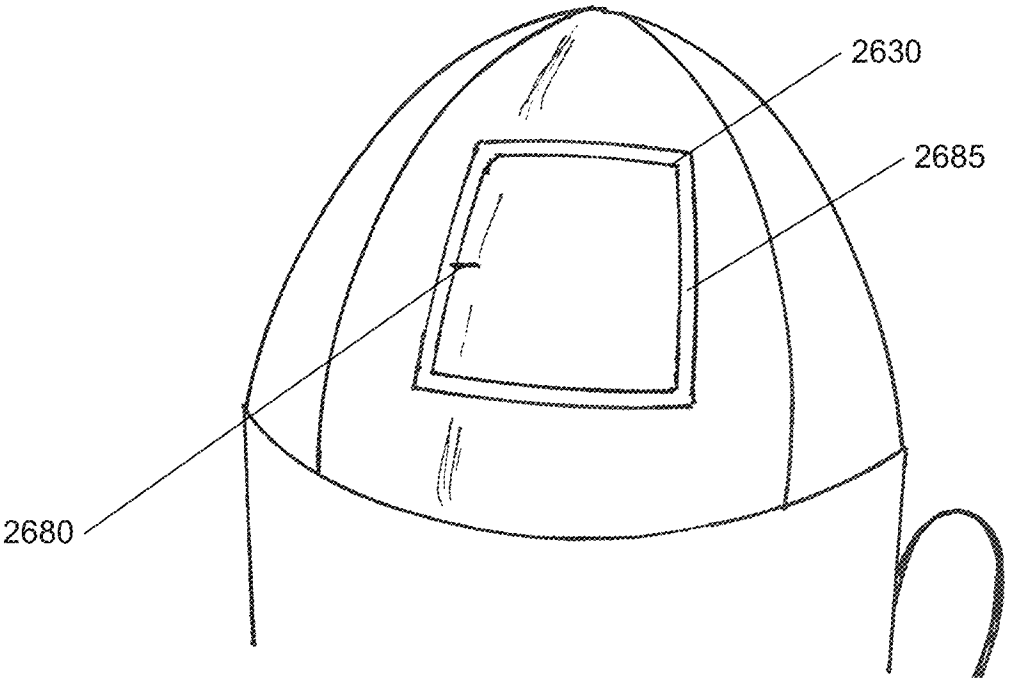
FIG. 26D shows another implementation of the lid with a door member on an inside of the lid.

FIG. 26D shows a specific embodiment of a holder member 2630 with a door member for accessing the inside of the holder member. The door member can include a latch 2680 for holding the door closed. In various embodiments, the door includes a hinge 2685 about which the door member can rotate to open and close the door. The door member can include a translucent or transparent material, allowing the user to see the contents of the holder member. The door member can also be referred to as a window or a pane.

Figure 27A:
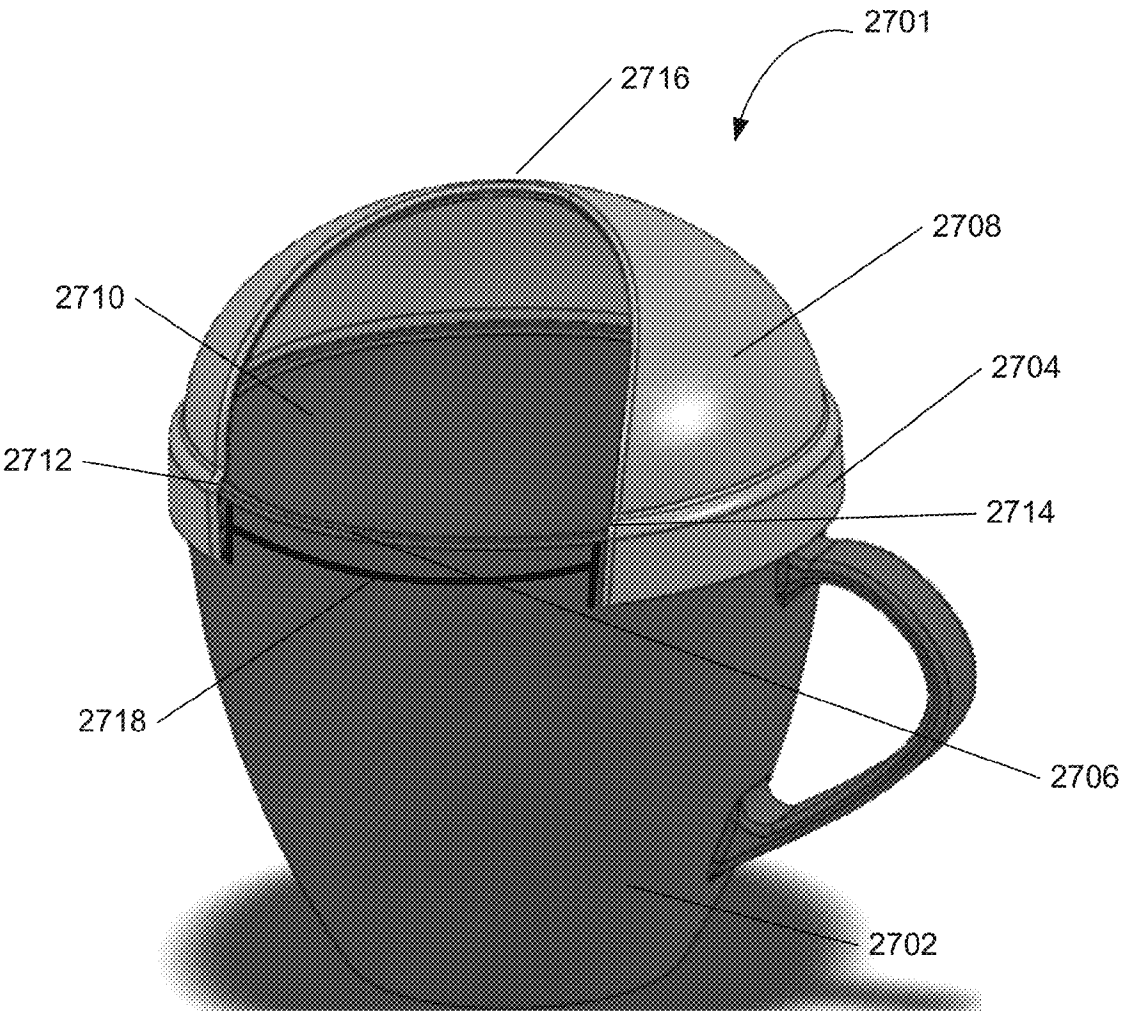
FIG. 27A shows an implementation of a lid coupled to a mug.
Figure 27C:
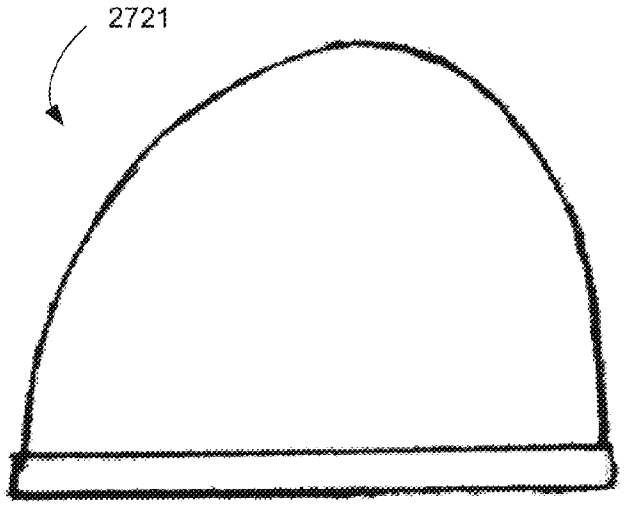
FIG. 27C shows a back view of the lid.
Figure 27D:
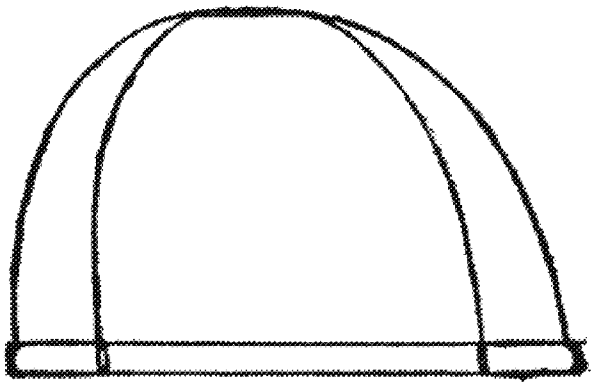
FIG. 27D shows a front view of the lid.
Figure 27B:
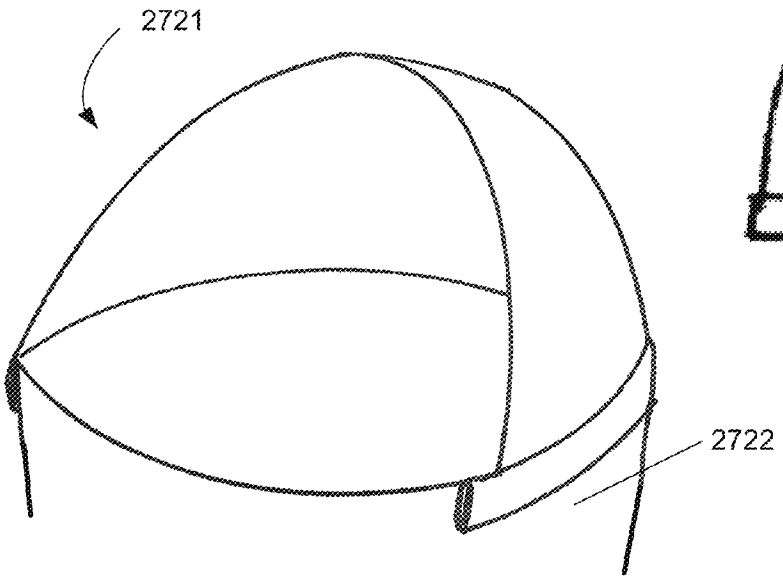
FIG. 27B shows another implementation of the lid.

FIG. 27A shows an implementation of a lid 2701 for a beverage container. FIG. 27A shows a perspective view of lid 2701 coupled to a beverage container 2702, such as a mug. The lid includes a rim portion 2704 that is configured to engage with an upper lip 2706 of a beverage container. The lid also includes a dome portion 2708, which is shown in FIG. 27A to have a hemispherical shape. However, in other implementations, the dome portion can also have other shapes, such as triangular prisms, pyramid, conical, cylindrical, or other polygon prisms. Different shapes and different sizes of shapes can affect the concentration of aromas. The dome portion has an opening 2710, which can also be referred to as an aroma opening. The opening extends from a first rim position 2712 to a second rim position 2714, and the opening extends from the rim portion to an apex 2716 of the lid. In other implementations, the opening can extend from rim portion to a point that is below the apex of the lid. An arc length 2718 of the opening at an elevation level of the rim portion is the arc length between the first and second rim positions. The arc length shown in FIG. 27A is approximately one quarter of the circumference of the rim portion. However, in other implementations, the arc length can be longer and the opening would be bigger, in order to help cool down a hot beverage. Or the arc length can be shorter and opening would be smaller in order to insulate and keep a hot beverage warm for a longer period of time. FIG. 27B shows another implementation of a lid 2721 coupled to a container 2722. FIGS. 27C-27D show a back and a front view of lid 2721, respectively.

Figure 28:
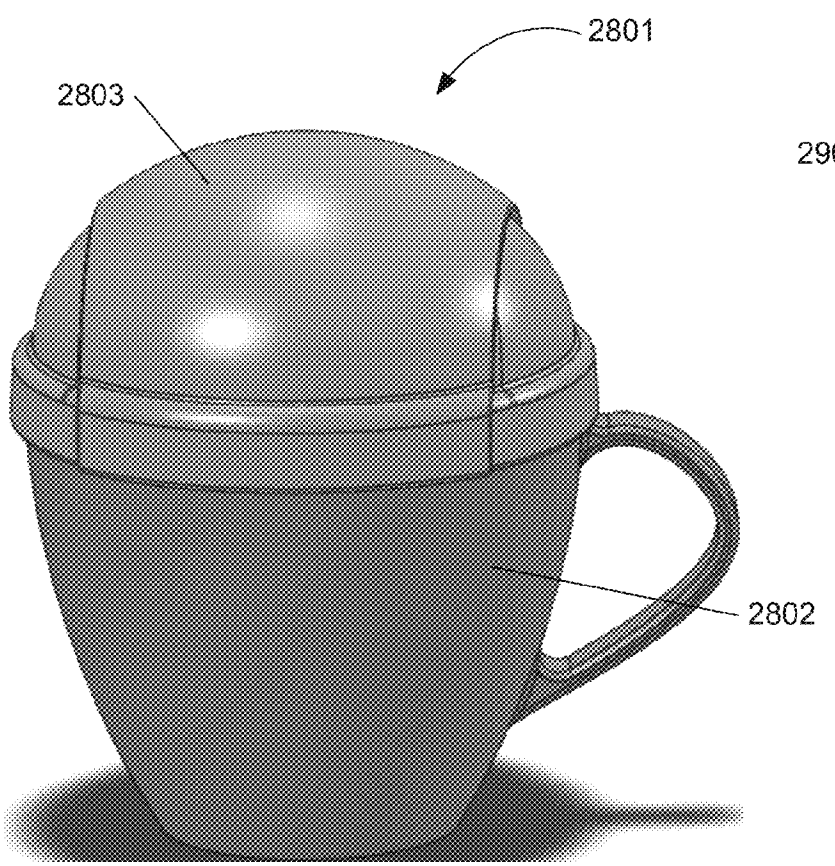
FIG. 28 shows another implementation of a lid with a cover.

FIG. 28 shows a specific implementation of a lid 2801 for a container 2802. Compared to the lid in FIG. 27A, lid 2801 includes a cover 2803 that closes the dome opening. Cover can be a separate piece that attaches onto an upper lip of the container or the rim portion of the lid.

Figure 29:
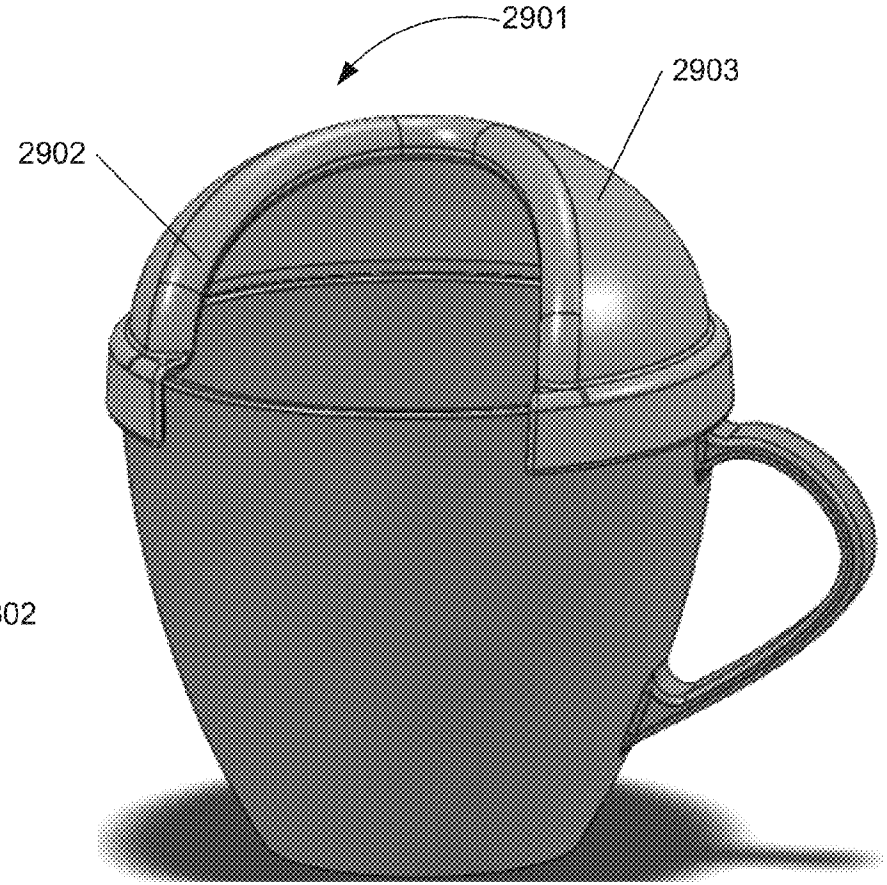
FIG. 29 shows another implementation of a lid with a softer opening.

FIG. 29 shows a specific implementation of a lid 2901. Compared to the lid in FIG. 27A, an edge 2902 of this dome portion 2903 that partially encloses the dome opening is softer and more smoothly rounded. This lid has a softer and smoother rounded aroma opening so it is more ergonomic for the drinker to use. The drinker would not feel uncomfortable when the drinker's face contacts the soft rounded edges of the lid. The shape of the softer edge can be part of a mold for this lid or it can be attached to the lid. The softer edge can be made of the same material as the lid or of a different material, such as a softer gel-like substance.

Figure 30A:
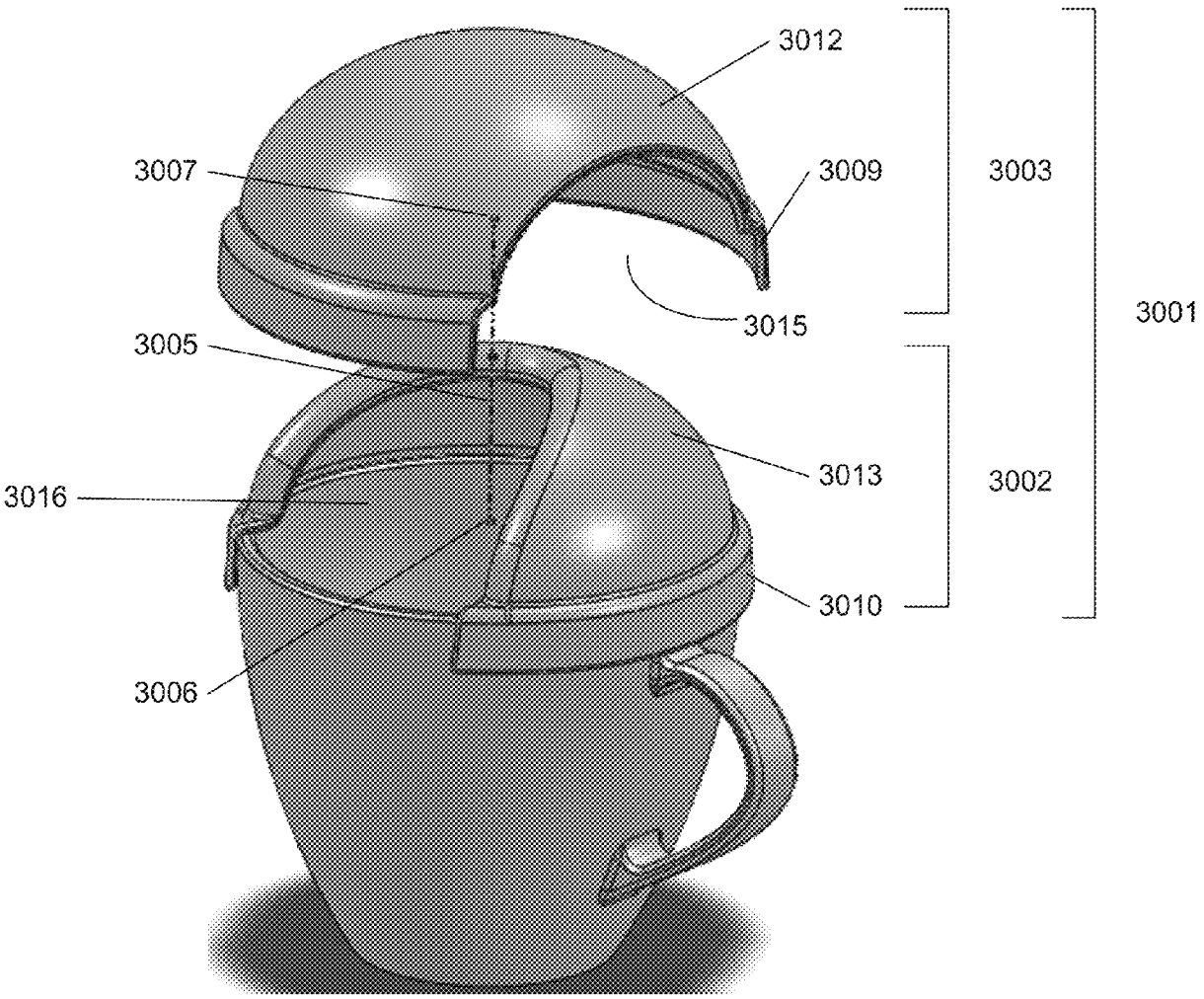
FIG. 30A shows an exploded view of an implementation of a lid that shows different graphics.
Figure 30B:
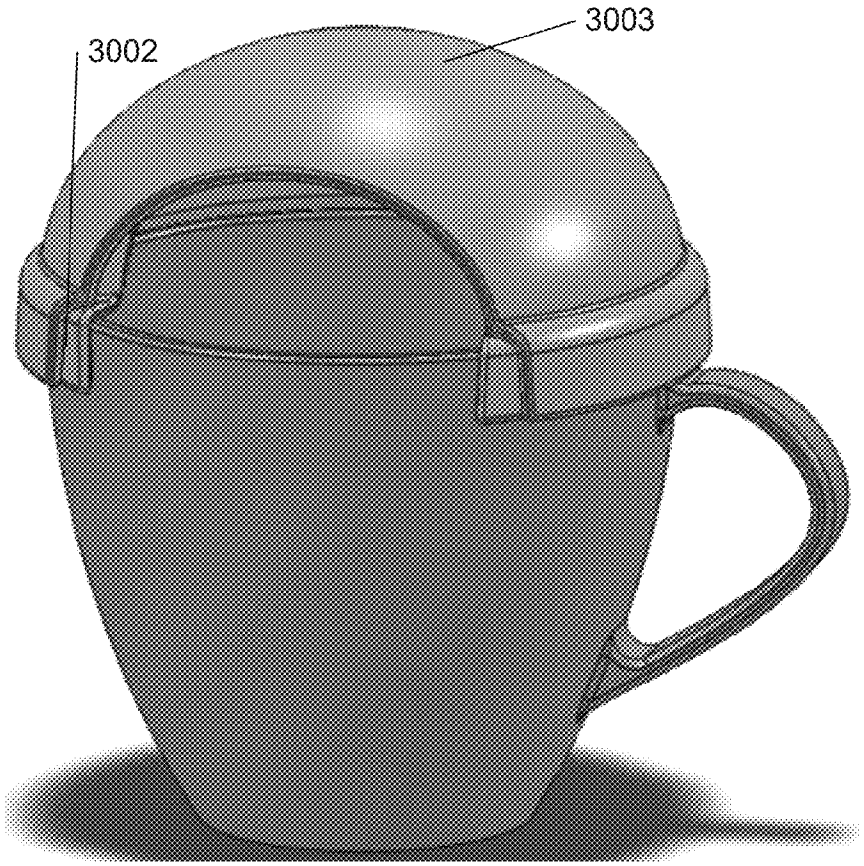
FIG. 30B shows an assembled view of the lid.

FIGS. 30A-30B shows a specific implementation of a lid 3001 that reveals different images or graphics as a dome portion of the lid is turned. FIG. 30A shows an exploded view of the lid. FIG. 30B shows an assembled view of the lid. The dome portion includes a lower piece 3002 and an upper piece 3003 that lies on top of the lower piece. The upper can be rotated around a central axis 3005, which is an axis that goes through a center 3006 of the rim portion and a center 3007 of the dome portion. Or the lower piece can be rotated, or both upper and lower pieces can be rotated. Because the rotational movement is similar to the rotational movement characteristic of a carousel, the implementation of FIGS. 30A and 30B can be referred to as a carousel design. When the top piece is attached to the lower piece, the top piece can be rotated to open and close the aroma opening.

Each piece includes a rim portion 3009, 3010, an upper dome portion 3012, a lower dome portion 3013, and an upper dome opening 3015, and a lower dome opening 3016. The dome openings of the lower and upper pieces can match in size, or shape, or both. Or they can be different in size or shape. The lower dome portion includes images on its exterior. The upper dome portion is placed atop the lower dome. When the either the upper dome portion, or the lower dome portion, or both are rotated, the images on the lower dome portion's exterior are revealed. In FIG. 30A, the dome openings of the upper and lower pieces are approximately 90 degrees from each other and the dome openings do not overlap. If assembled with the upper and lower pieces in this orientation, a user cannot drink from the cup. In FIG. 30B, the dome openings of the upper and lower pieces overlap with each other so a user can drink from the cup. This implementation is a more interactive concept that can be especially appealing to children.

Figure 31:
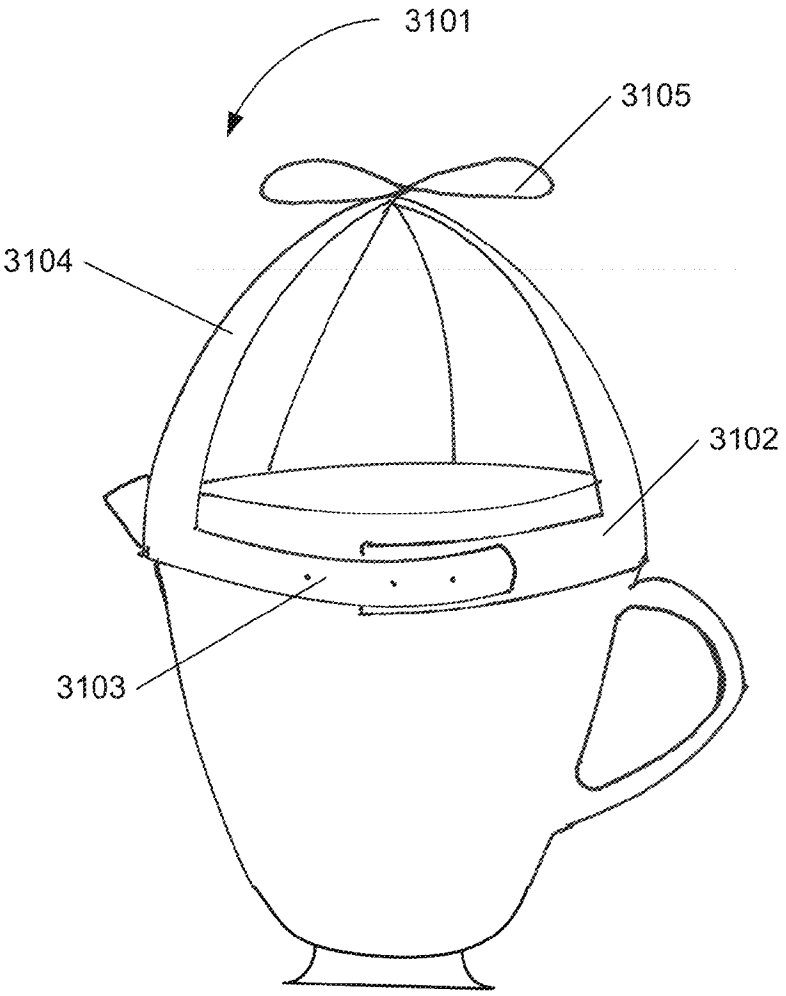
FIG. 31 shows an implementation of a lid with an adjustable rim portion.

FIG. 31 shows an implementation of a lid 3101 in which a size of a rim portion 3102 is adjustable. The lid can have an adjustable snap closure 3103 to allow the lid to fit onto various sized cups. Further, the lid can also resemble a cap 3104 with toy propeller blades 3105. This feature can be attractive to children, who can be entertained by the movable toy propellers while using the lid over a cup or mug.

Figure 32B:
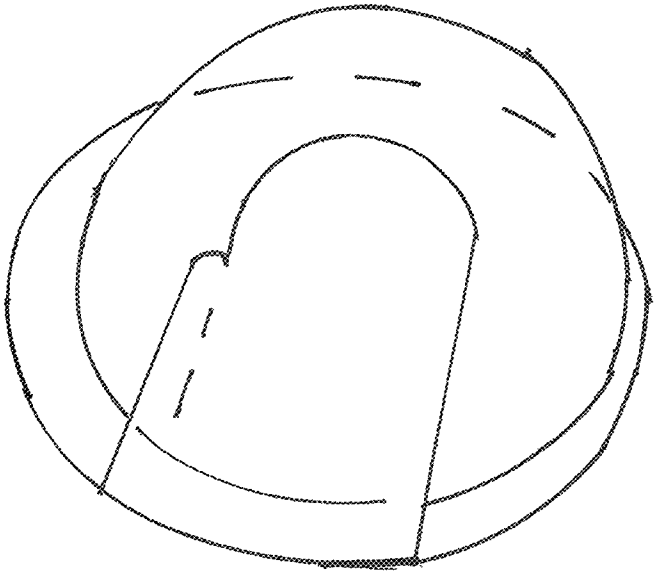
FIG. 32B shows the lid with the opening closed.
Figure 32A:
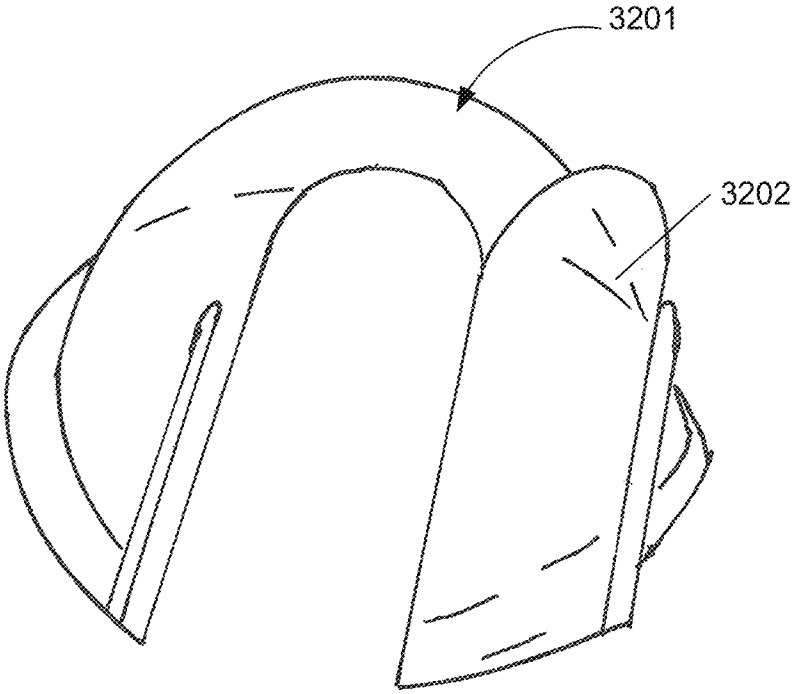
FIG. 32A shows another implementation of a lid with an opening that is opened.
Figure 33B:
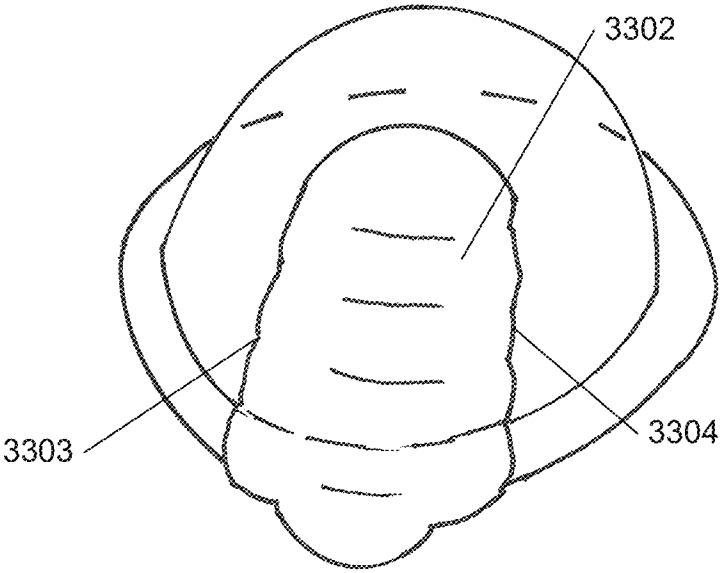
FIGS. 33A-33B show another implementation of a lid.
Figure 33A:
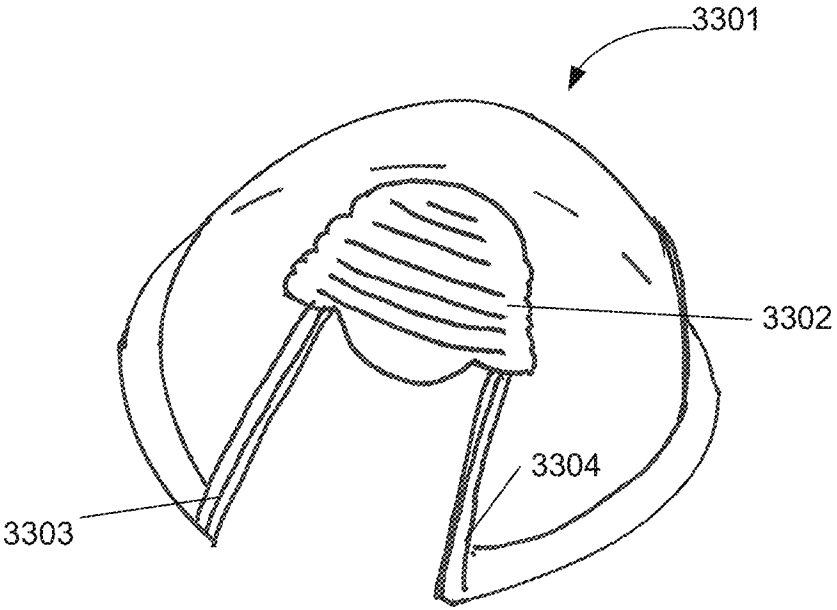

FIG. 32A-32B shows an implementation of lid 3201 where a dome opening of the lid is in open and closed state, respectively. Compared to the lid in FIG. 27A, this lid includes a cover 3202 for the dome opening. In this implementation, the cover is a flap that is bent into an open (FIG. 32A) or closed (FIG. 32B) position. In other implementations, the cover can be a separate piece and attached to the dome opening, such as with a hinge. FIG. 33A-33B show another implementation of lid 3301 in open and closed state, respectively. In this implementation, to open the dome opening, the cover 3302 is a piece that can be folded (similar to a garage door or window blinds) into one area of a dome opening so that the dome opening is wholly or partially exposed. To close the dome opening, the cover can be released from its folded position to cover the dome opening. Or the cover can slide up (to open) and down (to close) along a left edge 3303 and a right edge 3304 of the dome opening. The cover can be wider than a width of the dome opening. The width of the dome opening can be measured from a first position on left edge to an opposite position (a second position) on the right edge.

Figure 34B:
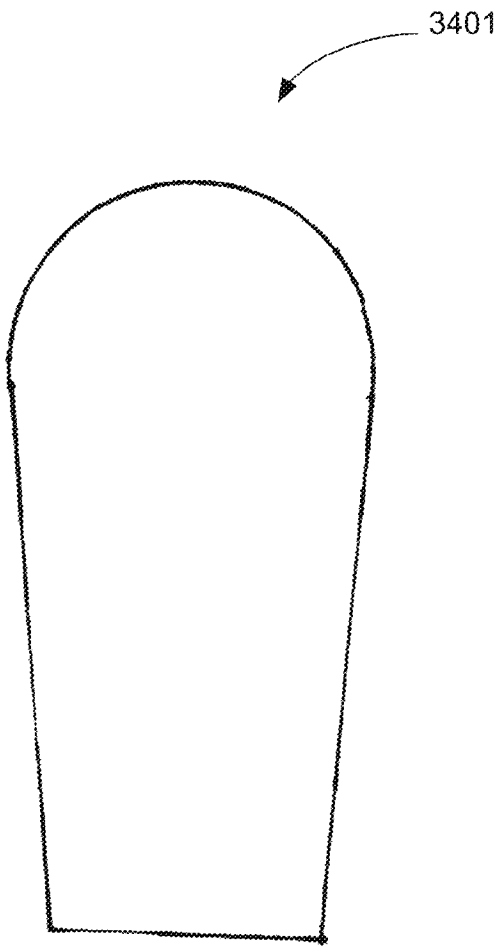
FIGS. 34A-34F show an implementation of a lid and a cup that is formed in one piece.
Figure 34A:
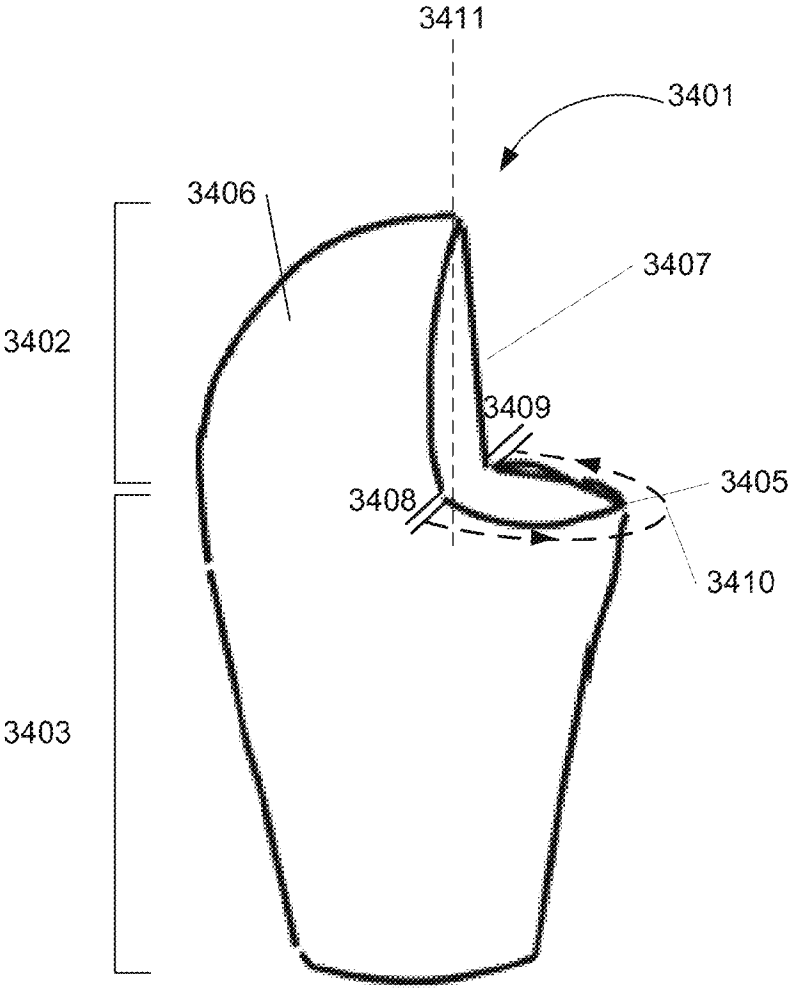
Figure 34D:
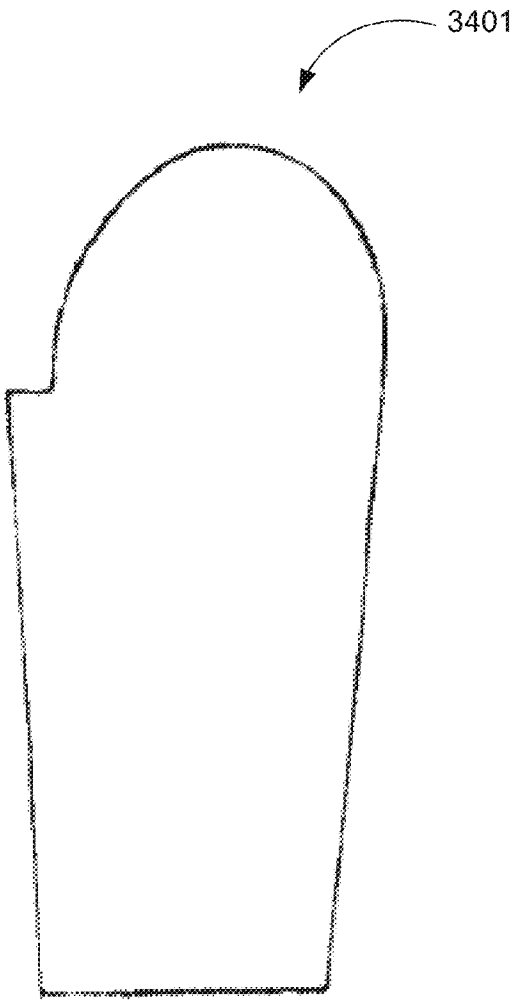
Figure 34C:
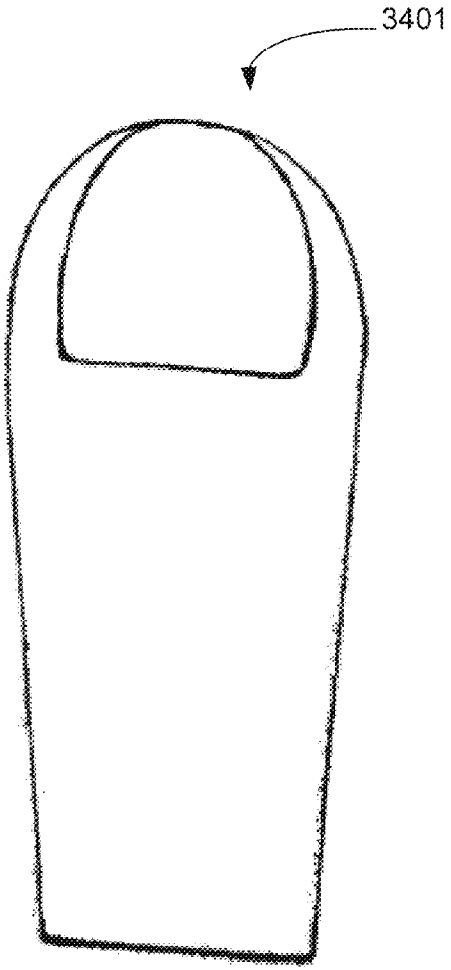
Figure 34F:
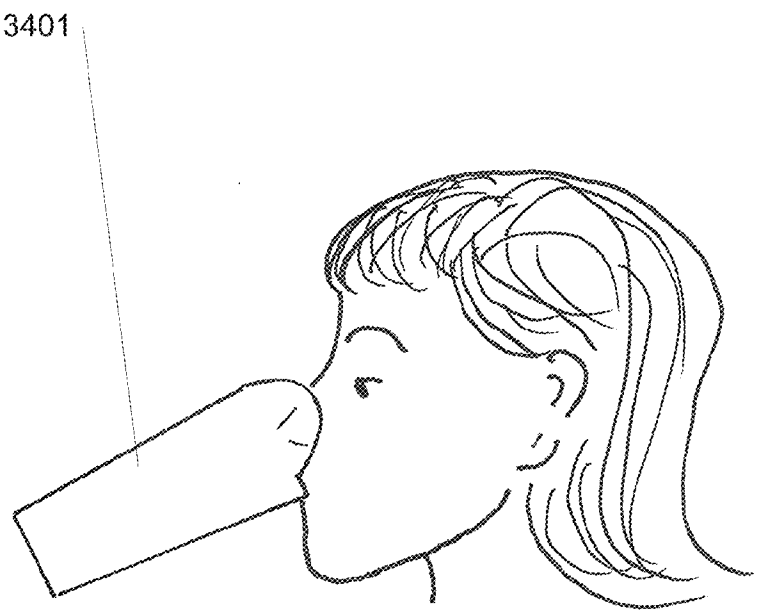
Figure 34E:
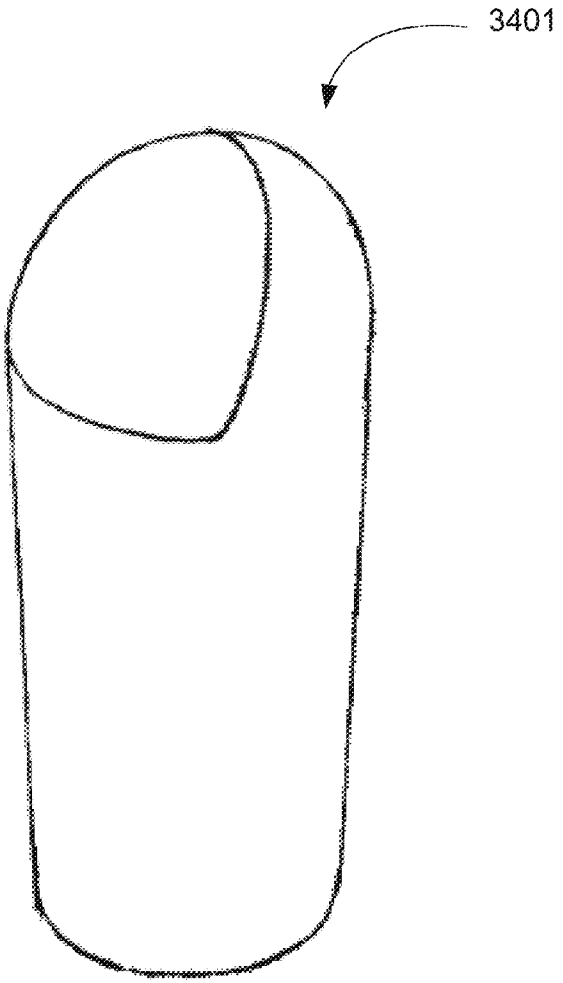
Figure 35B:
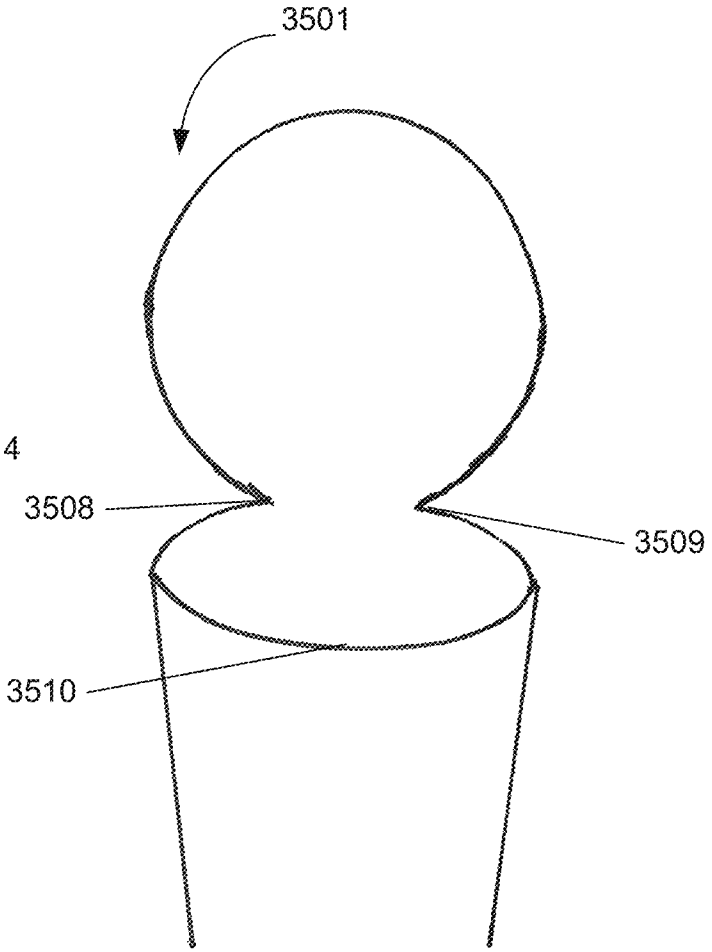
FIGS. 35A-35C show another implementation of a lid and a cup that is formed in one piece.
Figure 35A:
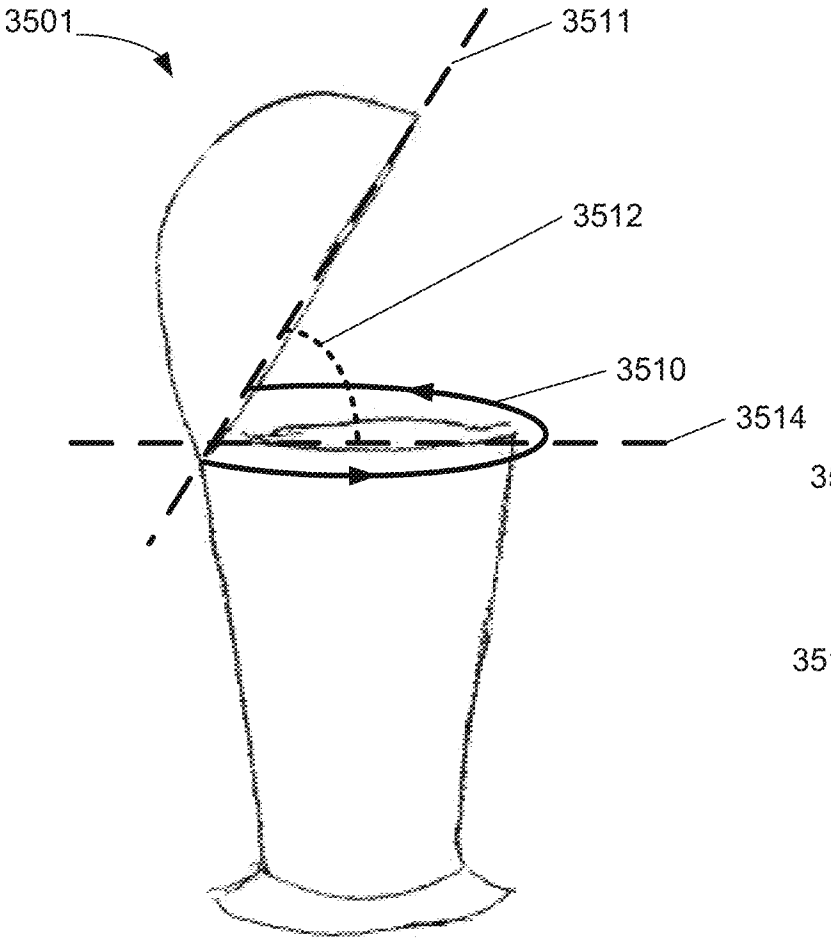
Figure 35C:
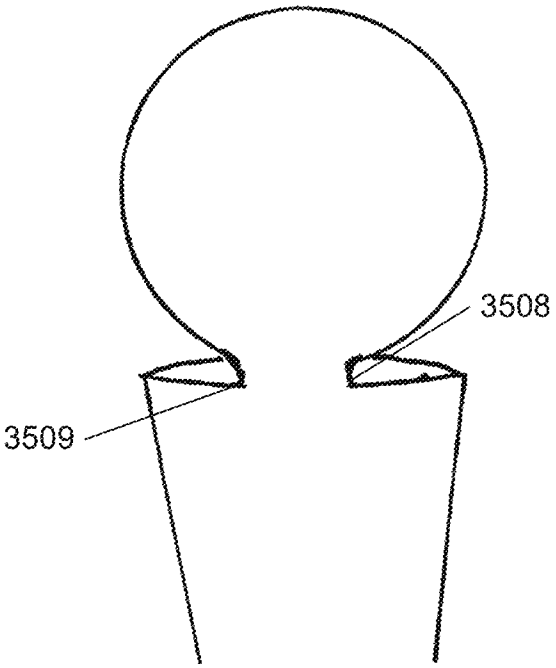

FIGS. 34A-34F show a combination 3401 of a lid 3402 and a cup 3403 that is formed in one piece. FIG. 34A shows a left side view of the combination. FIG. 34B shows a back view. FIG. 34C shows a front view. FIG. 34D shows an angled view from the back. FIG. 34E shows an angled view form the front. And FIG. 34F shows the lid and cup combination in use. The cup includes a cup lip 3405. The lid includes a dome portion 3406 with an opening 3407. In FIGS. 34A-34F, the opening starts at a first lip position 3408 and ends at a second lip position 3409. The second lip position is an arc length 3410 along the cup lip away from the first lip position. In this implementation the arc length is approximately one third of the cup lip's circumference. An edge of the dome opening is substantially planar and plane 3411 is substantially vertical. FIGS. 35A-35C show a side view, front view, and back view, respectively, of another implementation of a combination of a lid and a cup. Compared to FIGS. 34A-34F, the arc length 3510 between the first 3508 and second 3509 lip positions is greater. And the plane 3511 of the dome opening's edge is at an acute angle 3512 relative to a plane 3514 that includes the cup lip.

Figure 36A:
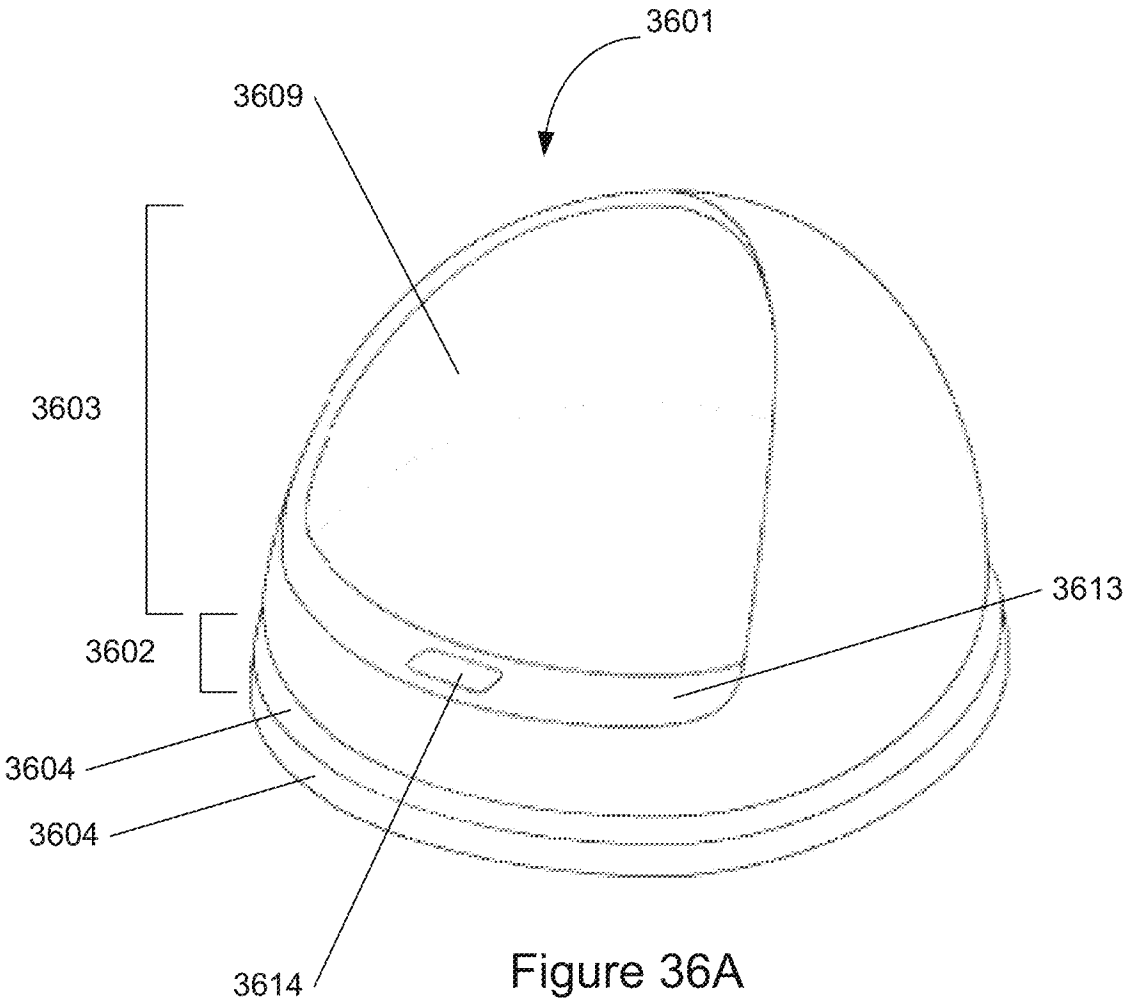
FIGS. 36A-36C show another implementation of a lid.
Figure 36B:
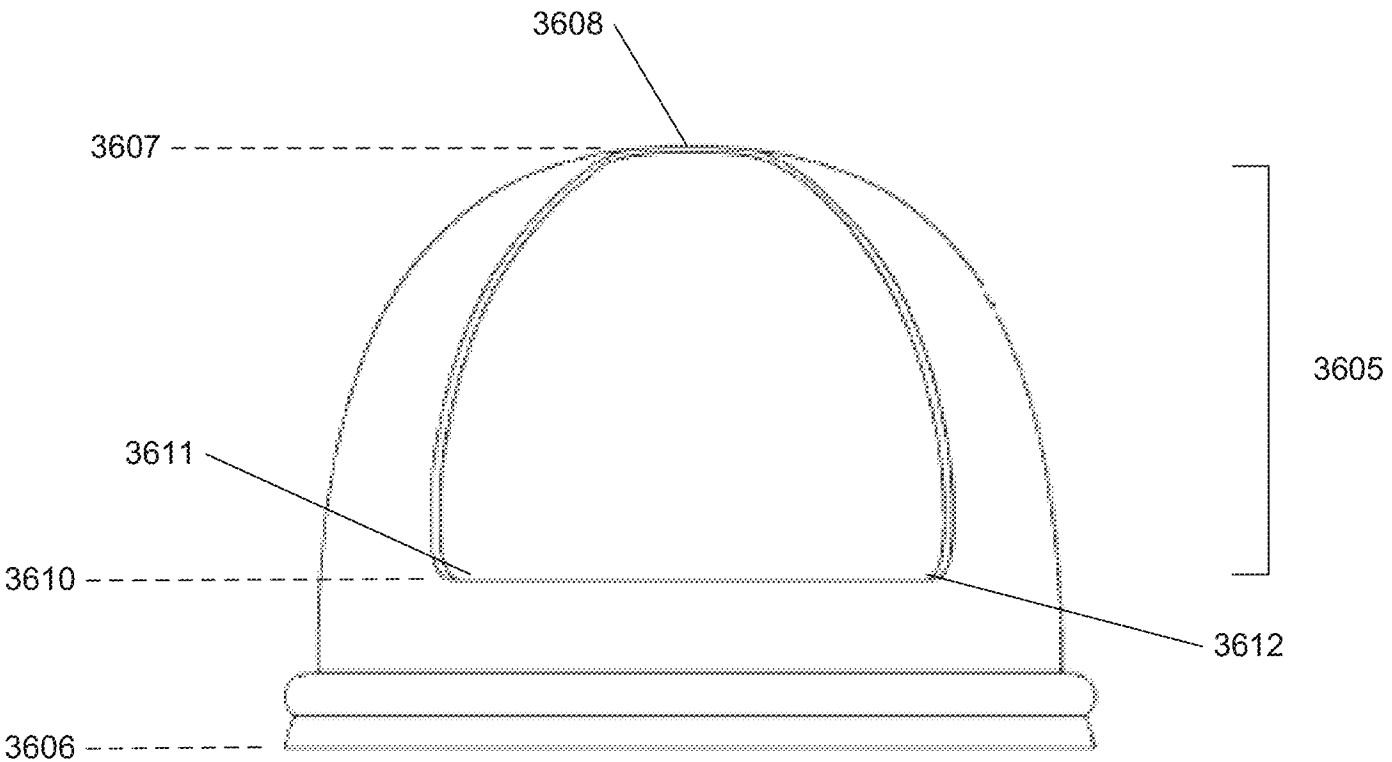
Figure 36C:
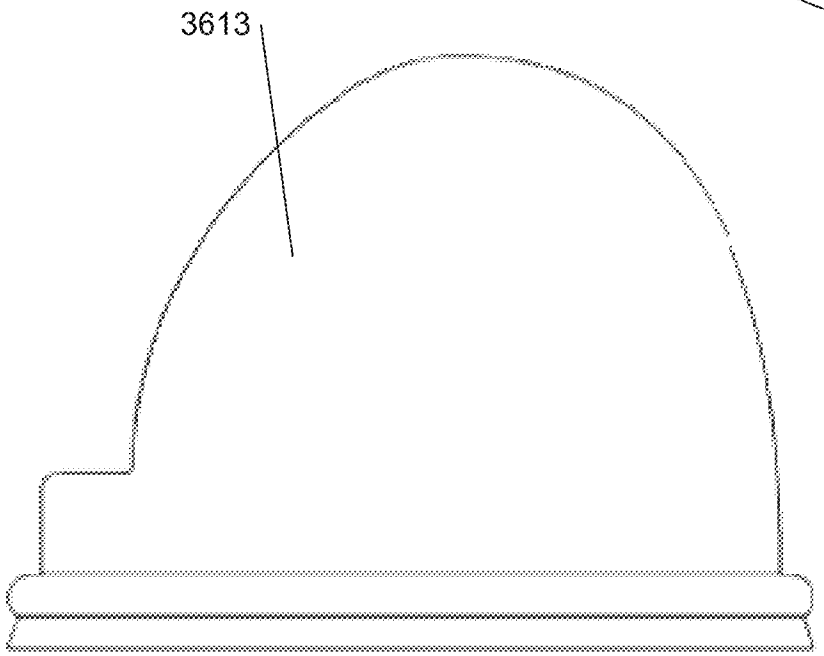

FIGS. 36A-36C shows an implementation of a lid 3601. FIG. 36A show a perspective view of the lid. FIG. 36B shows a front view of the lid. FIG. 36C shows a perspective view of the lid from the back. The lid includes a rim portion 3602 and a dome portion 3603. The exterior of the rim portion includes two ridges 3604 that extend around the perimeter of the rim. The dome portion is coupled to the rim portion. The dome portion has a height 3605 extending from an elevation level 3606 of the rim to an elevation level 3607 at an apex 3608 of the dome portion. The dome portion includes a dome opening 3609. On the dome portion, the dome opening extends from an elevation level 3610 that is above the rim to the elevation level of the apex. Compared to FIG. 27A, the dome opening in this lid is farther above the rim portion. The dome opening also extends from a first position 3611 on the dome portion to a second position 3612 on the dome portion. The first and second positions on the dome portion are substantially at the same elevation levels. Along the first and second positions on the dome portion, a ledge 3613 projects into the dome opening. The ledge includes a mouth opening 3614 that allows the liquid into a user's mouth.

Figure 37A:
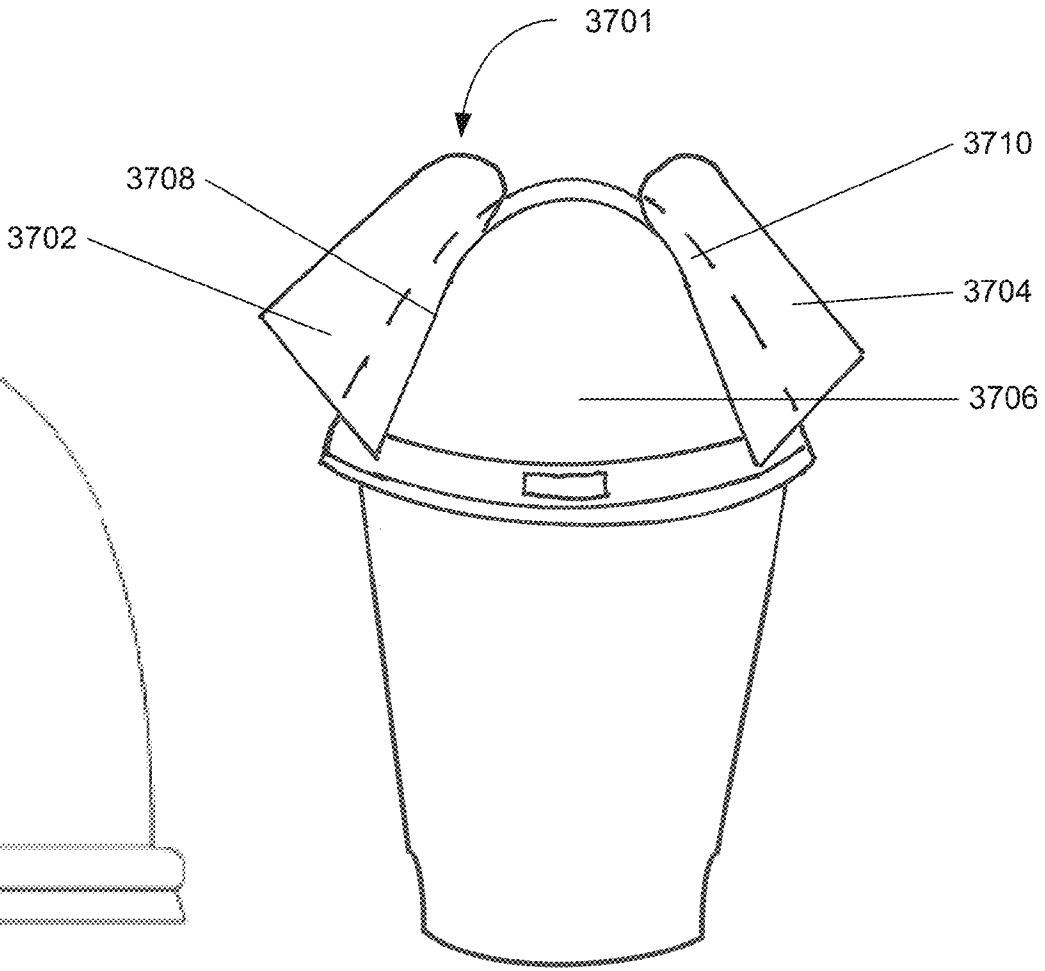
FIGS. 37A-37C show another implementation of a lid with overlapping covers.
Figure 37C:
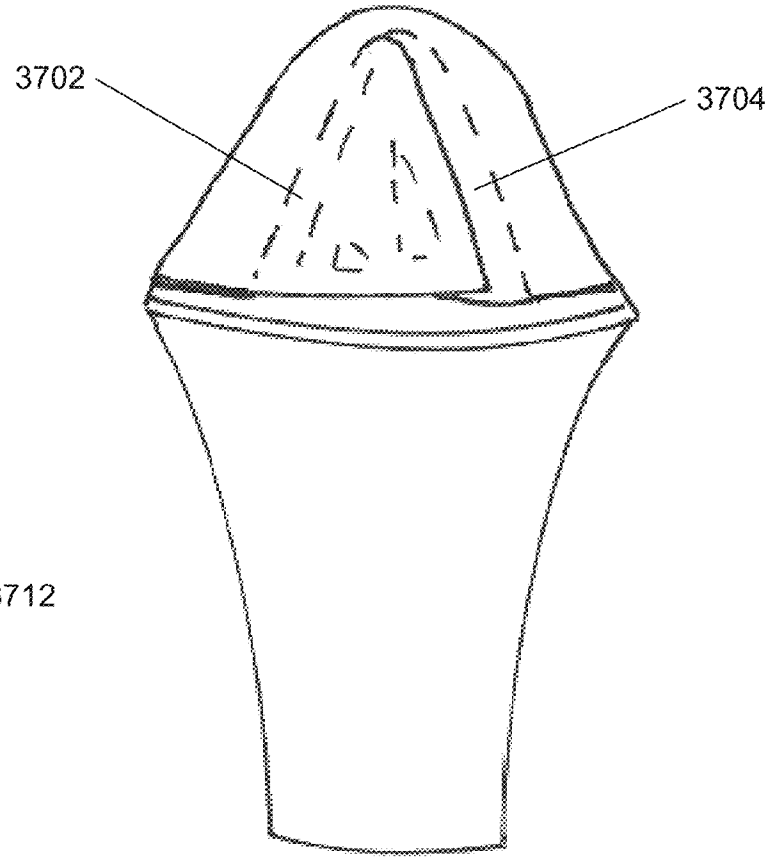
Figure 37B:
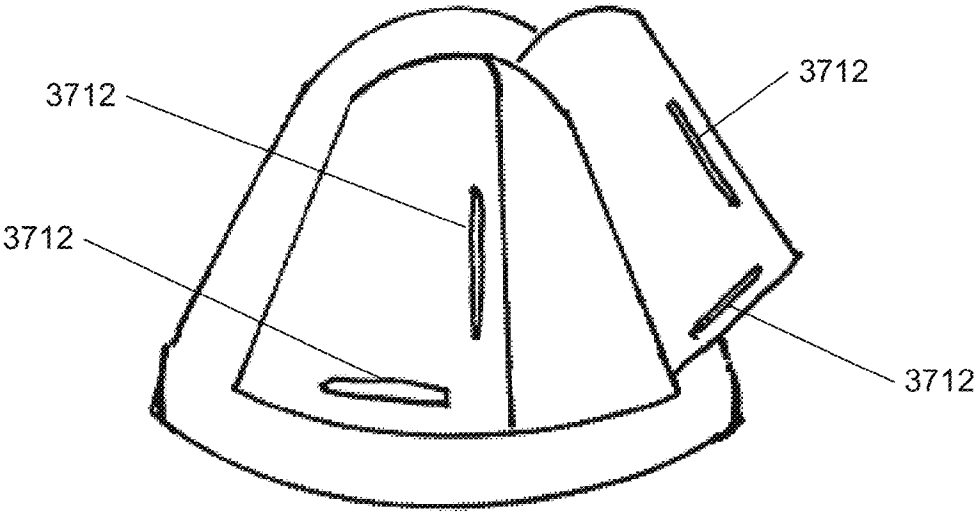

FIGS. 37A-37C shows another implementation of a lid 3701. Compared to lid 3601 in FIGS. 36A-36C, lid 3701 includes a left cover 3702 and a right cover 3704. When viewing a front view of the lid into a dome opening 3706, the left cover is coupled to a portion of a left edge 3708 of the dome opening. And the right cover is coupled to a portion of a right edge 3710 of the dome opening. When both left and right covers are closed, the left and right covers overlap. To secure the covers in position, the exterior of the left cover includes fasteners 3712 (e.g., snap fasteners) that mate with fasteners on the interior of the right cover. In another implementation, the left cover can include fasteners on the interior (instead of the exterior) that mates with fasteners on the exterior of the right cover. FIG. 37A shows the lid with both left and right covers in an open position. FIG. 37B shows the lid with the left cover in a closed position and the right cover in an open position. FIG. 37C shows the lid with the left cover overlapping the right cover in a closed position.

Figure 38A:
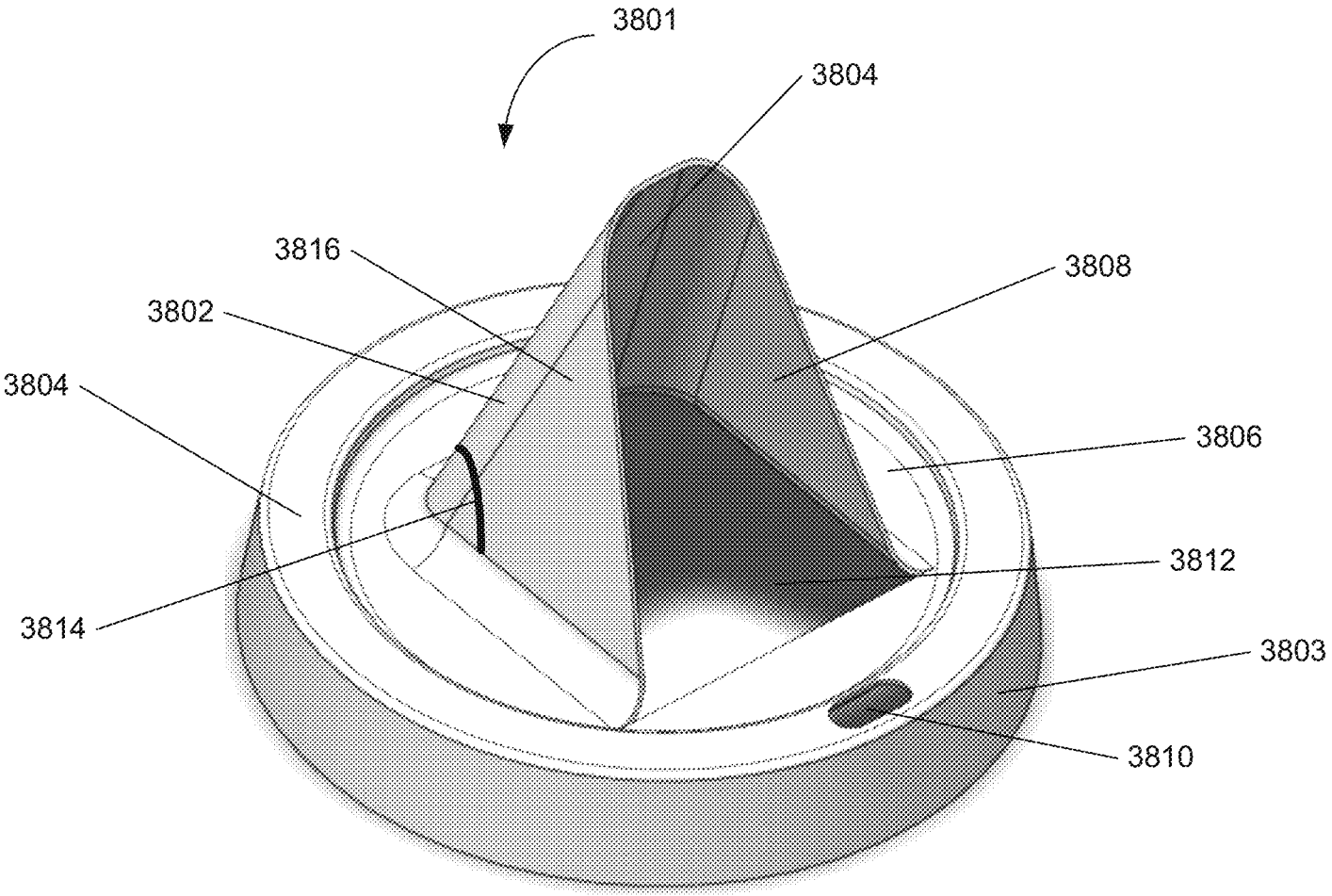
FIGS. 38A-38B show an implementation of a lid with a rectangular aroma channel.
Figure 38B:
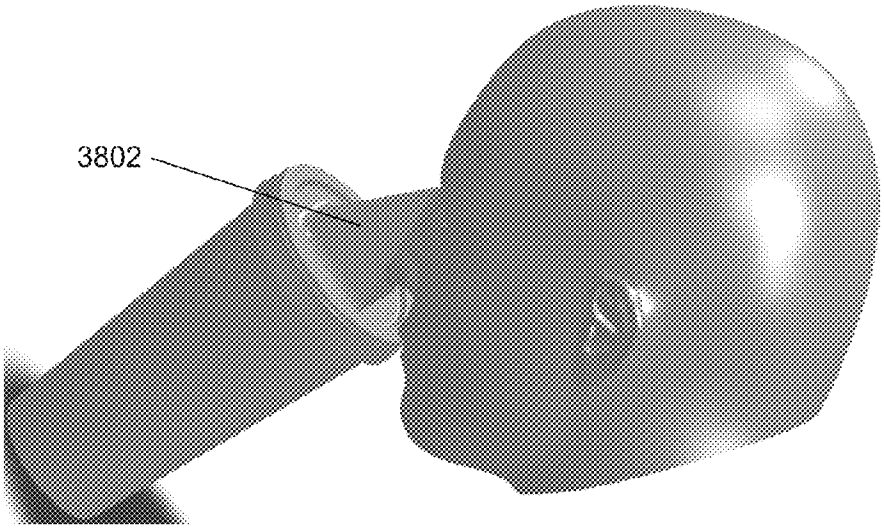

FIG. 38A-38B shows an implementation of a lid 3801 with a rectangular aroma channel 3802 instead of a dome. As an alternative to the dome lid, the aroma channel acts as a canopy by providing an enclosure for the drinker's nose. The lid includes an annular sidewall 3803, a base portion including a substantially horizontal perimeter wall 3804 and a recessed portion 3806 coupled to the horizontal perimeter wall, and an aroma channel 3808. The annular sidewall is configured to engage with an upper lip of a container. The horizontal perimeter wall includes an elongated opening 3810 (also can be referred to as a mouth opening). An aroma opening 3812 is formed in the recessed portion. In this implementation, the aroma opening is rectangular shape. In other implementations, the aroma opening can be shaped as a triangle, circle, or other polygons. An aroma channel projects outwards from the aroma opening at an angle 3814 relative to the recessed portion. The aroma channel comprises sidewalls 3816 that surround a portion of the aroma opening. The sidewalls are lower around a portion of the aroma opening that is closest to the mouth opening. The sidewalls can be one continuous sidewall or be multiple sidewalls coupled to each other. FIG. 38B shows the lid in use. When a user's mouth engages with the mouth opening, the user's nose is positioned into the aroma channel so that the user can inhale and enjoy the aromas arising from the beverage.

Figure 39A:
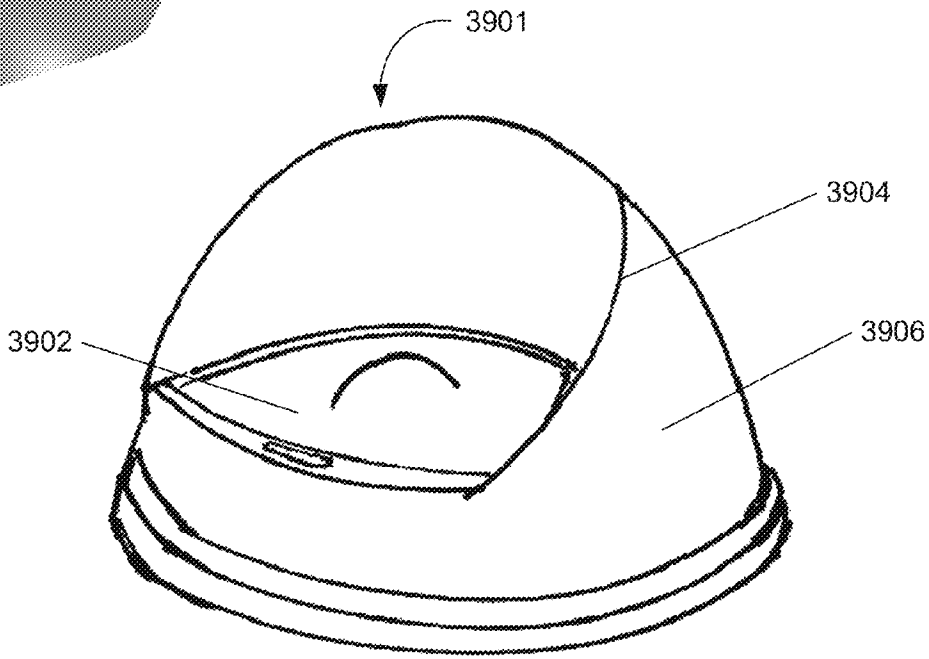
FIGS. 39A-39C show an implementation of a lid that includes a cover portion for an aroma dome.
Figure 39B:
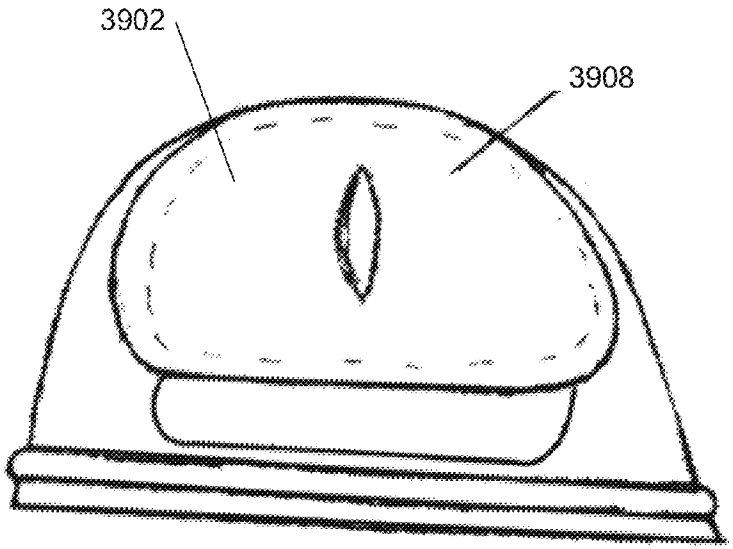
Figure 39C:
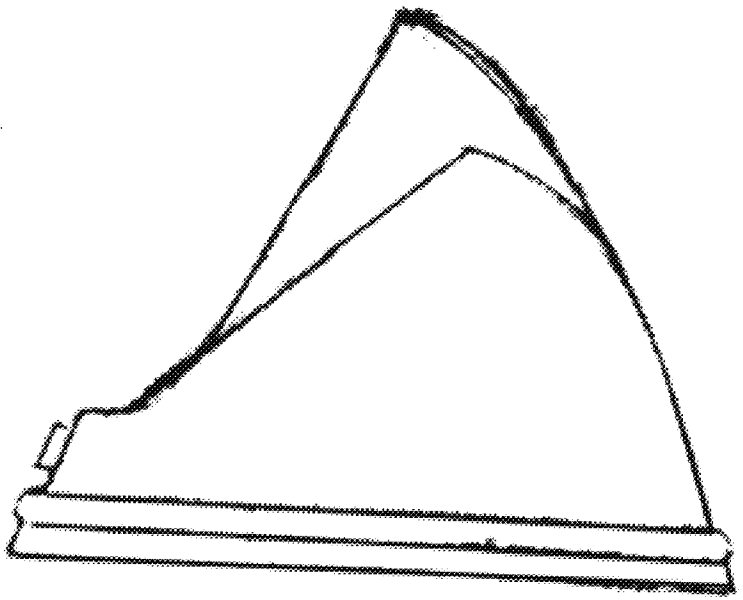

FIG. 39A shows an implementation of a lid 3904 that includes a cover portion 3902 for an aroma dome 3904. The cover portion can be lifted away from an aroma opening (not shown) of the lid. The lid is placed over a cup opening (cup is not shown). The cover portion covers the aroma opening through which steam escapes. FIG. 39A shows a perspective view of the lid with the aroma dome. The cover portion can be at least the size of the aroma opening. The cover portion can have flat portions 3906. FIG. 39B shows a front view of the lid with the cover portion positioned on the aroma dome. The cover can have a curved surface 3908 instead of flat portions. FIG. 39C shows a side or profile view of the lid with the aroma dome.

Figure 40A:
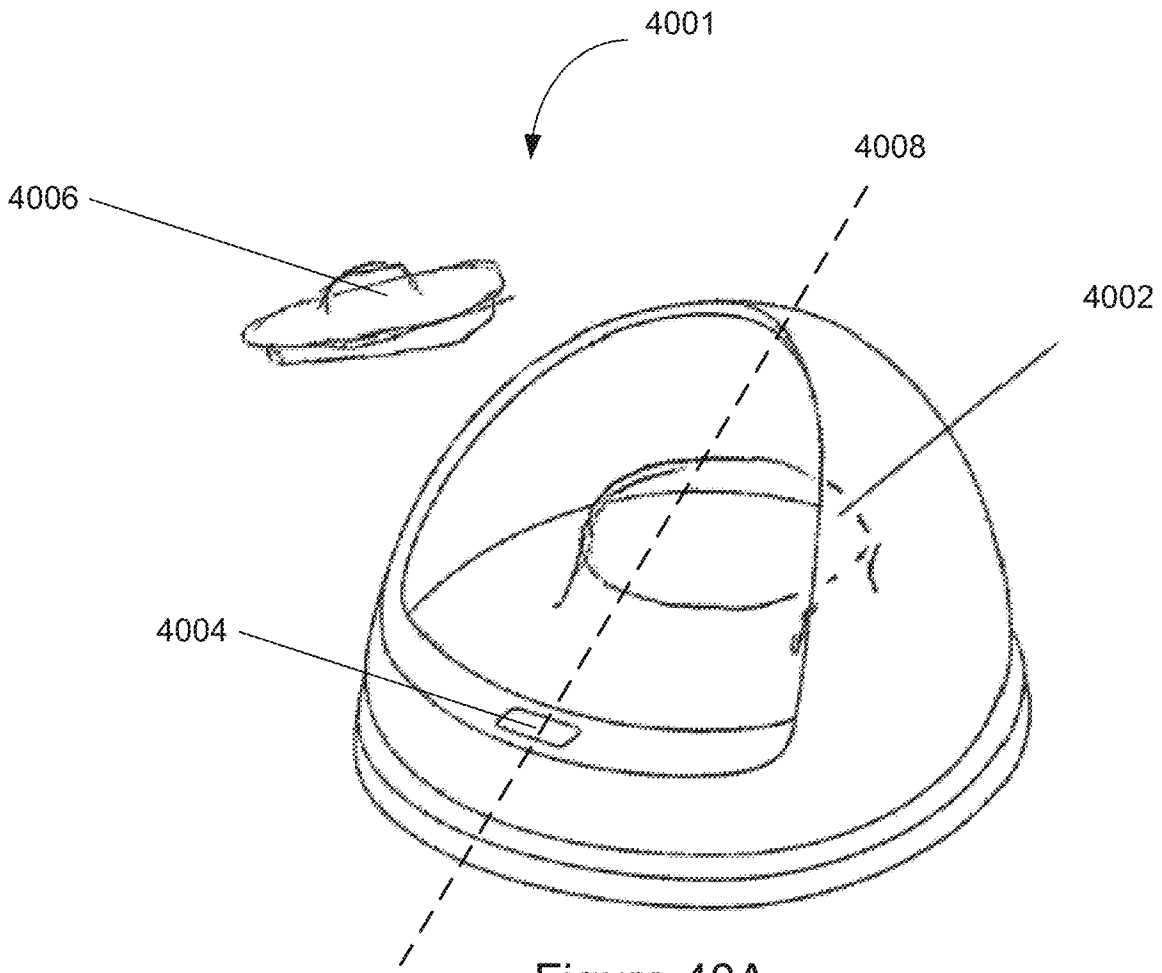
FIGS. 40A-40C show an implementation of a domed lid that includes a raised aroma opening.
Figure 40C:
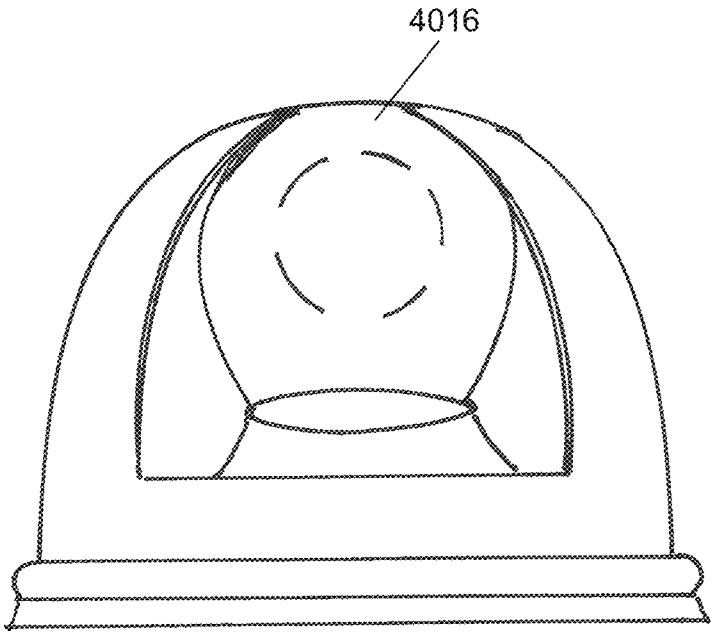
Figure 40B:
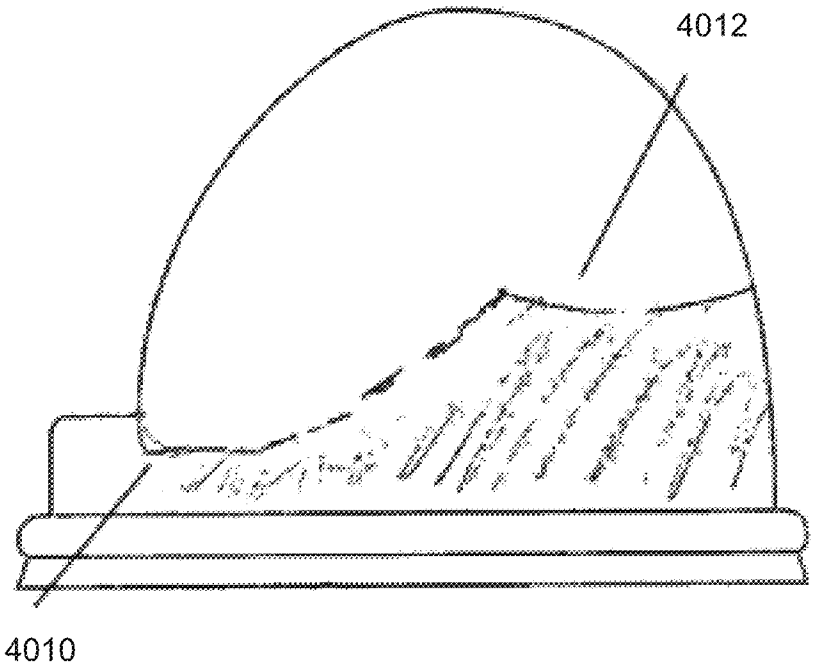

FIGS. 40A-40C show implementations of a domed lid 4001 that includes a raised aroma opening 4002. FIG. 40A show a perspective view of the lid. The raised aroma opening can be raised above a mouth opening 4004 to more easily prevent spillage. Or the raised aroma opening can be lower than the mouth opening to prevent the user's nose from contacting the aroma opening when the user is drinking. As shown in FIG. 40A, a lid 4006 for the raised aroma opening is optional. The aroma opening lid can be used to cover the aroma opening and removed as desired. The lid can easily fit over the opening. The aroma opening lid can be used to keep a beverage inside a cup (not shown) warm by preventing the warmth from escaping through the aroma opening. FIG. 40B shows a cross-sectional view of the lid along an axis 4008. At approximately position 4012, the raised portion of lid 4001 slopes upward (e.g., similar to a volcano) allowing the aroma to escape. And there is less chance of spillage. At approximately position 4010, the lid can optionally dip downwards, allowing a user to more easily drink a beverage through the lid. FIG. 40C shows another implementation of a lid 4011 that includes a raised aroma opening 4012 and lid 4016 for the aroma opening. The lid of the aroma opening can be lifted away from the opening and pressed up toward the dome to be secured to the dome.

Figure 41:
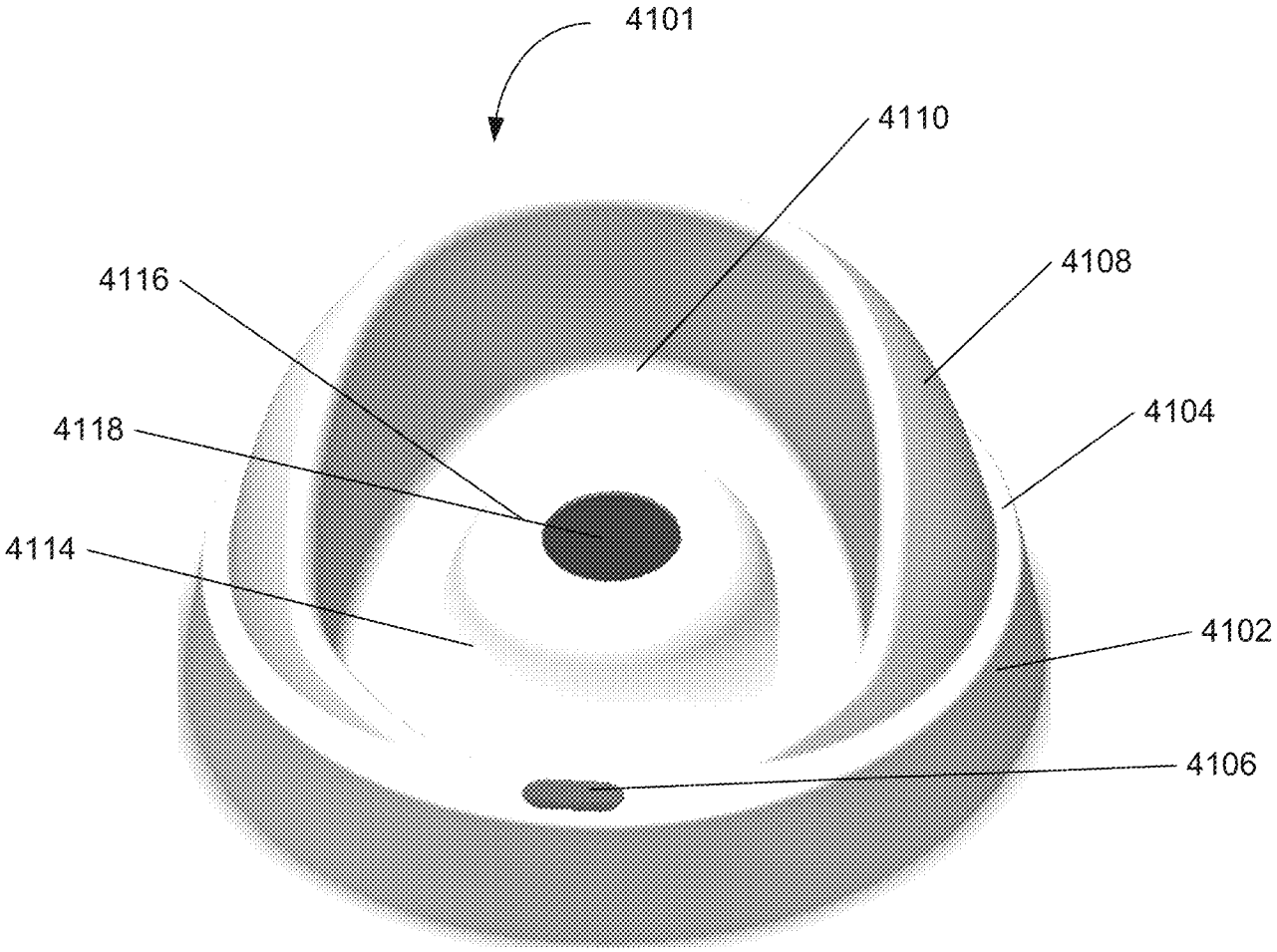
FIG. 41 shows an implementation of a lid with a raised aroma opening.

FIG. 41 shows an implementation of a lid 4101. The lid includes a rim portion, an aroma dome, and a raised aroma opening. The rim portion includes an annular sidewall 4102 and a horizontal perimeter wall 4104. A mouth opening 4106 is formed in the horizontal perimeter wall. The aroma dome includes a curved sidewall 4108 that curves as the sidewall increases in height, thereby forming a dome shape. The aroma dome is coupled to and enclosed by the rim portion. The curved sidewall generally decreases in height from a position 4110 that is diametrically opposed to the mouth opening to the mouth opening. In an intermediate position between the mouth opening and the curved sidewall at position 4110, a protrusion 4114 is formed. At an apical region 4116 of the protrusion, an aroma opening 4118 is formed. The aroma opening can have an area that is smaller than or as large as a cross-sectional area of the protrusion.

Figure 42A:
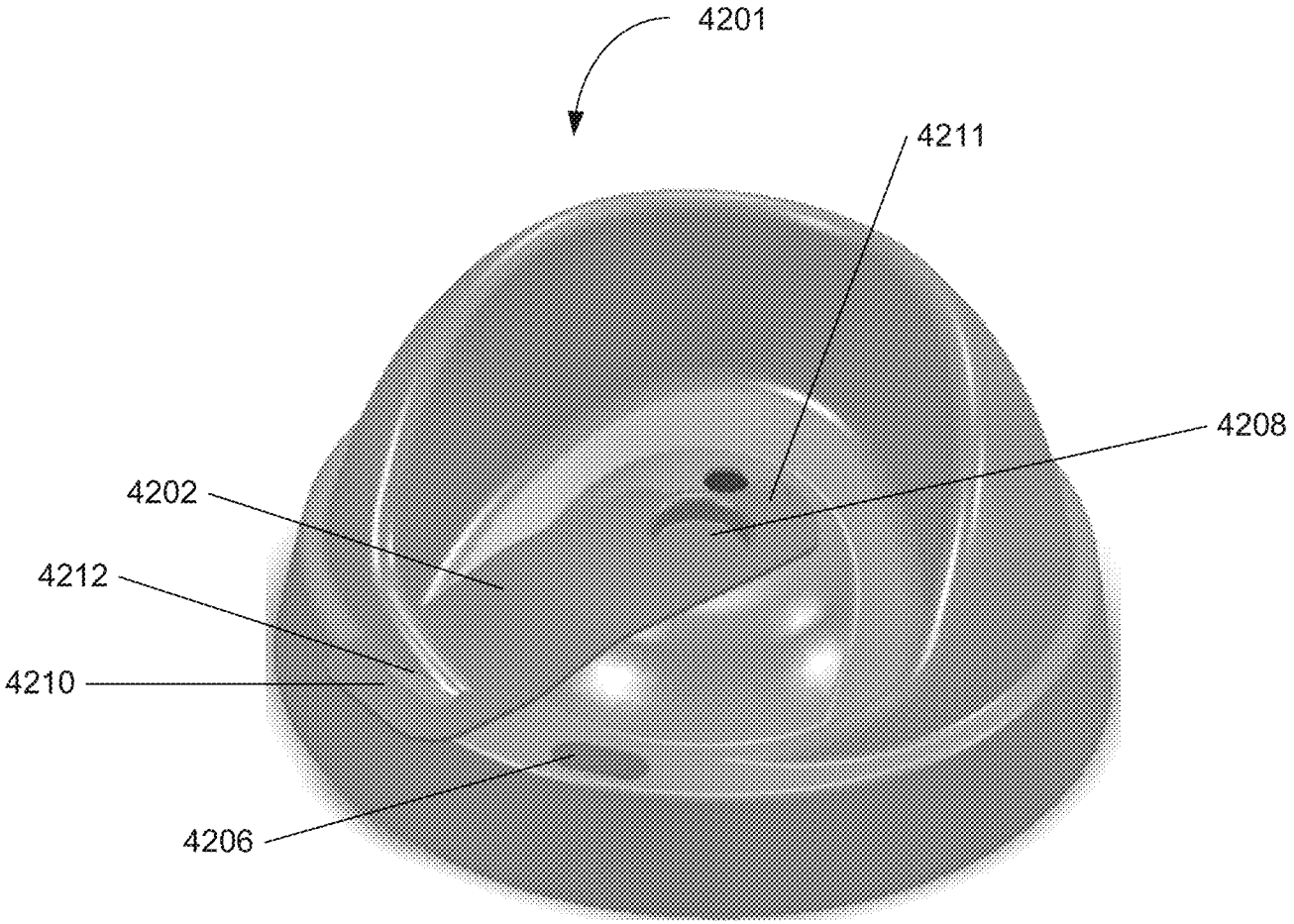
FIGS. 42A-42C show an implementation of a lid with a cover piece.
Figure 42B:
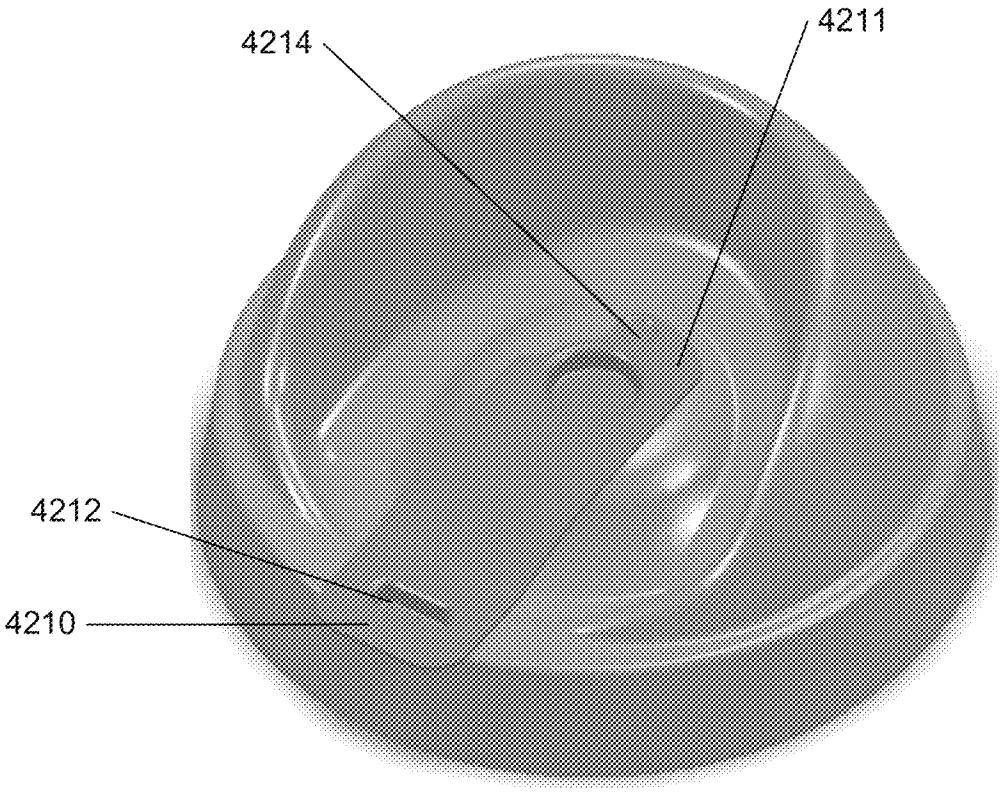
Figure 42C:
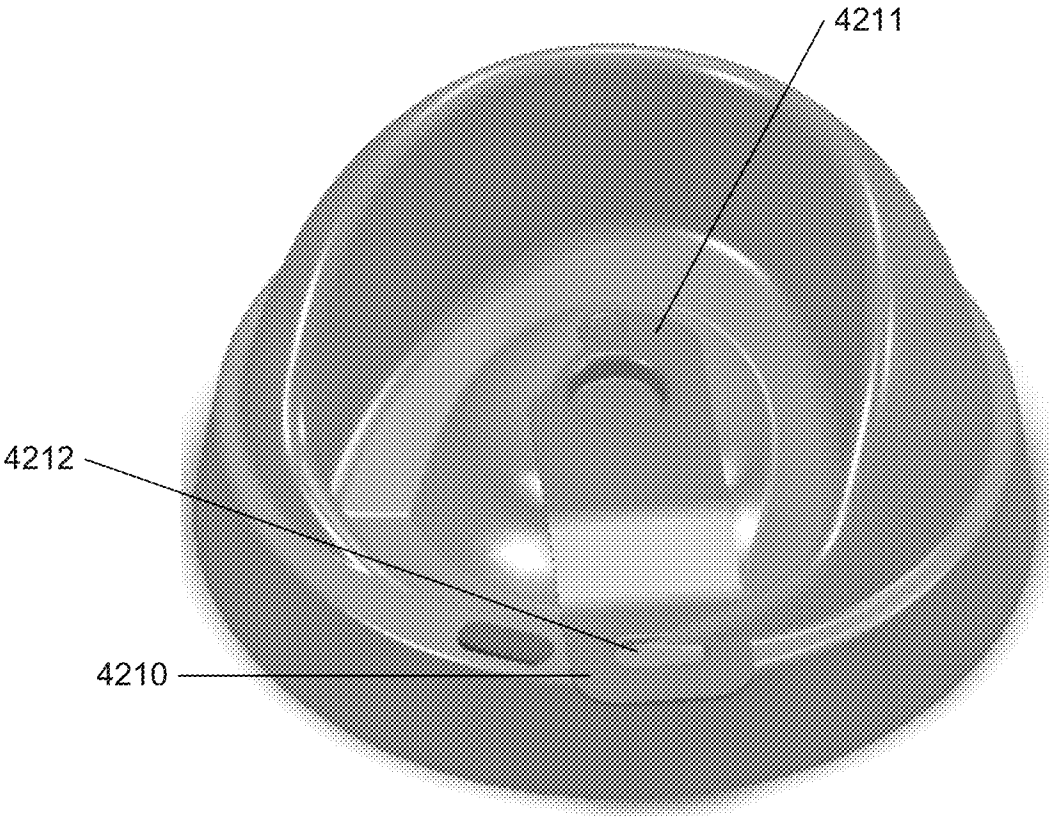

FIGS. 42A-42C show an implementation of a lid 4201 that includes a cover piece 4202 that covers an aroma opening (not shown), or a mouth opening 4206, or both. In FIG. 42A, the cover piece is coupled to the lid through a fastening member 4208, such as a snap. Alternatively, member 4208 can be a clasp, a latch, a hinge, a hook, or other means of attachment. The cover piece is substantially rectangular and can be rotated around a pivot point (e.g., the fastening member) to open or close the aroma opening. The cover piece includes a first end 4210, a second end 4211 opposite the first end, and a mouth aperture 4212 formed in the first end. In a first rotational position of the cover piece (shown in FIG. 42A), the second end is positioned away from the aroma opening and the aroma opening is opened. And the first end does not cover the mouth opening, leaving the mouth opening opened. In a second rotational position (shown in FIG. 42B), the second end is instead positioned over the aroma opening and the aroma opening is closed. The mouth aperture is positioned over the mouth opening, leaving the mouth opening opened. In a third rotational position (shown in FIG. 42C), the second end is positioned over the aroma opening and the aroma opening is closed. The first end does not cover the mouth opening, leaving the mouth opening opened.

Figure 43A:
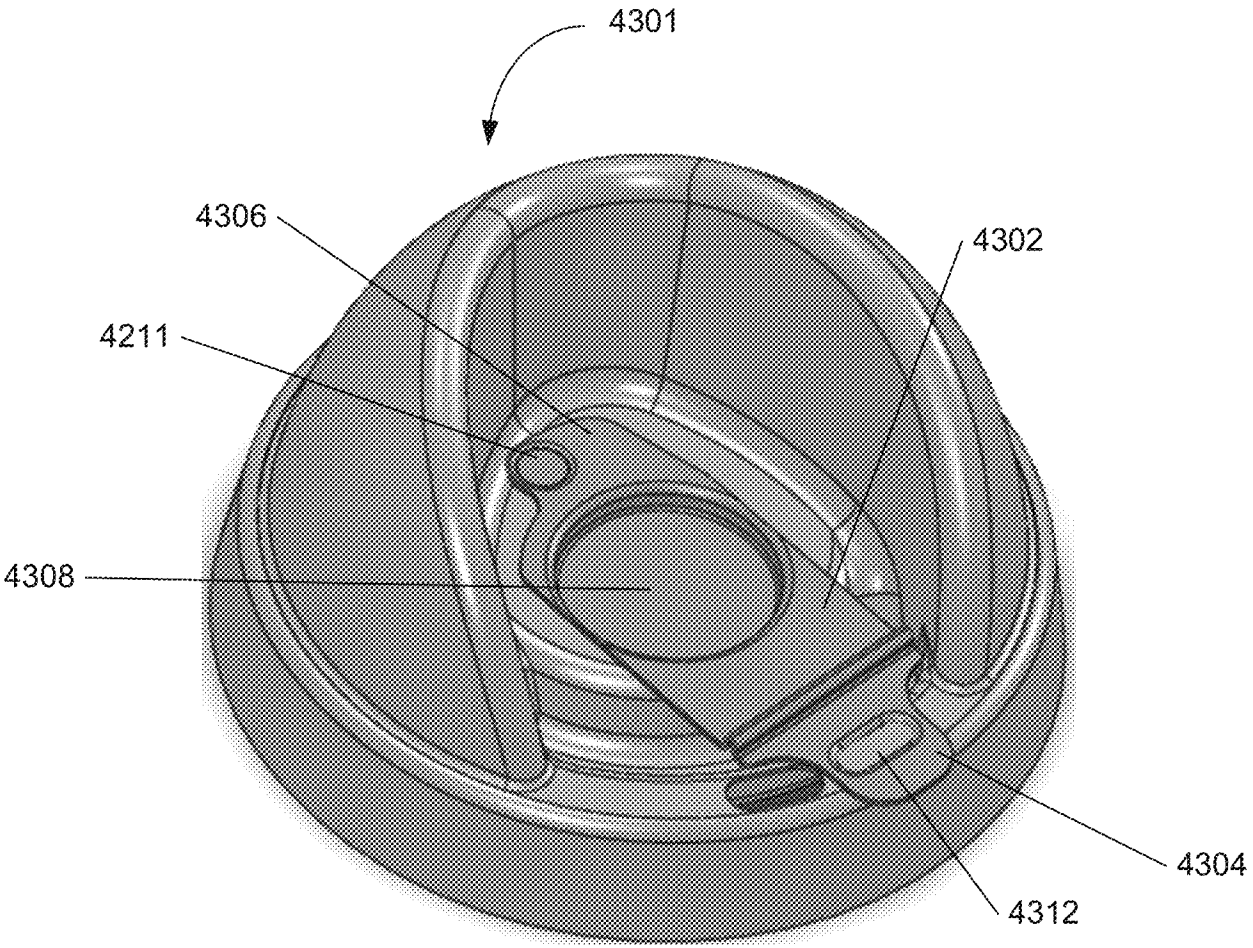
FIGS. 43A-43C show another implementation of a lid with a cover piece.
Figure 43C:
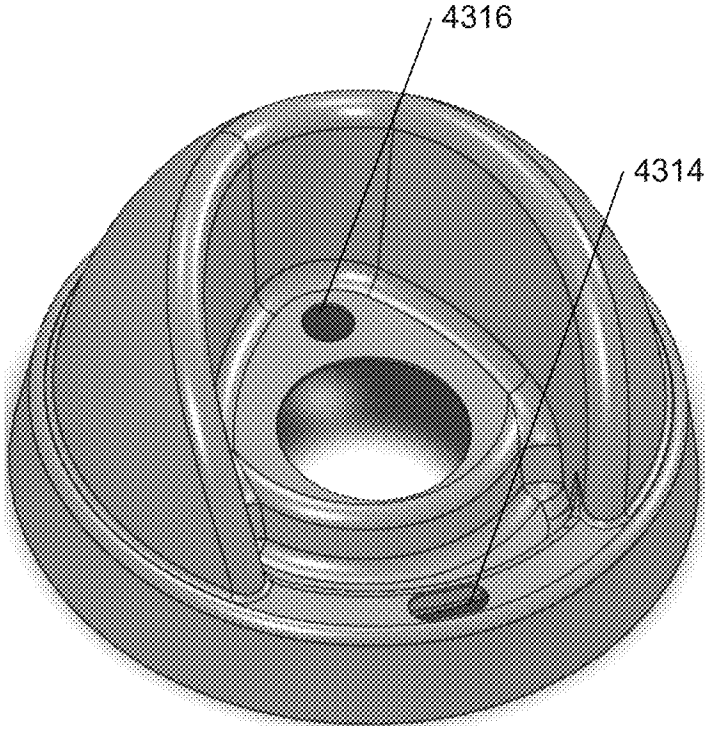
Figure 43B:
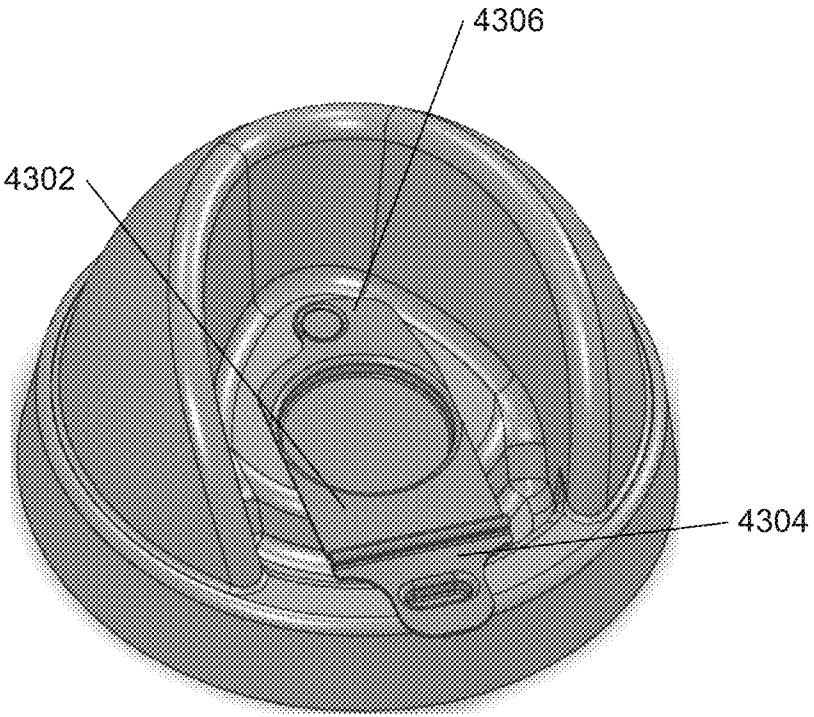

FIGS. 43A-43C show another implementation of a lid 4301 that includes a cover piece 4302. A fastening member 4308 is larger than fastening member 4208. Further, unlike the substantially rectangular cover piece 4202, cover piece 4302 have more tapered first 4304 and second 4306 ends. The first end includes an aroma 4312 aperture. FIG. 43A shows the cover piece in a first rotational position where the aroma opening is closed by the cover piece and a mouth opening 4314 is left open because the cover piece is rotated away from the mouth opening. FIG. 43B shows the cover piece in a second rotational position where the aroma opening is closed by the second end of the cover piece and the mouth opening is left open by the first end of the cover piece. FIG. 43C show a perspective view of the lid without the cover piece, thereby showing aroma opening 4316 and mouth opening 4314. Further, in this implementation, a size of the aroma opening is smaller than a size of a mouth opening.

Figure 44B:
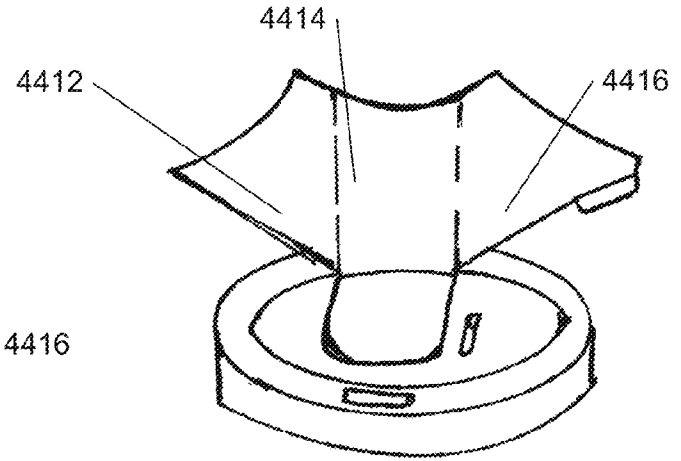
FIGS. 44A-44F show an implementation of a lid that includes a collapsible aroma channel that can be collapsed through folding.
Figure 44C:
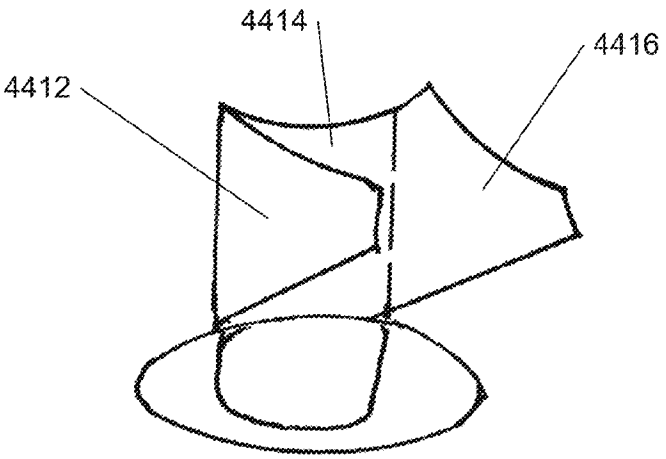
Figure 44A:
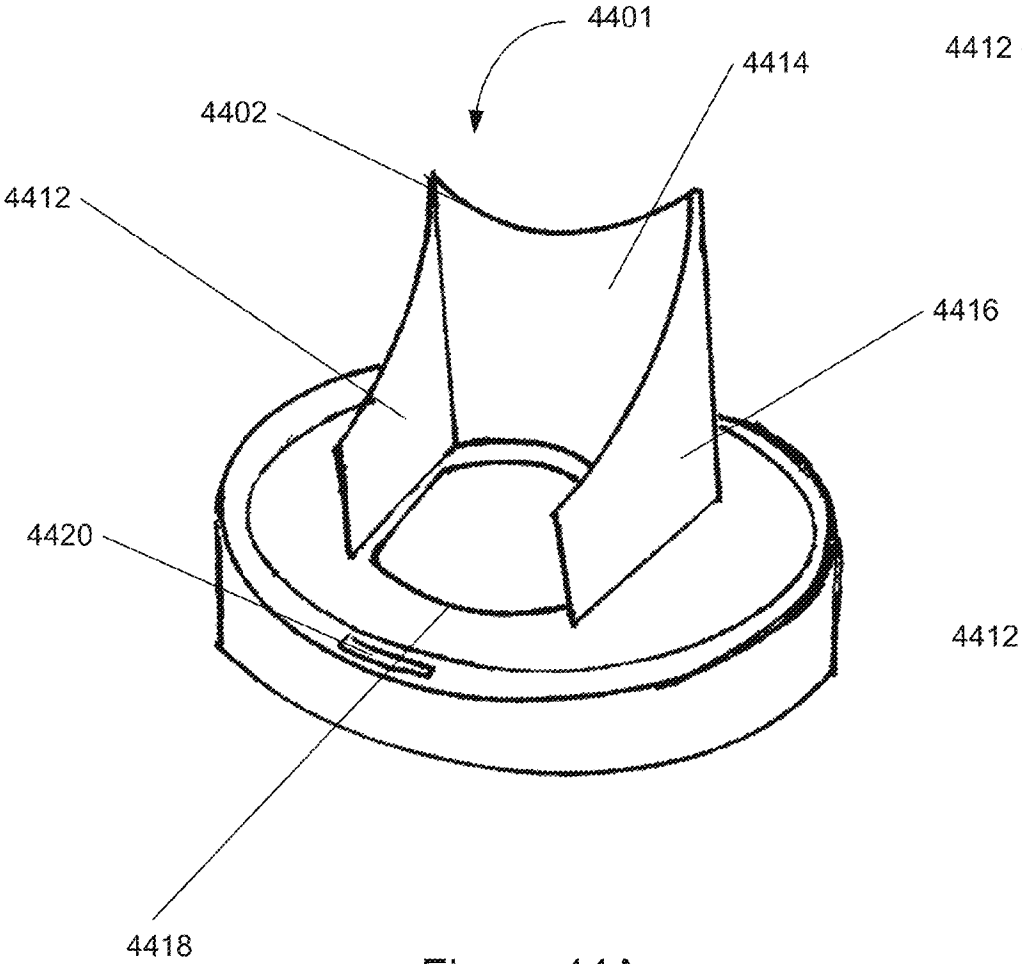
Figure 44D:
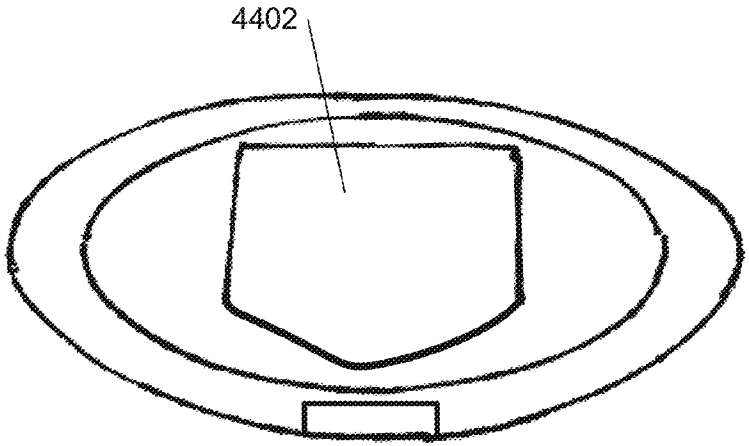
Figure 44E:
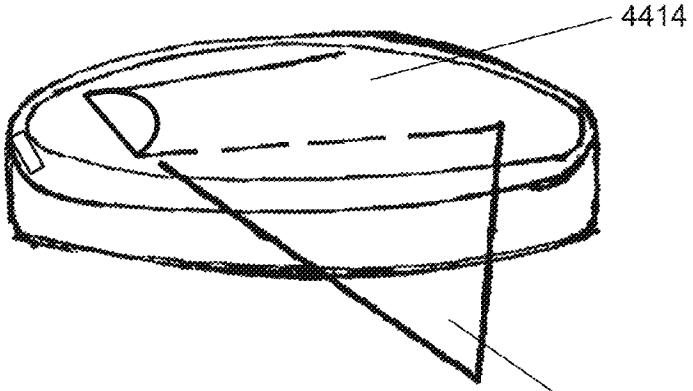
Figure 44F:
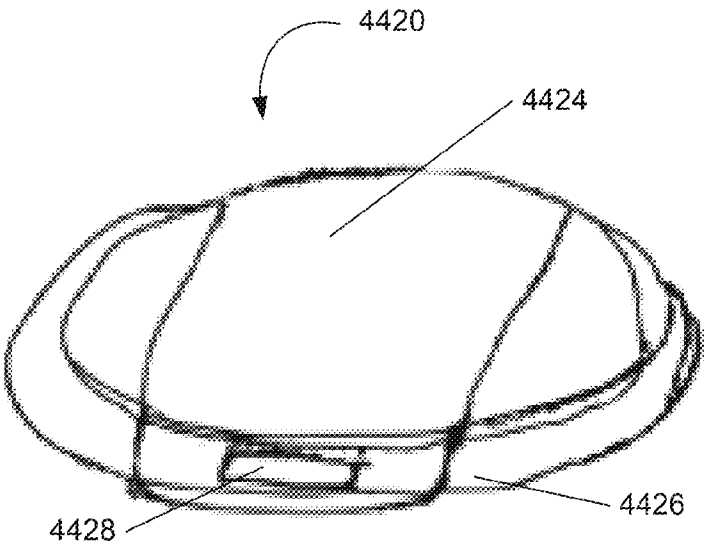

FIGS. 44A-44F show an implementation of a lid 4401 that includes a collapsible aroma channel 4402. The aroma channel can be collapsed and closed by folding the aroma channel. Similar to lid 3801, the aroma channel comprises sidewalls 4412, 4414, and 4416 that surround a portion of an aroma opening 4418. The sidewalls do not surround a portion of the aroma opening that is closest to a mouth opening 4420. In lid 4401, the aroma channel can be held open when sidewalls 4412 and 4416 support sidewall 4414 into an upright position. For example, the lid can have attachments that help sidewalls 4412, 4416 maintain their supporting positions. An example of sidewalls 4412 and 4416 in supporting positions is shown in FIG. 44A. In another example, sidewalls 4412 and 4416 can maintain their supporting positions when an edge of the sidewalls contacts a rim of the lid and is stopped from moving from that position. FIG. 44B shows a configuration of the aroma channel when sidewalls 4412, 4414, and 4416 are unfolded and spread. FIG. 44C shows a configuration of the aroma channel when one side of the aroma channel is folded. The configuration of FIG. 44C is seen when the user unfolds the aroma channel in preparation of flattening the aroma channel. In this implementation, sidewall 4412 is folded under sidewall 4414. FIG. 44D shows a folded configuration of the aroma channel collapsed into the lid, thereby closing the aroma opening. FIG. 44E shows an implementation of the lid where the aroma channel can be collapsed without folding sidewalls 4412 and 4416. A user can push the aroma channel downwards to close the aroma opening. And sidewalls 4412 and 4416, unfolded, fall to the side, as shown in FIG. 44E. FIG. 44F shows another specific implementation of a lid 4420 with collapsible aroma channel. Compared to lid 4401, sidewall 4424 is longer than sidewall 4414 and extends to a peripheral edge 4426 of the lid. Sidewall 4414 can cover and close a mouth opening (not shown) or sidewall 4414 can include an opening 4428 such that when sidewall 4424 is positioned over the mouth opening, the mouth opening is left open.

Figure 45B:
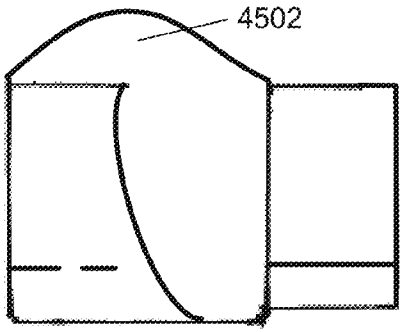
FIGS. 45A-45C show another implementation of a lid with a collapsible aroma channel.
Figure 45C:
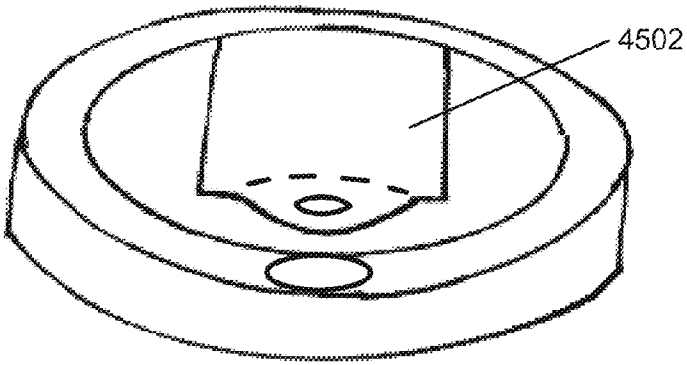
Figure 45A:
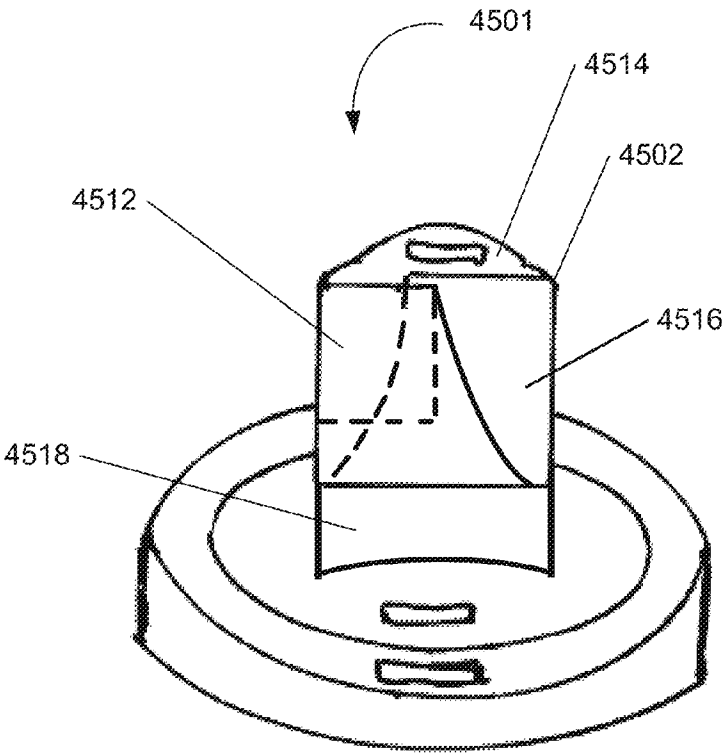
Figure 46A:
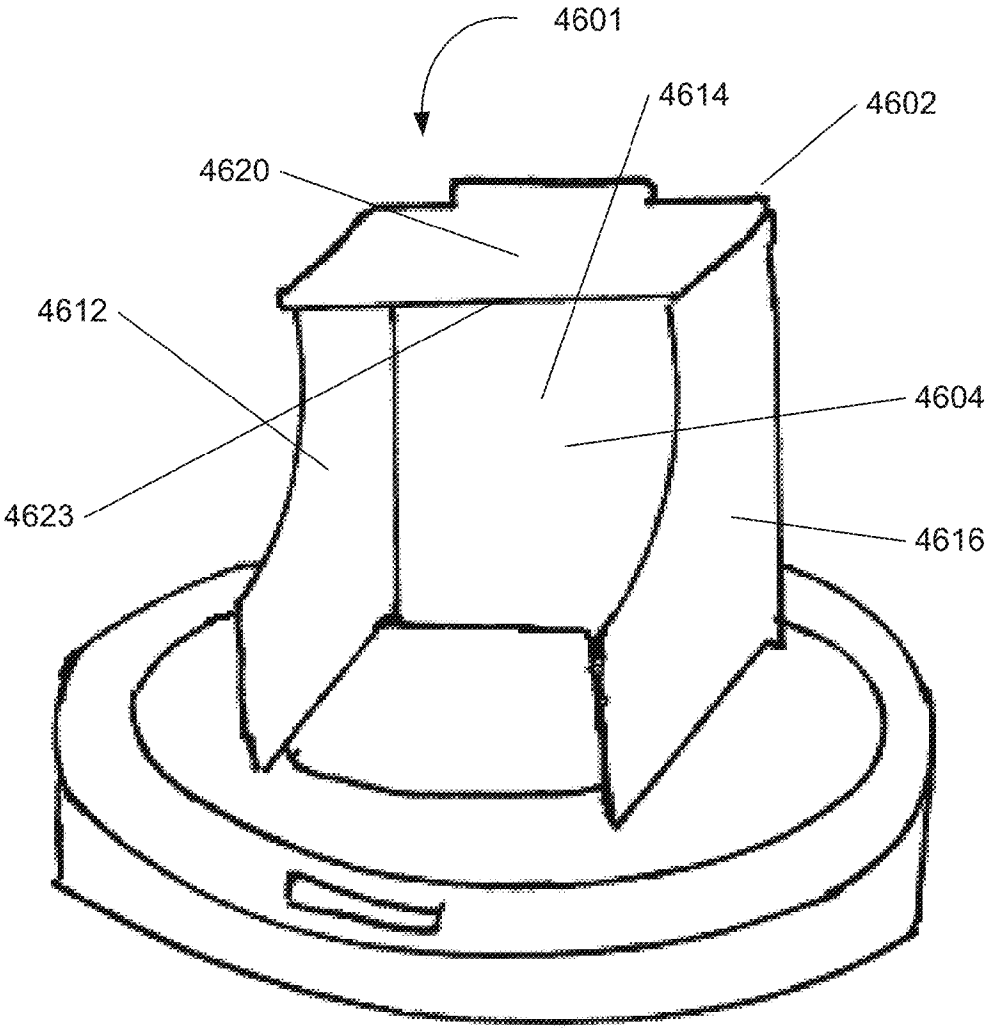
FIGS. 46A-46B show another specific implementation of a lid with a collapsible aroma channel.
Figure 46B:
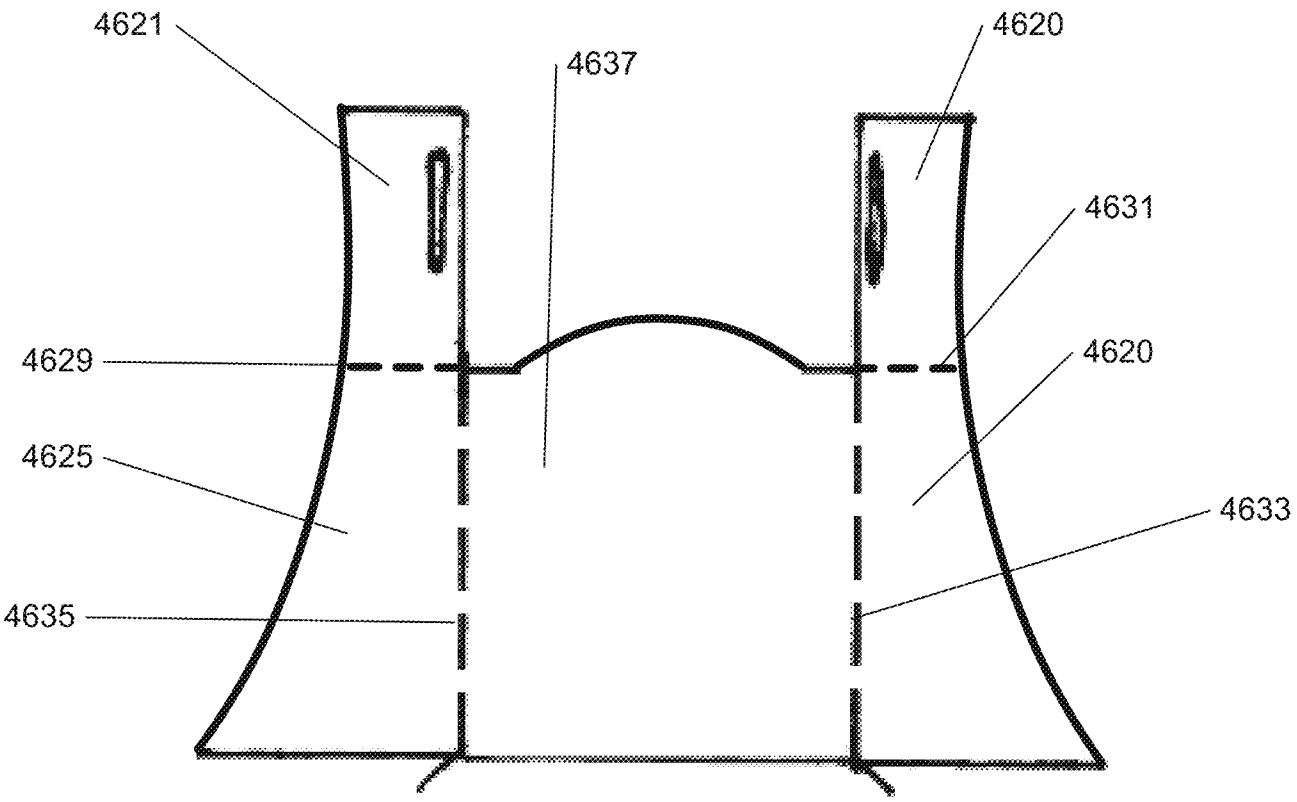

FIGS. 45A-45C shows another specific implementation of a lid 4501 with a collapsible aroma channel 4502. Similar to lid 4401, lid 4501 includes an aroma channel that has sidewalls 4512, 4514, and 4516 that can be folded and collapsed over an aroma opening 4518. FIG. 45B shows the aroma channel that is not in a collapsed state and the aroma opening is open. Aroma opening can be opened to allow steam to escape. FIG. 45C shows the lid with the aroma channel in a collapsed state and the aroma opening is closed. FIGS. 46A-46B show another specific implementation of a lid 4601 with a collapsible aroma channel 4602. Similar to lid 4401, lid 4601 includes an aroma channel 4604 that has sidewalls 4612, 4614, and 4616 that can be folded and collapsed over an aroma opening 4604. In addition, sidewalls 4612 and 4616 are coupled to sidewalls 4614 and 4620. Sidewalls 4620 and 4621 can be folded over each other. When sidewalls 4620 and 4621 are folded over each other and the aroma opening is open, the sidewalls create a roof 4623 that retains the aromas and steam rising through the aroma opening. FIG. 46B shows the aroma channel in an unfolded state. Portions 4620, 4621, 4625, and 4627 can bend or fold along fold lines 4629, 4631, 4633, and 4635. When the aroma channel is open, portions 4620 and 4621 form the roof. Portions 4625 and 4620 are the sidewalls 4612 and 4614, respectively. Portion 4637 is the back wall. Portions 4620 and 4621 include holes so that portions 4620 and 4621 can be stitched into the back wall to create the roof.

Figure 47A:
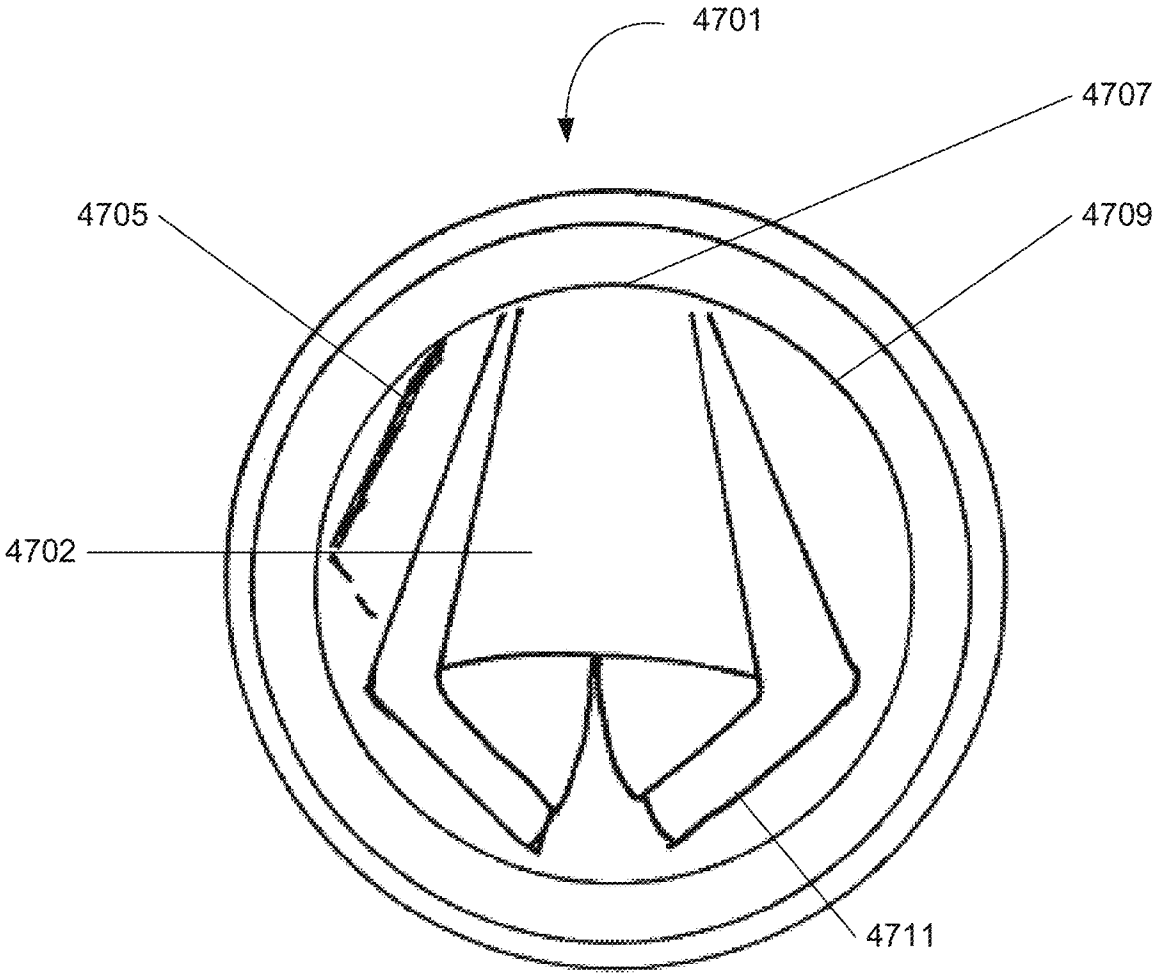
FIGS. 47A-47C show another specific implementation of a lid with a collapsible aroma channel.
Figure 47C:
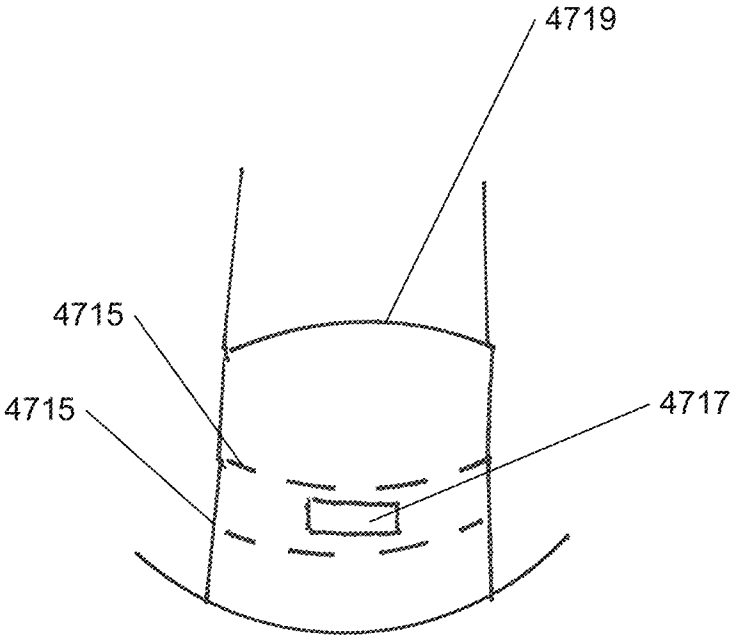
Figure 47B:
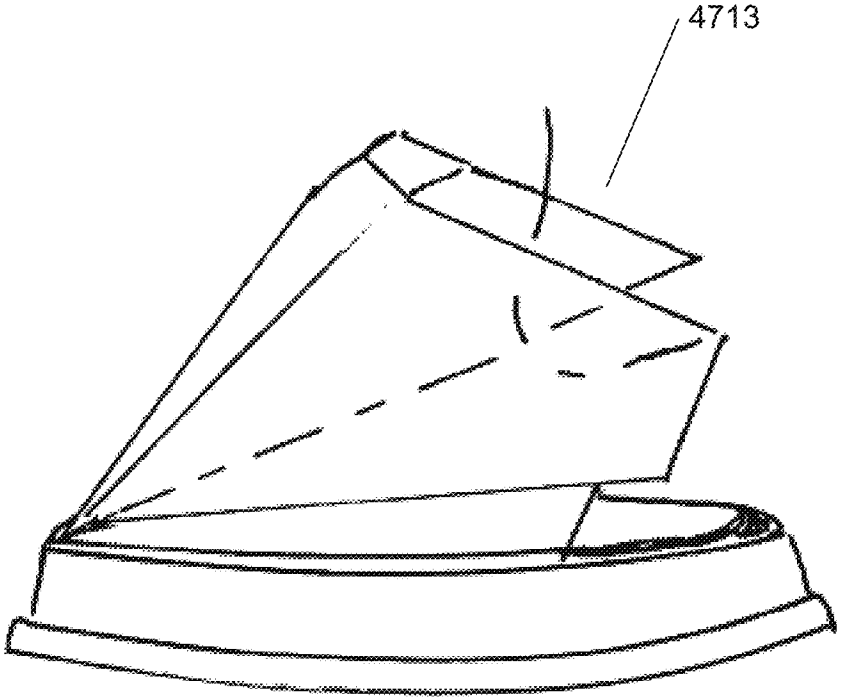

FIGS. 47A-47C show another implementation of a lid 4701 with a collapsible aroma channel 4702 coupled to the lid. The aroma channel includes several fold lines. FIG. 47A shows a top view of the lid when the aroma channel is folded, pressed down flat, and in a collapsed state. In another implementation, section 4705 of the aroma channel can be straight, instead of curved. Further, sections 4707 and 4709 of the aroma channel can be coupled to the lid. Other sections of the aroma channel can be coupled to the lid, as well. FIG. 47B shows a perspective view of the lid when the aroma channel has been pulled up from its collapsed state. When the aroma channel has been pulled up, the aroma channel unfolds. The aroma channel can have a dome shape or tent shape. A portion 4711 of the aroma channel can be coupled to the lid or be weighted so that the portion off aroma channel will not lift up and be folded when the user desires the aroma channel to be in an unfolded state. A user's nose can be placed at position 4713. FIG. 47C shows that a portion of the aroma channel can be longer to more easily close the lid. Broken lines 4715 indicate a ring around the lid where a mouth opening 4717 is. The mouth opening is higher than the flat middle part (as well as a rim) of the lid. If a very top of the lid 4719 is longer then what it is in FIG. 47A-47C (the longer top is not shown), then the top 4719 covers the both the aroma opening and the mouth opening. Depending on the design, the user may bend or tear the top 4719 off because the longer top may be inconvenient. FIGS. 47A-47C show a specific configuration of folding to collapse the aroma channel. However, the aroma channel can be folded in many different ways. Further, there are many shapes of aroma channels and many configurations of fold lines for each shape of aroma channel.

Figure 48B:
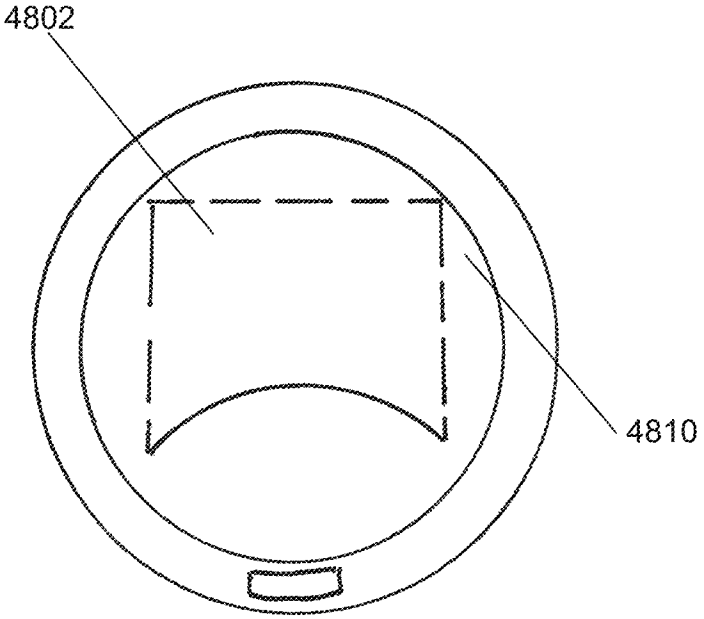
FIGS. 48A-48D show another specific implementation of a lid with a collapsible aroma channel that can be pulled up and down.
Figure 48A:
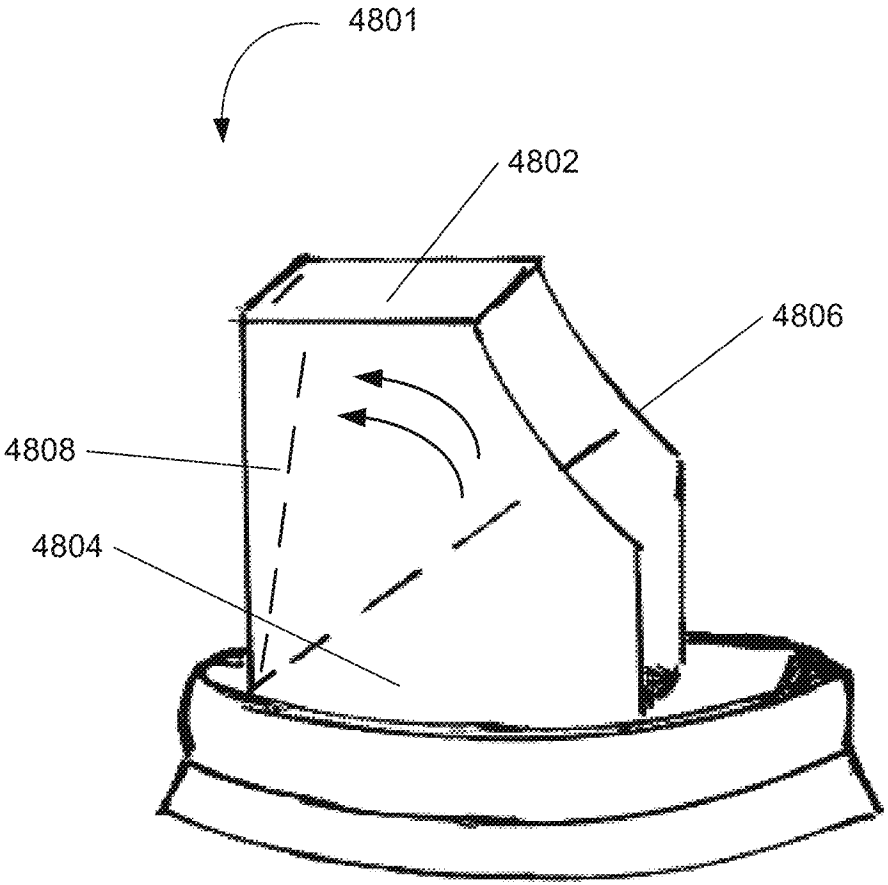
Figure 48D:
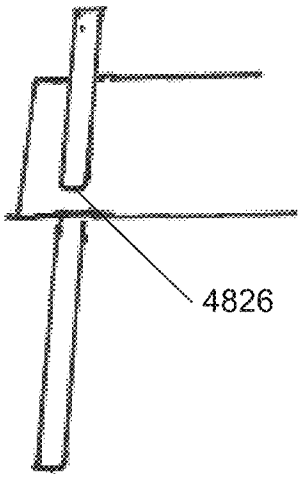
Figure 48C:
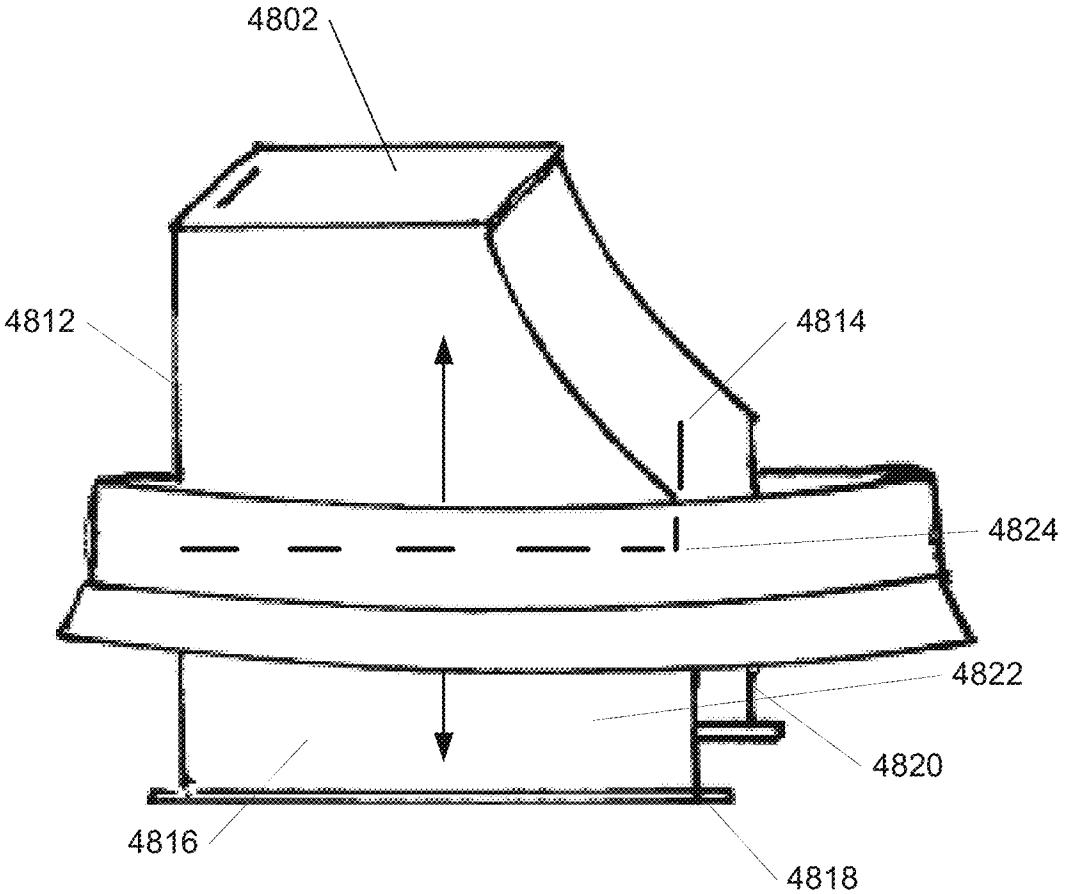

FIGS. 48A-48D show another implementation of a lid 4801 with a collapsible aroma channel 4802 that can be pulled up and down. Unlike the other implementations shown (where the aroma channel can be folded and collapsed), aroma channel 4802 can be pushed down underneath the surface of the lid to close an aroma opening 4804. To open the aroma opening, the aroma channel is pulled up above the lid. Broken line 4806 indicates that when the aroma channel is pulled up half way, a third wall is created. When the aroma channel is pulled upwards into an upright position 4808, the aroma channel is open, which allows steam from the beverage to escape. FIG. 48B shows a top view of the lid. The aroma channel can be pulled up and down. In alternative implementations, the side at position 4810, there can be one or more sides. If there are three sides, there can be an additional part added to stop the side from falling down or else it will be difficult for steam from the beverage to leave. FIG. 48C shows the movement of the aroma channel, up and down. Side 4812 is open in this figure. Sides 4816 and 4820 are below a rim of the lid. Bottom wall 4818 of the aroma channel can be wider than the aroma opening so that the aroma channel will not fall out of the aroma opening. Side 4822 can be folded in or folded up so that the lid is flat and the sides do not touch the beverage. Side 4824 is a closed top that can be a third wall. Element 4826 in FIG. 48D shows a hole on the roof of the aroma channel. The hole helps to put up an optional third wall side.

Figure 49:
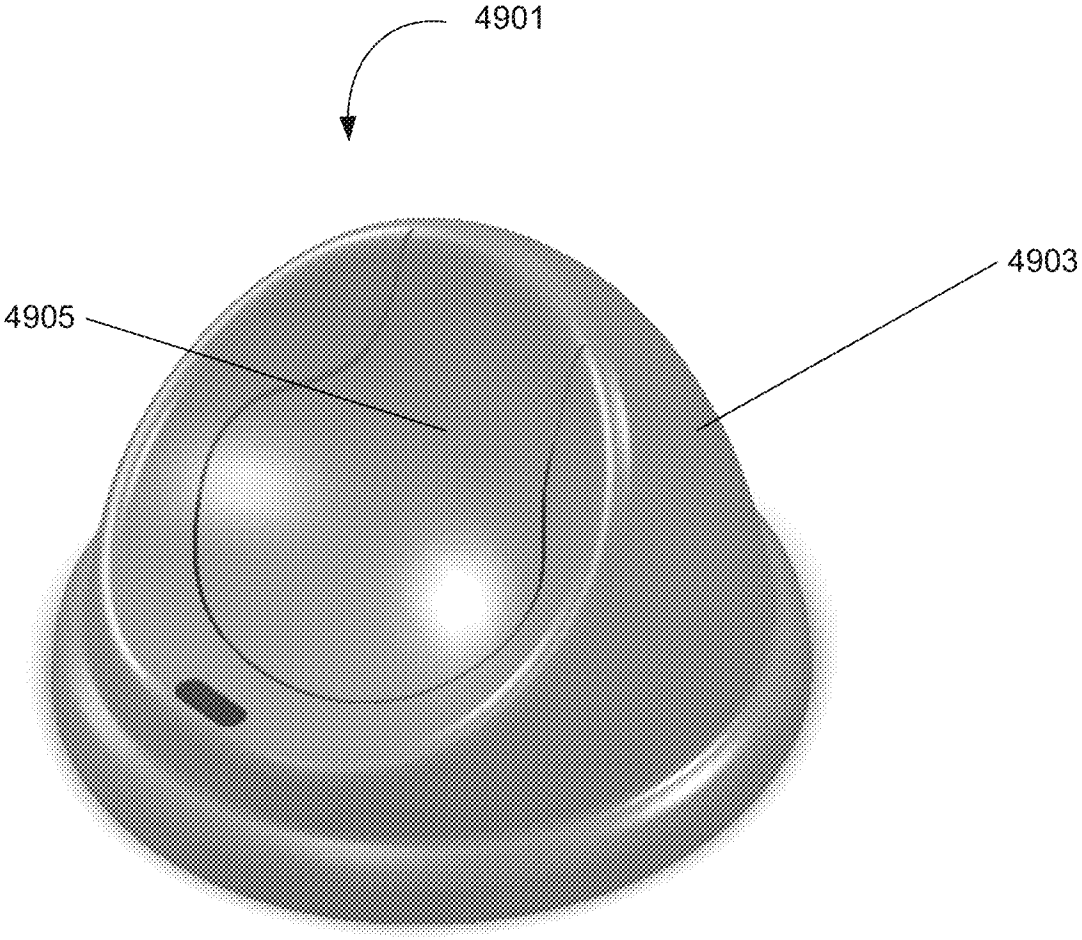
FIG. 49 shows an implementation of a lid.

FIG. 49 shows a perspective view of an implementation of a lid 4901. The lid includes a dome portion 4903, an aroma opening (not shown), and a cover 4905 for the aroma opening. The aroma opening is approximately spherical. The cover is coupled to the dome portion.

Figure 51:
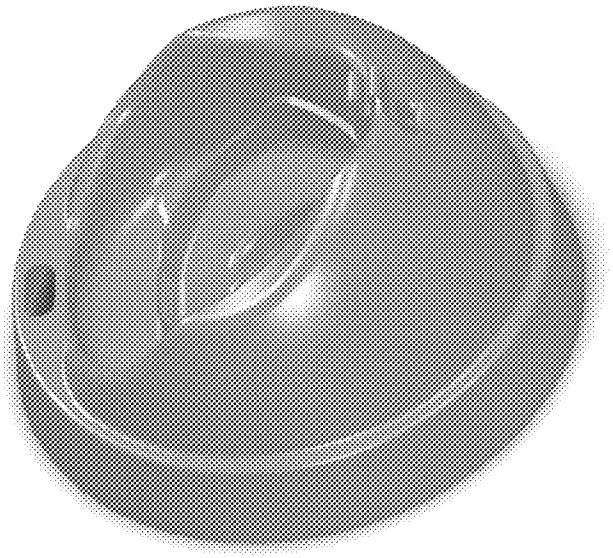
FIGS. 51-52 show another implementation of a lid that includes a cover.
Figure 50:
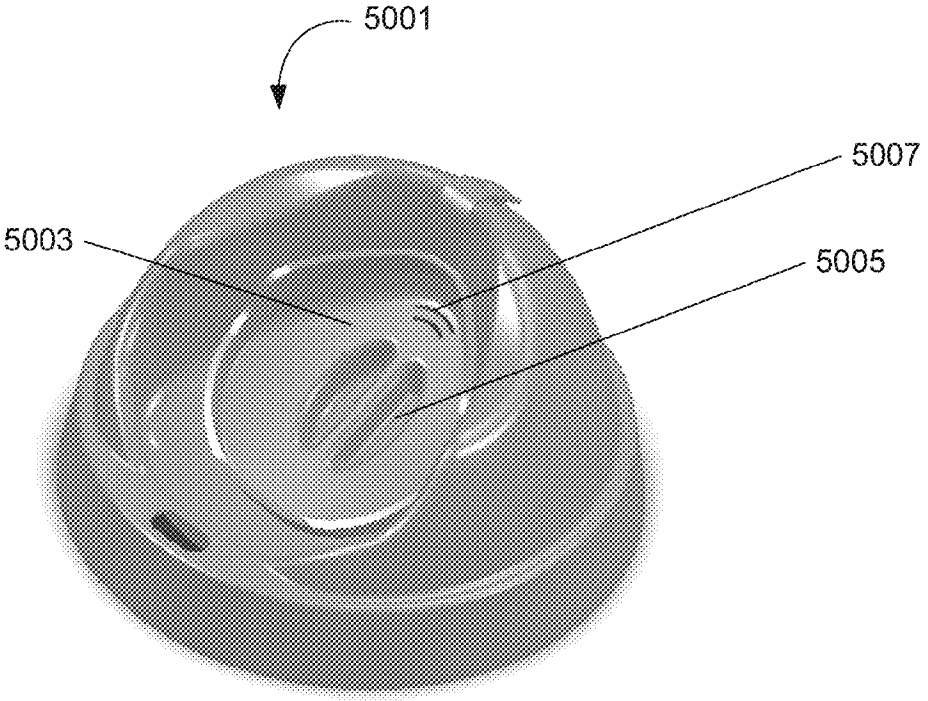
FIG. 50 shows an implementation of a lid that includes a cover.
Figure 52:
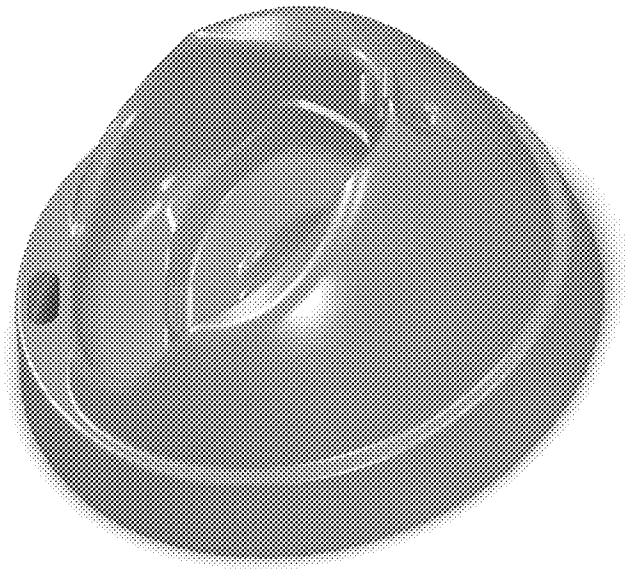

FIG. 50 shows another specific implementation of a beverage lid 5001 that includes a cover 5003 for an aroma opening. The cover includes recesses 5005 that allow a user to easily grasp the lid and lift it off to open the aroma opening. The cover also includes openings 5007 (e.g., slits). FIG. 51 shows an angled view of the beverage lid. FIG. 52 shows another angled view of the beverage lid.

Figure 53:
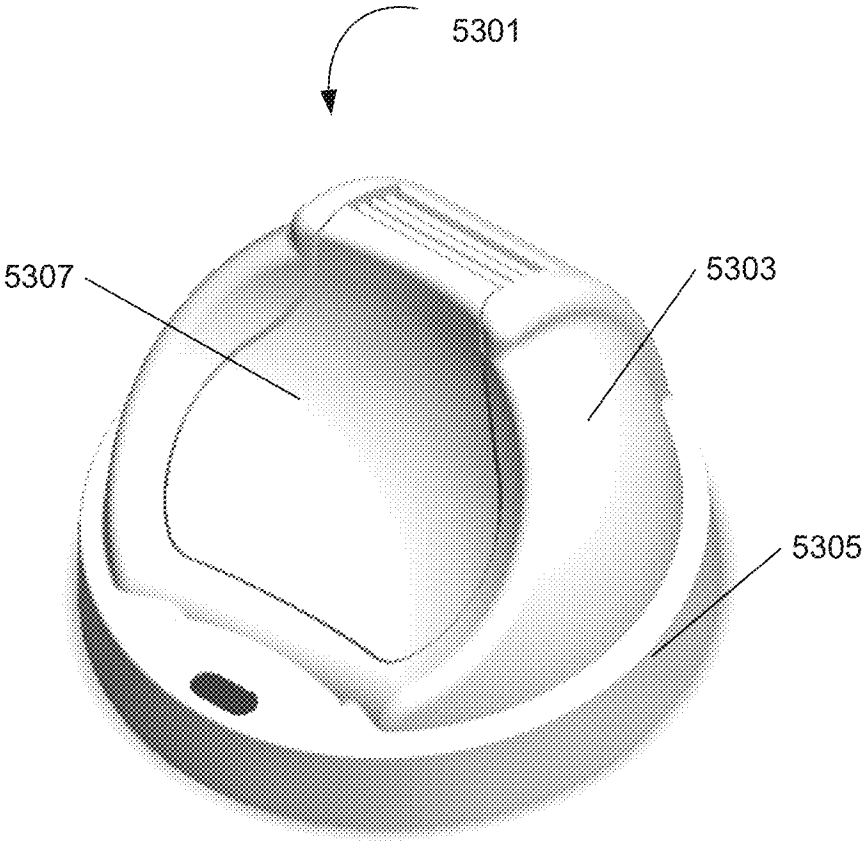
FIGS. 53-54 show another implementation of a lid with a cover.
Figure 54:
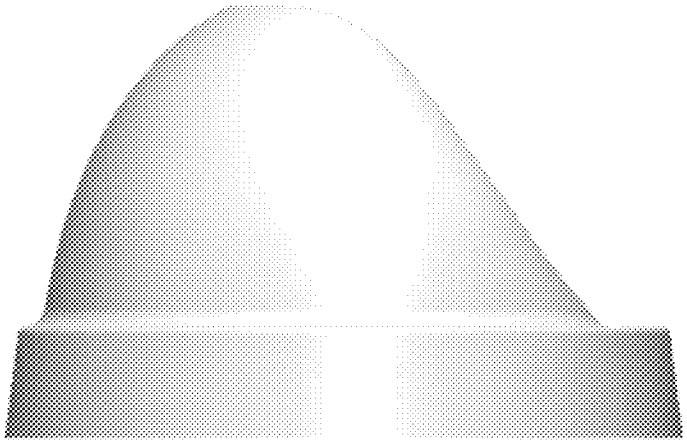

FIG. 53 shows a perspective view of another implementation of a lid 5301. The lid includes a dome portion 5303 mounted on a rim portion 5305. The dome portion includes an aroma opening (not shown) and a cover 5307 for the aroma opening. The cover can be flipped or rotated into a first position that closes the aroma opening. The cover can also be flipped into a second position that opens the aroma opening and the cover can rest against an outer sidewall of the dome portion. FIG. 54 shows a side view of the lid.

Figure 55:
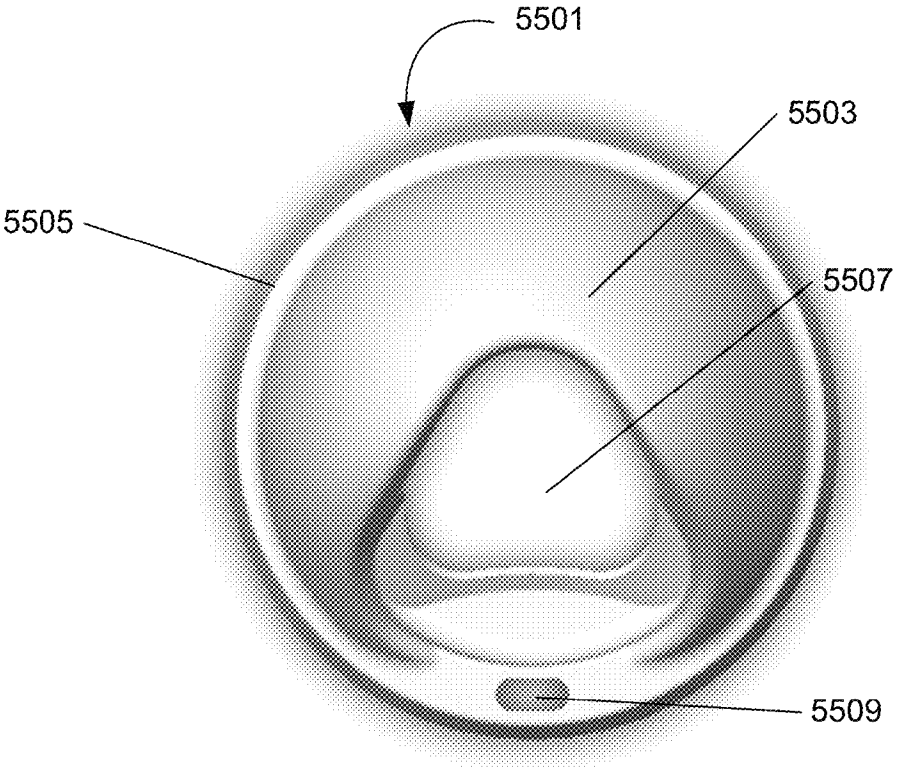
FIGS. 55-57 show another implementation of a lid.
Figure 57:
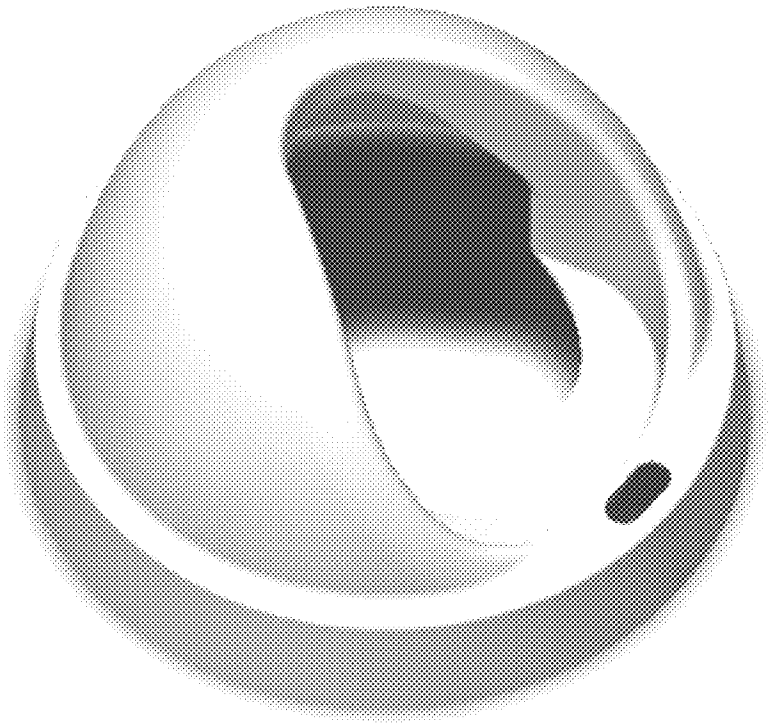
Figure 56:
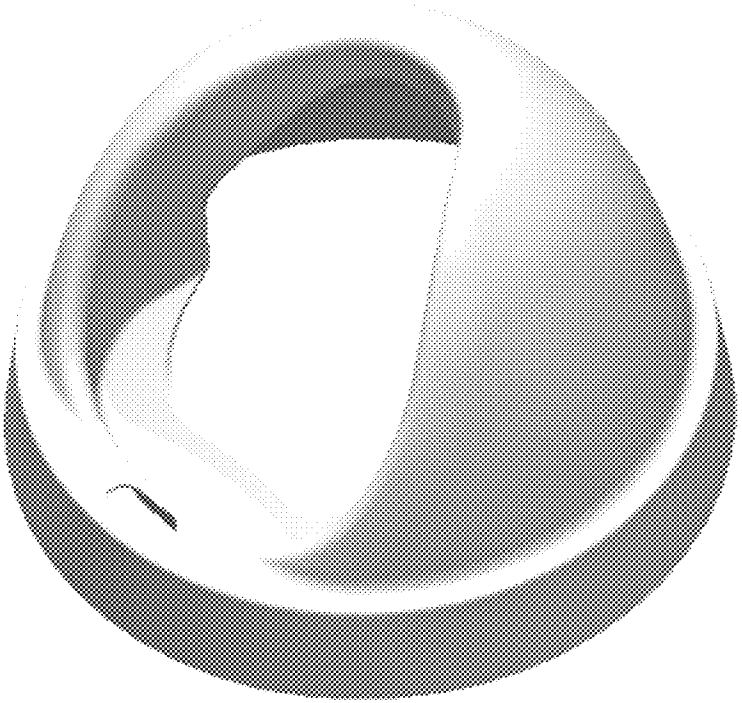

FIG. 55 shows another implementation of a lid 5501. The lid includes a dome portion 5503, a rim portion 5505, an aroma opening 5507, and a mouth opening 5509. FIG. 56 shows a perspective view of the lid from the right side. FIG. 57 shows a perspective view of the lid from the left side.

Figure 58:
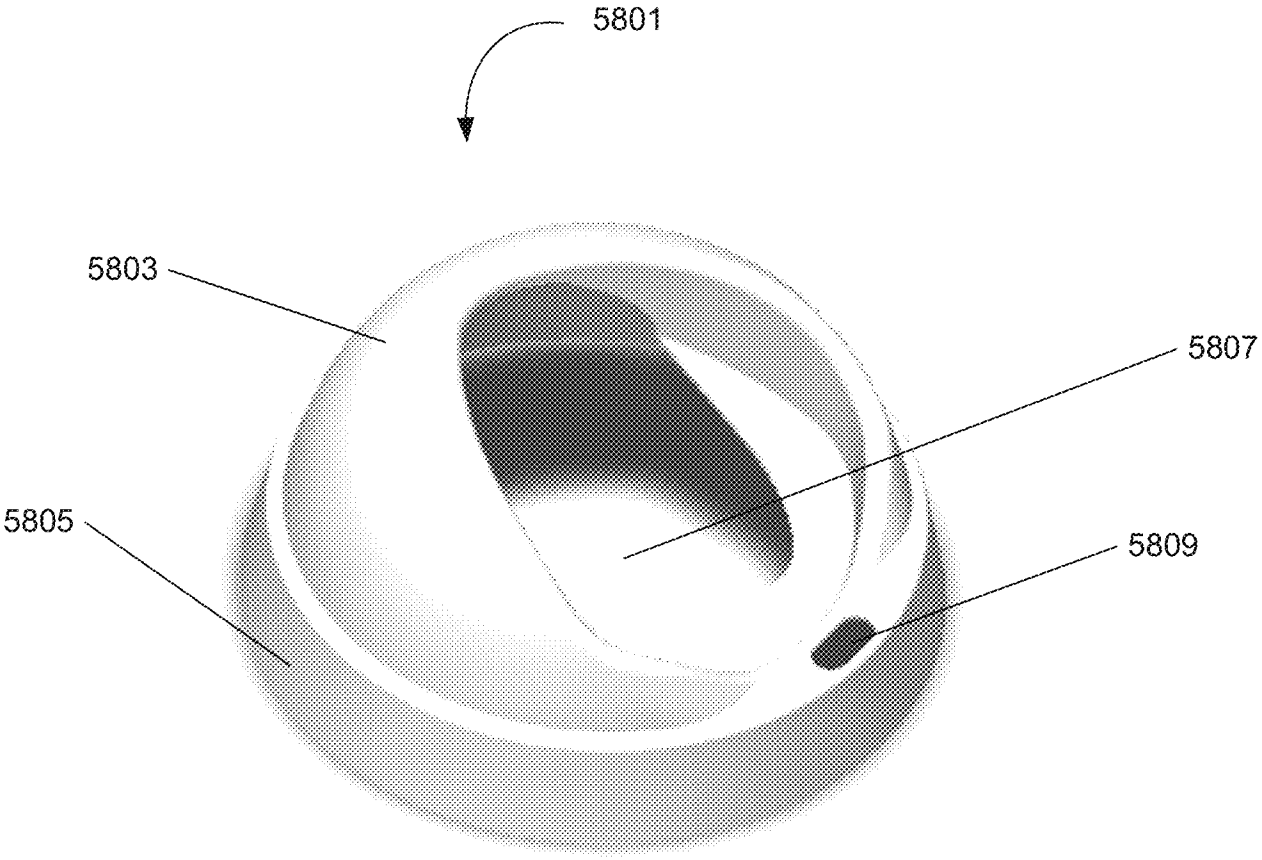
FIGS. 58-60 show an implementation of a domed lid.
Figure 60:
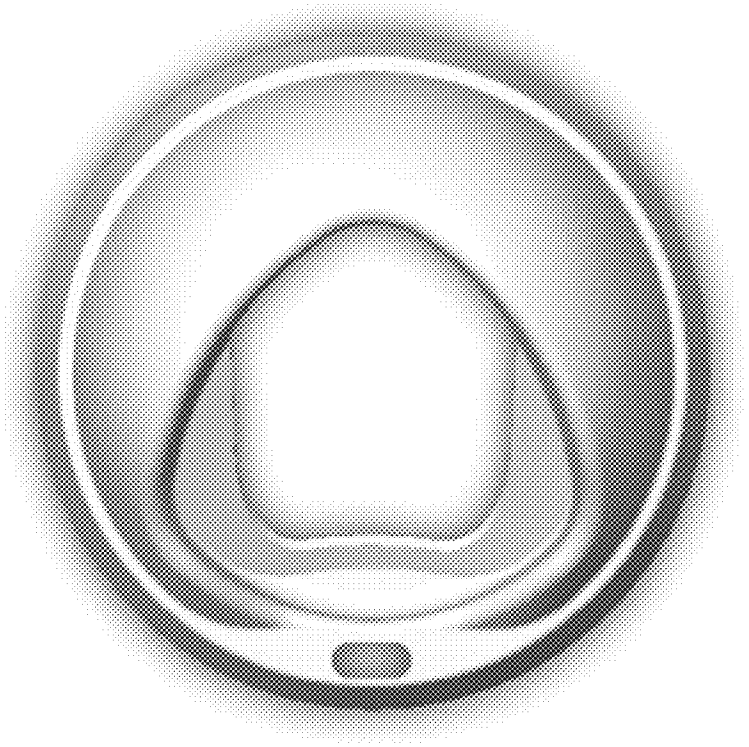
Figure 59:
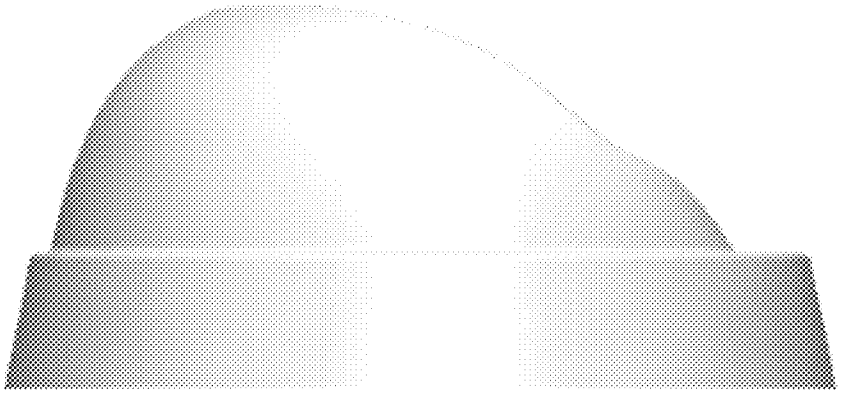

FIG. 58 shows a perspective view of an implementation of a lid 5801. The lid includes a dome portion 5803, a rim portion 5805, an aroma opening 5807, and a mouth opening 5809. Compared to other dome portions previously shown, the dome portion in this figure is lower. Instead of half of a dome, the dome portion in this figure includes approximately the top quarter of a dome. The aroma opening as shown in this figure extends to a portion of an inner sidewall of a dome portion. FIG. 59 shows a side of view of the lid. FIG. 60 shows a top view of the lid.

Figure 62:
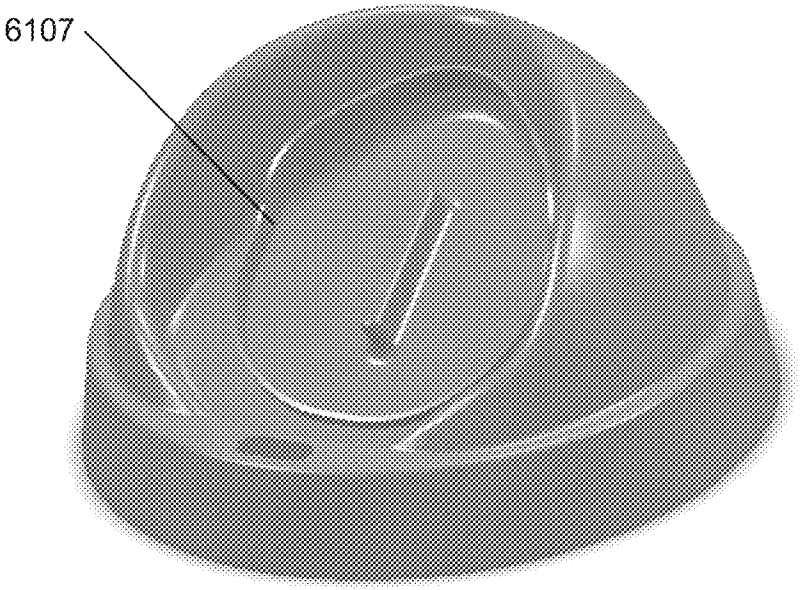
FIGS. 61-62 show an implementation of a lid with a hinged cover.
Figure 61:
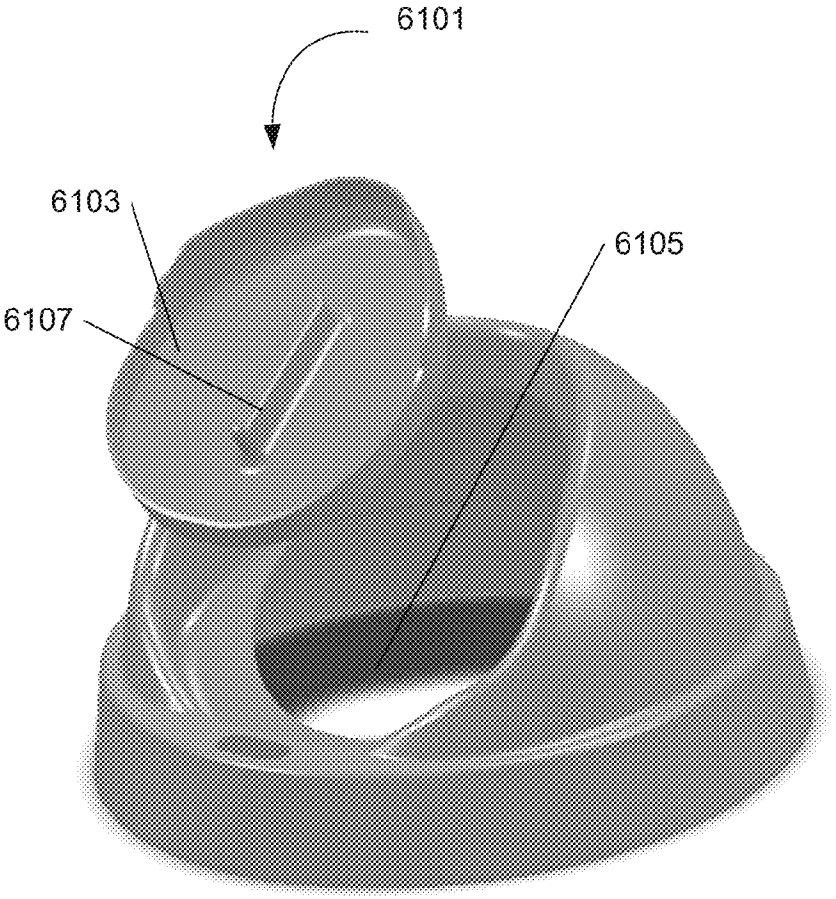

FIGS. 61-62 show an implementation of a container lid 6101 that includes a hinged cover 6103 for an aroma opening 6105. When hinged cover is open and exposing the aroma opening (shown in FIG. 61), the hinged cover is partially attached to an edge of the aroma opening. The cover also includes an elongated protrusion 6107 that allows for easy grasping of the lid. FIG. 62 shows the hinged lid covering the aroma opening.

Figure 63B:
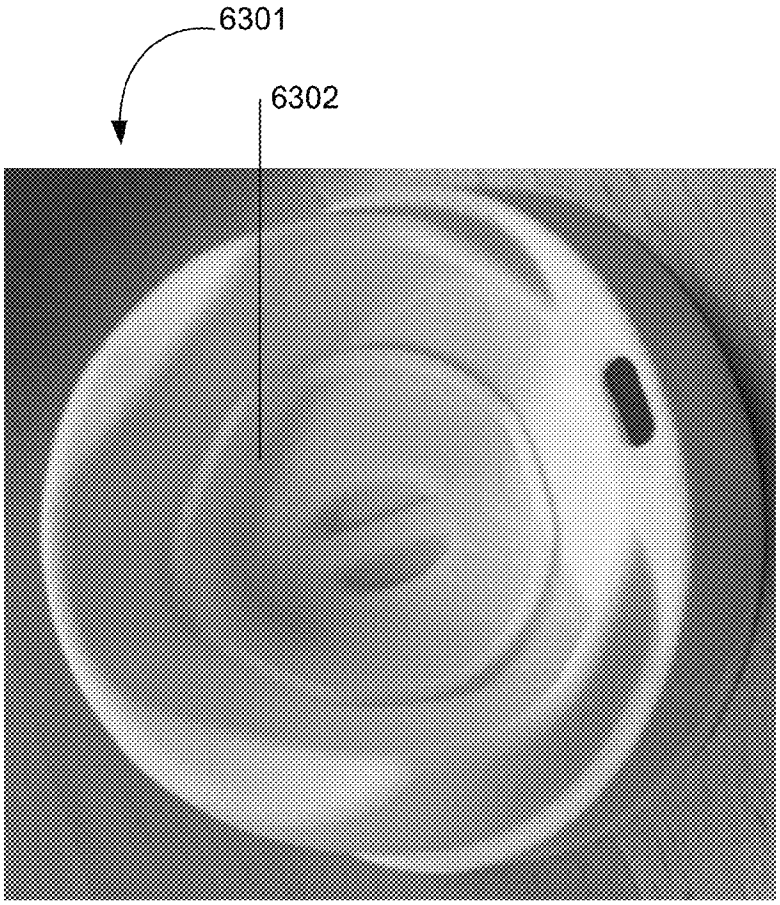
FIGS. 63A-63B show an implementation of a lid.
Figure 63A:
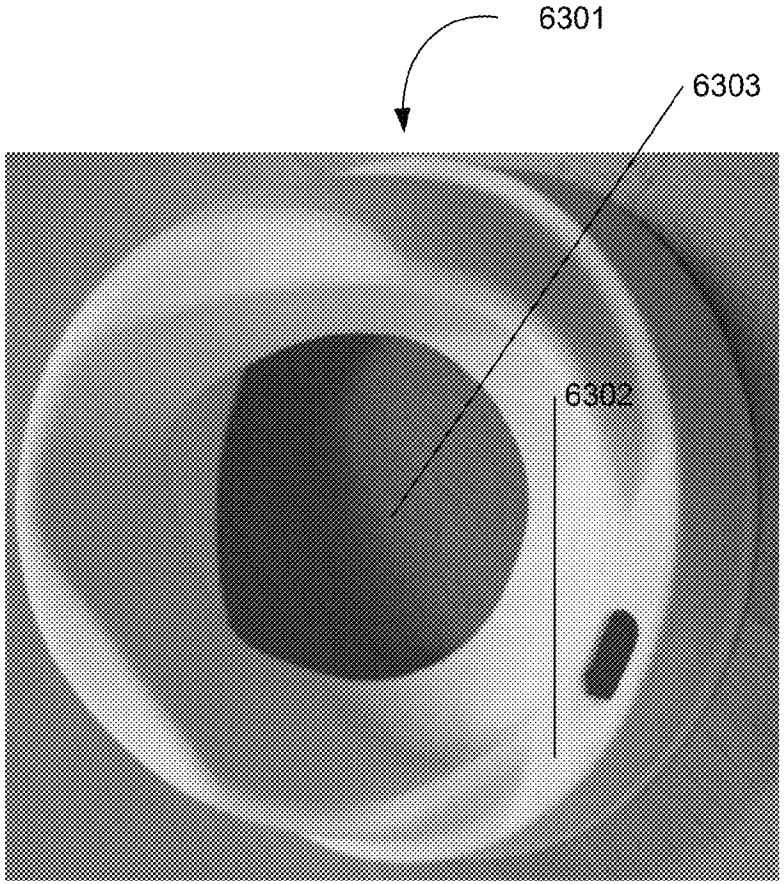
Figure 63D:
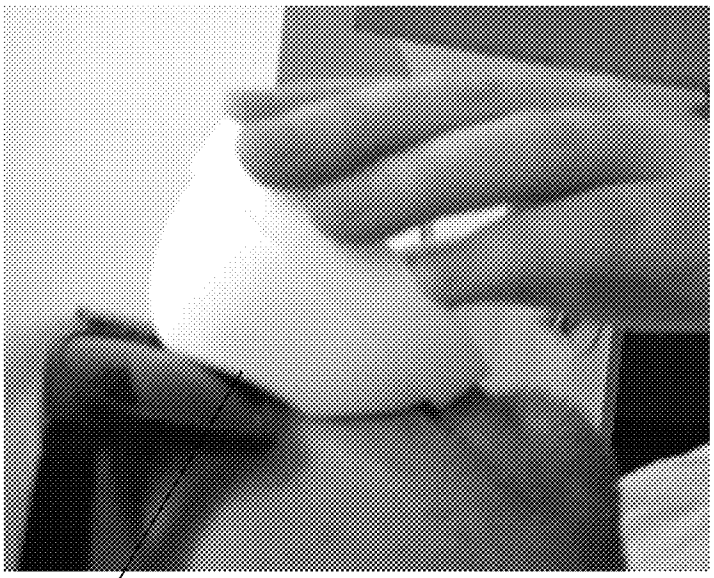
FIG. 63D shows the lid of FIG. 63A.
Figure 63C:
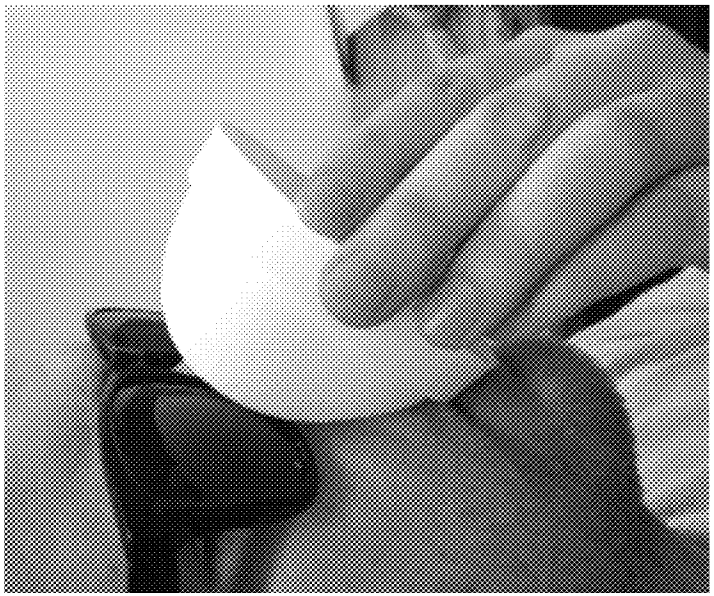
FIG. 63C shows an implementation of a lid.

FIGS. 63A-63D show an implementation of a lid 6301 that includes a cover 6302 for an aroma opening 6303. FIG. 63A shows a top view of the lid with the cover off. FIG. 63B shows a top view of the lid with the cover on. FIG. 63C shows an implementation of a domed lid 6311 that is round on the top. As shown in the figure, when a user wears glasses, the rounded top contacts the glasses and the user is obstructed from tilting the lid further. FIG. 63D shows lid 6301. Cover 6302 has a concave portion 6305 (can also be referred to as a wave). The concave portion allows a user to drink comfortably while wearing glasses because the concave portion does not obstruct the user from tilting the lid further.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A lid cover apparatus for a beverage container comprising:

a rim, wherein the rim is circular and fits on an open top of the beverage container, and the rim comprises a seal that mates with an edging formed on the top of the beverage container to create a leakproof seal, the rim elastically stretches to fit over the edging of the top of the beverage container and elastically contracts to its original size to couple against an outside of the top edging of the beverage container;

an upper covered portion, coupled to the rim, wherein the covered portion extends in a direction away from the beverage container opening when the lid cover is coupled to the beverage container;

a mouth opening formed in the upper covered portion of the lid cover; and an aroma opening formed in the upper covered portion of the lid cover, wherein the aroma opening is larger than the mouth opening, and the aroma opening extends further in a direction away from the beverage container than the mouth opening, the aroma opening comprises an aroma opening covering, and to allow use by the user, the aroma opening covering is pulled away from the upper covered portion to reveal the aroma opening, and when the lid cover is used by a user and the mouth is placed at the mouth opening to drink from the beverage container, at least a portion of the upper covered portion is above and forms over at least a portion of the user's nose, thus enveloping and exposing the nose to interior space of the beverage container while separating the nose from an exterior space outside the beverage container.

2. The apparatus of claim 1 wherein the mouth opening and aroma opening are merged to form a single opening.

3. The apparatus of claim 1 wherein the aroma opening covering is a removable and disposable piece of the upper covered portion.

4. The apparatus of claim 1 wherein the aroma opening covering can be opened and reclosed into the upper covered portion.

5. The apparatus of claim 1 wherein the aroma opening covering is removable and remains coupled to the upper covered portion, and the upper covered portion comprises at least one of a fastening peg or fastening groove that will retain the aroma opening covering in the open position, away from the aroma opening.

6. The apparatus of claim 1 wherein the mouth opening comprises a mouth opening covering, and to allow drinking by the user, the mouth opening covering is pulled away from the upper covered portion to reveal the mouth opening.

7. The apparatus of claim 1 wherein the upper covered portion comprises a dome shape.

8. The apparatus of claim 1 wherein aromas and fragrances from within the beverage container space can flow through the aroma opening to the nose and nostrils, unimpeded by a boundary or a lid wall of the lid cover.

9. The apparatus of claim 1 wherein the mouth opening and aroma opening are merged to form a single opening, and the upper covered portion comprises a dome shape.

10. A lid cover apparatus for a beverage container comprising:

a rim, wherein the rim is circular and fits on an opening at a top of the beverage container, and the rim mates with an edging at the top of the beverage container;

an upper covered portion, coupled to the rim, wherein the covered portion extends in a direction away from the beverage container opening when the lid cover is coupled to the beverage container;

a mouth opening formed in the upper covered portion of the lid cover; and an aroma opening formed in the upper covered portion of the lid cover, wherein the aroma opening is larger than the mouth opening, and the aroma opening extends further in a direction away from the beverage container than the mouth opening, the aroma opening comprises an aroma opening covering, and to allow use by the user, the aroma opening covering is pulled away from the upper covered portion to reveal the aroma opening, and when the lid cover is used by a user and the mouth is placed at the mouth opening to drink from the beverage container, at least a portion of the upper covered portion is above and forms over at least a portion of the user's nose, thus enveloping and exposing the nose to interior space of the beverage container while separating the nose from an exterior space outside the beverage container.

11. The apparatus of claim 10 wherein the rim stretches to fit over the edging at the top of the beverage container and contracts to couple against the top edging of the beverage container.

12. The apparatus of claim 10 wherein the mouth opening and aroma opening are merged to form a single opening.

13. The apparatus of claim 10 wherein the aroma opening covering is a removable and disposable piece of the upper covered portion.

14. The apparatus of claim 10 wherein the aroma opening covering can be opened and reclosed into the upper covered portion.

15. The apparatus of claim 10 wherein the aroma opening covering is removable and remains coupled to the upper covered portion, and the upper covered portion comprises at least one of a fastening peg or fastening groove that will retain the aroma opening covering in the open position, away from the aroma opening.

16. The apparatus of claim 10 wherein the mouth opening comprises a mouth opening covering, and to allow drinking by the user, the mouth opening covering is pulled away from the upper covered portion to reveal the mouth opening.

17. The apparatus of claim 10 wherein the upper covered portion comprises a dome shape.

18. The apparatus of claim 10 wherein the mouth opening and aroma opening are merged to form a single opening, and the upper covered portion comprises a dome shape.

19. A lid cover apparatus for a beverage container comprising:

a rim, wherein the rim fits on an opening at a top of the beverage container, and the rim couples with the top of the beverage container;

an upper covered portion, coupled to the rim, wherein the covered portion extends in a direction away from the beverage container opening when the lid cover is coupled to the beverage container;

a mouth opening formed in the upper covered portion of the lid cover;

an aroma opening formed in the upper covered portion of the lid cover, wherein the aroma opening is larger than the mouth opening, and the aroma opening extends further in a direction away from the beverage container than the mouth opening, and when the lid cover is used by a user and the mouth is placed at the mouth opening to drink from the beverage container, at least a portion of the upper covered portion is above and forms over at least a portion of the user's nose, thus enveloping and exposing the nose to interior space of the beverage container while separating the nose from an exterior space outside the beverage container; and an aroma opening covering that covers the aroma opening, wherein the aroma opening can be uncovered to reveal the aroma opening.

20. The apparatus of claim 19 wherein the mouth opening and aroma opening are merged to form a single opening.

* * * * *